US010472982B2

(12) United States Patent
Khan et al.

(10) Patent No.: US 10,472,982 B2
(45) Date of Patent: Nov. 12, 2019

(54) VARIABLE GEOMETRY TURBINE ASSEMBLY

(71) Applicant: Cummins Ltd, Huddersfield (GB)

(72) Inventors: Mohammed Hanif Khan, Birmingham (GB); David Camus, Goole (GB); Frederick Carter, Huddersfield (GB); David Andrew Luck, West Yorkshire (GB); Owen Wallbank, Harrogate (GB); Robert L. Holroyd, Halifax (GB)

(73) Assignee: Cummins Ltd., Huddersfield (GB)

( * ) Notice: Subject to any disclaimer, the term of this patent is extended or adjusted under 35 U.S.C. 154(b) by 511 days.

(21) Appl. No.: 15/308,905

(22) PCT Filed: May 7, 2015

(86) PCT No.: PCT/GB2015/051346
§ 371 (c)(1),
(2) Date: Nov. 4, 2016

(87) PCT Pub. No.: WO2015/170106
PCT Pub. Date: Nov. 12, 2015

(65) Prior Publication Data

US 2017/0067359 A1 Mar. 9, 2017

(30) Foreign Application Priority Data

May 7, 2014 (GB) ..... 1408087.3

(51) Int. Cl.
*F01D 17/14* (2006.01)
*F01D 17/16* (2006.01)

(52) U.S. Cl.
CPC ..... *F01D 17/143* (2013.01); *F01D 17/165* (2013.01); *F05D 2220/40* (2013.01)

(58) Field of Classification Search
CPC ..... F01D 17/143; F01D 17/165
See application file for complete search history.

(56) References Cited

U.S. PATENT DOCUMENTS 3,478,955 A 11/1969 Kunderman
4,349,312 A 9/1982 Stieger
(Continued)

FOREIGN PATENT DOCUMENTS

CN 103016070 A 4/2013
DE 4218229 C1 3/1993
(Continued)

OTHER PUBLICATIONS

Search Report issued by the United Kingdom Intellectual Property Office, dated Nov. 19, 2014, for Application No. GB 1408087.3; 3 pages.
(Continued)

*Primary Examiner* — Woody A Lee, Jr.
(74) *Attorney, Agent, or Firm* — Faegre Baker Daniels LLP

(57) ABSTRACT

A variable geometry turbine assembly comprising an inlet passageway, extending radially inwards towards a turbine wheel, defined between a surface of a movable wall member and a facing wall and an actuation mechanism arranged to move the movable wall member axially and comprising a cam member provided with at least one formation and a carrier member axially coupled to at least one co-operating formation, wherein one of the at least one formation and the at least one co-operating formation is a radially extending formation, the at least one formation or the at least one co-operating formation extending in both the circumferential direction and the axial direction such that as the cam member is rotated relative to the carrier member, the at least one formation and the at least one co-operating formation
(Continued)

engage such the movable wall member is moved in the axial direction.

20 Claims, 66 Drawing Sheets

(56) References Cited

U.S. PATENT DOCUMENTS

| | | | | |
|---|---|---|---|---|
| 4,886,416 | A | 12/1989 | Wunderlich | |
| 5,851,104 | A | 12/1998 | Dakin et al. | |
| 7,396,204 | B2 | 7/2008 | Shiraishi et al. | |
| 8,967,956 | B2 | 3/2015 | Arnold et al. | |
| 9,556,882 | B2 * | 1/2017 | Heidingsfelder | F01D 17/165 |
| 9,816,434 | B1 * | 11/2017 | Luck | F02B 37/22 |
| 2004/0025504 | A1 | 2/2004 | Perrin et al. | |
| 2004/0109757 | A1 | 6/2004 | Nenstiel | |
| 2004/0244372 | A1 | 12/2004 | Leavesley | |
| 2005/0262841 | A1 * | 12/2005 | Parker | F01D 17/14 60/602 |
| 2015/0345376 | A1 * | 12/2015 | Ibaraki | F02B 37/22 60/605.1 |

FOREIGN PATENT DOCUMENTS

| | | | |
|---|---|---|---|
| DE | 102004003210 | A1 | 8/2005 |
| DE | 10 2008 032497 | | 1/2010 |
| DE | 10 2008 060251 | | 6/2010 |
| EP | 2 573 363 | | 3/2013 |
| GB | 2408779 | A | 6/2005 |
| GB | 2503029 | A | 12/2013 |
| WO | WO0020726 | A1 | 4/2000 |
| WO | WO2005017321 | A1 | 2/2005 |

OTHER PUBLICATIONS

Letter Exam Report issued by The State Intellectual Property Office, Chinese Patent Office, People's Republic of China, dated Jul. 2, 2018, for related Chinese priority Application No. 2018062702165430; 5 pages.

International Search Report and Written Opinion dated Aug. 10, 2015 in PCT/GB2015/051346.

* cited by examiner 101
101a
5
102
26
3
7
4
38
14
20
28
11
31
15
9
101
32
14
10
5
8
19
2
202
33
24
201

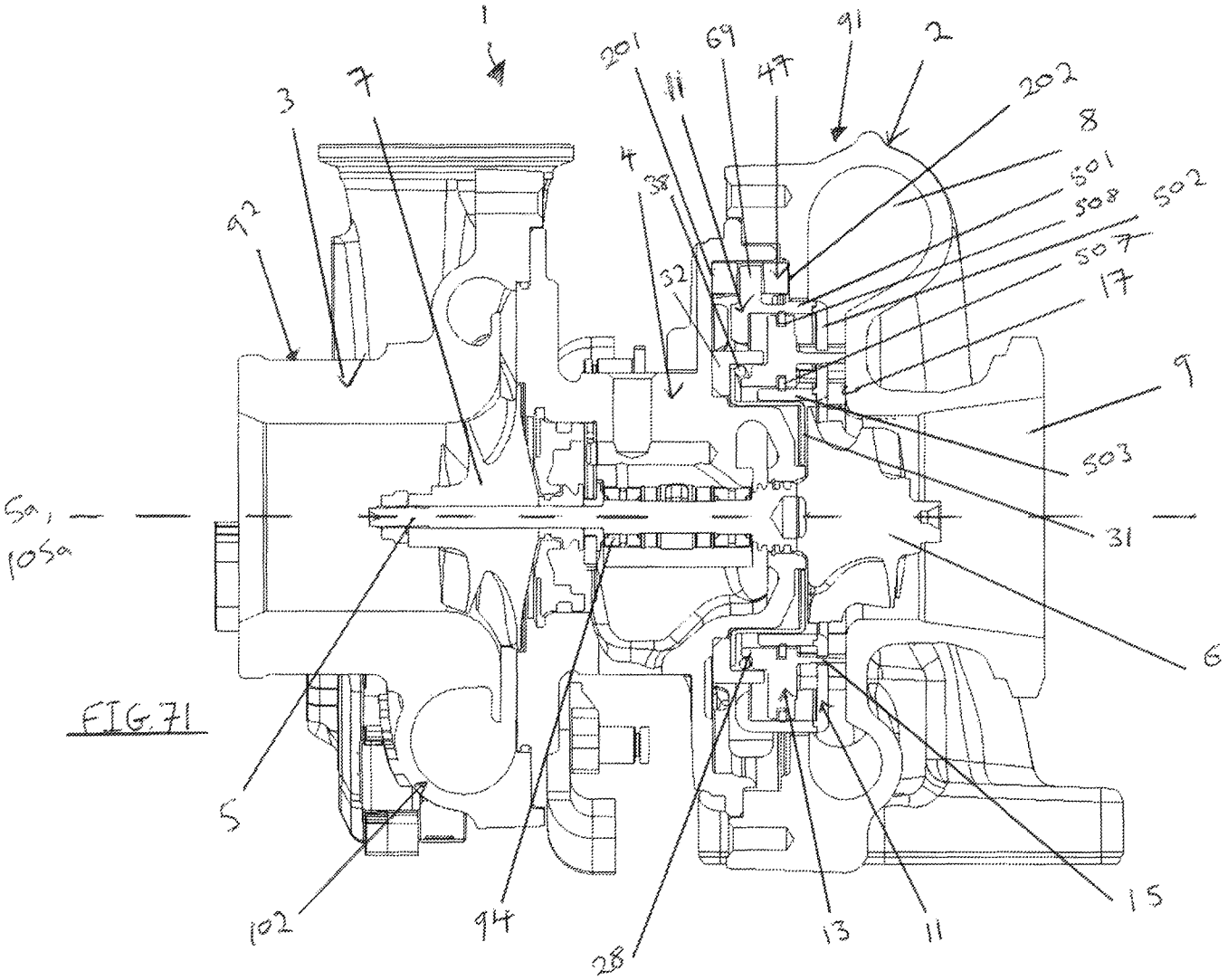
1
2
3
4
5
6
7
8
11
13
14
15
28
31
41
44
50a
50b
50c
50d
50e
50f
50g
102
102a
102b
102c
102d
102e
102f
102g
102h
102i
102j
102k
102l
102m
102n
102o
102p
102q
102r
102s
102t
102u
102v
102w
102x
102y
102z
102aa
102ab
102ac
102ad
102ae
102af
102ag
102ah
102ai
102aj
102ak
102al
102am
102an
102ao
102ap
102aq
102ar
102as
102at
102au
102av
102aw
102ax
102ay
102az
102ba
102bb
102bc
102bd
102be
102bf
102bg
102bh
102bi
102bj
102bk
102bl
102bm
102bn
102bo
102bp
102bq
102br
102bs
102bt
102bu
102bv
102bw
102bx
102by
102bz
102ca
102cb
102cc
102cd
102ce
102cf
102cg
102ch
102ci
102cj
102ck
102cl
102cm
102cn
102co
102cp
102cq
102cr
102cs
102ct
102cu
102cv
102cw
102cx
102cy
102cz
102da
102db
102dc
102dd
102de
102df
102dg
102dh
102di
102dj
102dk
102dl
102dm
102dn
102do
102dp
102dq
102dr
102ds
102dt
102du
102dv
102dw
102dx
102dy
102dz
102ea
102eb
102ec
102ed
102ee
102ef
102eg
102eh
102ei
102ej
102ek
102el
102em
102en
102eo
102ep
102eq
102er
102es
102et
102eu
102ev
102ew
102ex
102ey
102ez
102fa
102fb
102fc
102fd
102fe
102ff
102fg
102fh
102fi
102fj
102fk
102fl
102fm
102fn
102fo
102fp
102fq
102fr
102fs
102ft
102fu
102fv
102fw
102fx
102fy
102fz
102ga
102gb
102gc
102gd
102ge
102gf
102gg
102gh
102gi
102gj
102gk
102gl
102gm
102gn
102go
102gp
102gq
102gr
102gs
102gt
102gu
102gv
102gw
102gx
102gy
102gz
102ha
102hb
102hc
102hd
102he
102hf
102hg
102hh
102hi
102hj
102hk
102hl
102hm
102hn
102ho
102hp
102hq
102hr
102hs
102ht
102hu
102hv
102hw
102hx
102hy
102hz
102ia
102ib
102ic
102id
102ie
102if
102ig
102ih
102ii
102ij
102ik
102il
102im
102in
102io
102ip
102iq
102ir
102is
102it
102iu
102iv
102iw
102ix
102iy
102iz
102ja
102jb
102jc
102jd
102je
102jf
102jg
102jh
102ji
102jj
102jk
102jl
102jm
102jn
102jo
102jp
102jq
102jr
102js
102jt
102ju
102jv
102jw
102jx
102jy
102jz
102ka
102kb
102kc
102kd
102ke
102kf
102kg
102kh
102ki
102kj
102kk
102kl
102km
102kn
102ko
102kp
102kq
102kr
102ks
102kt
102ku
102kv
102kw
102kx
102ky
102kz
102la
102lb
102lc
102ld
102le
102lf
102lg
102lh
102li
102lj
102lk
102ll
102lm
102ln
102lo
102lp
102lq
102lr
102ls
102lt
102lu
102lv
102lw
102lx
102ly
102lz
102ma
102mb
102mc
102md
102me
102mf
102mg
102mh
102mi
102mj
102mk
102ml
102mm
102mn
102mo
102mp
102mq
102mr
102ms
102mt
102mu
102mv
102mw
102mx
102my
102mz
102na
102nb
102nc
102nd
102ne
102nf
102ng
102nh
102ni
102nj
102nk
102nl
102nm
102nn
102no
102np
102nq
102nr
102ns
102nt
102nu
102nv
102nw
102nx
102ny
102nz
102oa
102ob
102oc
102od
102oe
102of
102og
102oh
102oi
102oj
102ok
102ol
102om
102on
102oo
102op
102oq
102or
102os
102ot
102ou
102ov
102ow
102ox
102oy
102oz
102pa
102pb
102pc
102pd
102pe
102pf
102pg
102ph
102pi
102pj
102pk
102pl
102pm
102pn
102po
102pp
102pq
102pr
102ps
102pt
102pu
102pv
102pw
102px
102py
102pz
102qa
102qb
102qc
102qd
102qe
102qf
102qg
102qh
102qi
102qj
102qk
102ql
102qm
102qn
102qo
102qp
102qq
102qr
102qs
102qt
102qu
102qv
102qw
102qx
102qy
102qz
102ra
102rb
102rc
102rd
102re
102rf
102rg
102rh
102ri
102rj
102rk
102rl
102rm
102rn
102ro
102rp
102rq
102rr
102rs
102rt
102ru
102rv
102rw
102rx
102ry
102rz
102sa
102sb
102sc
102sd
102se
102sf
102sg
102sh
102si
102sj
102sk
102sl
102sm
102sn
102so
102sp
102sq
102sr
102ss
102st
102su
102sv
102sw
102sx
102sy
102sz
102ta
102tb
102tc
102td
102te
102tf
102tg
102th
102ti
102tj
102tk
102tl
102tm
102tn
102to
102tp
102tq
102tr
102ts
102tt
102tu
102tv
102tw
102tx
102ty
102tz
102ua
102ub
102uc
102ud
102ue
102uf
102ug
102uh
102ui
102uj
102uk
102ul
102um
102un
102uo
102up
102uq
102ur
102us
102ut
102uv
102uw
102ux
102uy
102uz
102va
102vb
102vc
102vd
102ve
102vf
102vg
102vh
102vi
102vj
102vk
102vl
102vm
102vn
102vo
102vp
102vq
102vr
102vs
102vt
102vu
102vv
102vw
102vx
102vy
102vz
102wa
102wb
102wc
102wd
102we
102wf
102wg
102wh
102wi
102wj
102wk
102wl
102wm
102wn
102wo
102wp
102wq
102wr
102ws
102wt
102wu
102wv
102ww
102wx
102wy
102wz
102xa
102xb
102xc
102xd
102xe
102xf
102xg
102xh
102xi
102xj
102xk
102xl
102xm
102xn
102xo
102xp
102xq
102xr
102xs
102xt
102xu
102xv
102xw
102xx
102xy
102xz
102ya
102yb
102yc
102yd
102ye
102yf
102yg
102yh
102yi
102yj
102yk
102yl
102ym
102yn
102yo
102yp
102yq
102yr
102ys
102yt
102yu
102yv
102yw
102yx
102yy
102yz
102za
102zb
102zc
102zd
102ze
102zf
102zg
102zh
102zi
102zj
102zk
102zl
102zm
102zn
102zo
102zp
102zq
102zr
102zs
102zt
102zu
102zv
102zw
102zx
102zy
102zz

VARIABLE GEOMETRY TURBINE ASSEMBLY

CROSS-REFERENCE TO RELATED APPLICATIONS

This application is the national phase of International Application No. PCT/GB2015/051346, titled "VARIABLE GEOMETRY TURBINE ASSEMBLY", filed on May 7, 2015, which claims the benefit of priority to British Patent Application No. 1408087.3 titled "VARIABLE GEOMETRY TURBINE ASSEMBLY", filed with the United Kingdom Intellectual Property Office on May 7, 2014, the disclosures of which are incorporated herein by reference.

FIELD OF THE DISCLOSURE

The present disclosure relates to a variable geometry turbine assembly. The present disclosure relates to a variable geometry turbine assembly of a variable geometry turbomachine and particularly, but not exclusively, of a variable geometry turbocharger. The present disclosure also relates to an actuation mechanism for moving a movable wall member of a variable geometry turbine.

BACKGROUND

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In known turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. It is also known to improve turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine an axially moveable wall member, generally referred to as a "nozzle ring" defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output. The nozzle ring is provided with vanes which extend into the inlet and through slots provided in a "shroud" defining the facing wall of the inlet passageway to accommodate movement of the nozzle ring. The vanes are at a fixed angle relative to the radius of the nozzle ring. A variable geometry turbocharger including such a variable geometry turbine is for instance disclosed in U.S. Pat. No. 5,868,552.

In different arrangements the nozzle ring is fixed and the shroud is axially moveable so as to control the axial width of the inlet passageway.

In current variable geometry turbochargers the moveable wall member (i.e. the nozzle ring or the shroud) is mounted on the end of push rods that are attached, at their other end, to a rotating yoke pivoting in an arc about a cross shaft. The yoke is arranged such that its rotation moves the push rods in the axial direction, so as to move the moveable wall member in the axial direction.

The yoke and push rods are mounted internally to the bearing housing. In this case, seals are required where the push rods pass through the bearing housing wall into the turbine housing. These seals are relatively expensive and require water cooling, which increases the complexity and cost of the variable geometry to the charger.

In an alternative arrangement, the push rods and the yoke are mounted in a cavity in the turbine housing. This arrangement does not require the seals of the bearing housing mounted arrangement. However, this arrangement is large and bulky in nature to allow for the mounting of the moveable wall member, push rods, and yoke. This results in a large overall turbine housing, which also increases its thermal inertia. Furthermore, due to the large cavities required to house all of the moving components, an increased pressure differential is experienced during filling and scavenging of the exhaust gas in the housing.

SUMMARY

It is one object of the present disclosure to obviate or mitigate the aforesaid disadvantages. It is also an object of the present disclosure to provide for an improved or alternative variable geometry turbine assembly. It is also an object of the present disclosure to provide for an improved or alternative actuation mechanism for a movable wall member of a variable geometry turbine assembly.

According to a first aspect of the disclosure there is provided a variable geometry turbine assembly comprising:

- a turbine wheel mounted within a turbine housing for rotation about a turbine axis;
- an annular inlet passageway extending radially inwards towards the turbine wheel;
- the annular inlet passageway being defined between a surface of a movable wall member and a facing wall;
- the movable wall member being movable in the axial direction so as to vary the size of the annular inlet passageway,
- and an actuation mechanism arranged to move the movable wall member axially relative to the facing wall;

the actuation mechanism comprising:

a carrier member, the carrier member being movable in the axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

the turbine assembly further comprising a nozzle ring having a plurality of circumferentially distributed inlet vanes and an annular shroud provided with a plurality of slots for receiving the inlet vanes of the nozzle ring as the shroud is moved axially relative to the nozzle ring;

wherein the shroud comprises the movable wall member;

and the nozzle ring and shroud are mounted on the same axial side of the inlet passageway.

This is advantageous in that it provides a relatively compact variable geometry turbine arrangement. In addition, the cam member, carrier member and movable wall member can be formed as a self-contained cartridge that is relatively compact and easy to install.

Furthermore, the above arrangement does not require axial push rods to move the moveable wall member and so does not require the sealing arrangement necessary where push rods are used, which is relatively expensive, wears easily and requires water cooling. Therefore the above arrangement is relatively inexpensive, durable and compact.

It will be appreciated that where something is referred to as "radially extending" or "extending in the radial direction", this refers to extending generally in the radial direction (the radial direction relative to the turbine axis) and, unless otherwise stated, is not to be interpreted as specifically requiring that it extends substantially parallel to the radial direction.

Similarly, where something is referred to as "axially extending" or "extending in the axial direction" this refers to extending generally in the axial direction (the direction of the turbine axis) and, unless otherwise stated, is not to be interpreted as specifically requiring that it extends substantially parallel to the axial direction.

Optionally the nozzle ring comprises an annular radially extending wall, the plurality of circumferentially distributed inlet vanes extend axially inboard from an inboard surface of the radially extending wall and the annular shroud comprises an annular radially extending wall provided with said plurality of slots, wherein the radially extending wall of the nozzle ring is mounted axially outboard of the radial wall of the shroud.

Optionally the variable geometry turbine assembly comprises a bearing housing arranged to house at least one bearing that rotatably supports a shaft on which the turbine wheel is mounted and the shroud and the nozzle ring are mounted on the same axial side of the inlet passageway as the bearing housing.

Alternatively, the shroud and nozzle ring may be mounted on an opposite axial side of the inlet passageway to the bearing housing. In this regard, the shroud and nozzle ring may be mounted on the same axial side of the inlet passageway as the turbine housing.

Optionally the nozzle ring is substantially fixed in the axial direction. In this regard, the inlet vanes of the nozzle ring are disposed in the inlet passageway. The inlet vanes may extend substantially across the width of the inlet passageway.

Optionally the nozzle ring is also movable in the axial direction, so as to vary the axial extent of the inlet vanes in the inlet passageway.

Optionally the carrier member is annular. Optionally the carrier member extends in the circumferential direction about the turbine axis.

Optionally the cam member and the carrier member axially overlap for at least one axial position of the movable wall member.

Optionally the cam member is disposed radially outwardly of the movable wall member. Alternatively, the cam member may be disposed radially inwardly of the movable wall member.

Optionally the at least one formation and the at least one co-operating formation extend in both the circumferential direction and the axial direction. Preferably only the at least one formation or the at least one co-operating formation extends in both the circumferential direction and the axial direction.

According to a second aspect of the disclosure there is provided a variable geometry turbine assembly comprising:

a turbine wheel mounted within a turbine housing for rotation about a turbine axis;

an annular inlet passageway extending radially inwards towards the turbine wheel; the annular inlet passageway being defined between a surface of a movable wall member and a facing wall;

the movable wall member being movable in the axial direction so as to vary the size of the annular inlet passageway, and an actuation mechanism arranged to move the movable wall member axially relative to the facing wall;

the actuation mechanism comprising:

an annular carrier member, the carrier member being movable in the axial direction and coupled to the movable wall member such that as the carrier member is moved in the axial direction, the moveable wall member is moved in the axial direction a cam member mounted for rotation about the turbine axis;

the cam member is provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess to receive the radially extending formation, the at least one formation extending in both the circumferential direction and the axial direction;

the actuation mechanism is arranged such that as the cam member is rotated, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member and the carrier member axially overlap for at least one axial position of the movable wall member.

This is advantageous in that it provides a relatively compact variable geometry turbine arrangement. In addition, the cam member, carrier member and movable wall member can be formed as a self-contained cartridge that is relatively compact and easy to install.

Furthermore, the above arrangement does not require axial push rods to move the moveable wall member and so does not require the sealing arrangement necessary where push rods are used, which is relatively expensive, wears easily and requires water cooling. Therefore the above arrangement is relatively inexpensive, durable and compact.

Optionally the carrier member is annular. Optionally the carrier member extends in the circumferential direction about the turbine axis. Optionally the carrier member comprises an annular wall that extends in the circumferential direction about the turbine axis.

Optionally the cam member and the carrier member axially overlap for a plurality of axial positions of the movable wall member.

Optionally the turbine assembly further comprises a nozzle ring having a plurality of circumferentially distributed inlet vanes and an annular shroud provided with a plurality of slots for receiving the inlet vanes of the nozzle ring as the shroud is moved axially relative to the nozzle ring.

The nozzle ring and shroud may be mounted on the same or different sides of the inlet passageway. Where the shroud comprises the movable wall member, the nozzle ring and shroud may be mounted on the same axial side of the inlet passageway.

Optionally the cam member is disposed radially outwardly of the movable wall member. Alternatively, the cam member may be disposed radially inwardly of the movable wall member.

According to a third aspect of the disclosure there is provided there is provided a variable geometry turbine assembly comprising:

a turbine wheel mounted within a turbine housing for rotation about a turbine axis;

an annular inlet passageway extending radially inwards towards the turbine wheel; the annular inlet passageway being defined between a surface of a movable wall member and a facing wall;

the movable wall member being movable in the axial direction so as to vary the size of the annular inlet passageway, and an actuation mechanism arranged to move the movable wall member axially relative to the facing wall;

the actuation mechanism comprising:

a carrier member, the carrier member being movable in the axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member is disposed radially outwardly of the movable wall member.

This is advantageous in that it provides a relatively compact variable geometry turbine arrangement. In addition, the cam member, carrier member and movable wall member can be formed as a self-contained cartridge that is relatively compact and easy to install.

Furthermore, the above arrangement does not require axial push rods to move the moveable wall member and so does not require the sealing arrangement necessary where push rods are used, which is relatively expensive, wears easily and requires water cooling. Therefore the above arrangement is relatively inexpensive, durable and compact.

Optionally the cam member is annular. Optionally the cam member extends in the circumferential direction about the turbine axis.

Optionally the movable wall member is annular. Optionally the movable wall member extends in the circumferential direction about the turbine axis.

Optionally the turbine assembly further comprises a nozzle ring having a plurality of circumferentially distributed inlet vanes and an annular shroud provided with a plurality of slots for receiving the inlet vanes of the nozzle ring as the shroud is moved axially relative to the nozzle ring.

The nozzle ring and/or the shroud may comprise the movable wall member.

The nozzle ring and shroud may be mounted on the same or different sides of the inlet passageway. Where the shroud comprises the movable wall member, the nozzle ring and shroud may be mounted on the same axial side of the inlet passageway.

Optionally the carrier member is annular.

Optionally the cam member and the carrier member axially overlap for at least one axial position of the movable wall member.

Optionally the at least one formation and the at least one co-operating formation extend in both the circumferential direction and the axial direction. Preferably only the at least one formation or the at least one co-operating formation extends in both the circumferential direction and the axial direction.

Any of the first to the third aspects of the disclosure may comprise any of the following features, in any combination.

The movable wall member may be part of the shroud. In this case, the carrier member may be coupled to the shroud such that as the carrier member moves axially, the shroud moves axially. The carrier member may be part of the shroud such that as the carrier member moves axially, the shroud moves axially.

In this case, the shroud and nozzle ring may be mounted on the same axial side of the inlet passageway. The nozzle ring may be substantially fixed in the axial direction.

The movable wall member may be part of the nozzle ring. In this case, the carrier member may be coupled to the nozzle ring such that as the carrier member moves axially, the nozzle ring moves axially. The carrier member may be part of the nozzle ring such that as the carrier member moves axially, the nozzle ring moves axially.

In this case, the shroud and nozzle ring may be mounted on opposite axial sides of the inlet passageway. The shroud may be substantially fixed in the axial direction.

Optionally the nozzle ring comprises an annular radially extending wall, the plurality of circumferentially distributed inlet vanes extend axially inboard from an inboard surface of the radially extending wall and the annular shroud comprises an annular radially extending wall provided with said plurality of slots, wherein the radially extending wall of the nozzle ring is mounted axially outboard of the radial wall of the shroud.

Optionally the variable geometry turbine assembly comprises a bearing housing arranged to house at least one bearing that rotatably supports a shaft on which the turbine wheel is mounted and the shroud and the nozzle ring are mounted on the same axial side of the inlet passageway as the bearing housing.

Alternatively, the shroud and nozzle ring may be mounted on an opposite axial side of the inlet passageway to the bearing housing. In this regard, the shroud and nozzle ring may be mounted on the same axial side of the inlet passageway as the turbine housing.

Optionally the nozzle ring is substantially fixed in the axial direction. In this regard, the inlet vanes of the nozzle ring are disposed in the inlet passageway. The inlet vanes may extend substantially across the width of the inlet passageway.

Optionally the nozzle ring is also movable in the axial direction, so as to vary the axial extent of the inlet vanes in the inlet passageway.

Optionally the one of the at least one formation and the at least one co-operating formation that extends in both the circumferential direction and the axial direction is said complimentary recess and the other is said radially extending formation.

Optionally the at least one co-operating formation is said radially extending formation and the at least one formation defines said complimentary recess to receive the radially extending formation.

Optionally the at least one formation is said complimentary recess and extends in both the circumferential direction and the axial direction and the at least one co-operating formation is said radially extending formation.

Optionally the co-operating formation is part of the carrier member.

Alternatively, the at least one co-operating formation may be a separate entity to the carrier member. In this case, optionally the at least one co-operating formation is a radially extending coupling element. Optionally the carrier member has an annular wall provided with at least one radially extending bore and the at least one radially extending coupling element is received in the at least one radially extending bore such that as the at least one coupling element is moved in the axial direction, the carrier member is moved in the axial direction.

The at least one coupling element may be elongate, having a longitudinal axis that is substantially parallel to the radial direction. The longitudinal axis of the at least one coupling element may be substantially straight.

The at least one coupling element may be a pin. The at least one coupling element may be substantially cylindrical.

Optionally the one of the at least one formation and the at least one co-operating formation that extends in both the circumferential direction and the axial direction defines at least part of a helix. Optionally the one of the at least one formation and the at least one co-operating formation that extends in both the circumferential direction and the axial direction is substantially helical.

Optionally the complimentary recess is a radially extending slot.

The carrier member may be substantially rotationally fixed about the turbine axis.

Optionally the at least one formation is said complimentary recess and extends in both the circumferential direction and the axial direction and the at least one co-operating formation is said radially extending formation and a wall member is provided with at least one axially extending slot, the at least one co-operating formation being received in the at least one axially extending slot and wherein the actuation mechanism is arranged such that as the cam member is rotated relative to the carrier member, the at least one formation and the at least one co-operating formation engage such that the at least one co-operating formation is moved in the axial direction, along the at least one axially extending slot in said wall member, thereby moving the carrier member in the axial direction and thereby moving the movable wall member in the axial direction, so as to vary the width of the inlet passageway.

Optionally, where the shroud comprises the movable wall member, the nozzle ring and shroud are arranged such that as the shroud is moved axially, the engagement of the vanes with the slots guides the shroud in the axial direction. Optionally the engagement of the vanes with the slots limits the rotation of the shroud about the turbine axis, as the shroud is moved in the axial direction. Optionally the engagement of the vanes with the slots substantially prevents the shroud from rotating about the turbine axis, as the shroud is moved in the axial direction. Optionally the nozzle ring is substantially rotationally fixed about the turbine axis.

Optionally the nozzle ring and shroud are arranged such that as the shroud is moved axially, the engagement of the at least one formation and the at least one co-operating formation rotates the shroud such that, for each slot in the shroud, at least a portion of an inner surface that defines the slot abuts against an opposed surface of a vane of the nozzle ring that is received within the slot. This advantageously reduces leakage of exhaust gas from the inlet passageway, through the slots in the shroud.

Optionally the nozzle ring and shroud are arranged such that as the cam member is rotated in a first rotational direction, for each slot in the shroud, a first portion of an inner surface that defines the slot abuts against an opposed surface of a vane of the nozzle ring that is received within the slot and as the cam member is rotated in a second rotational direction, for each slot in the shroud, a second portion of an inner surface that defines the slot abuts against an opposed surface of a vane of the nozzle ring that is received within the slot. It will be appreciated that the first and second rotational directions are opposite to each other.

Optionally the variable geometry turbine assembly comprises a bearing housing arranged to house at least one bearing that rotatably supports a shaft on which the turbine wheel is mounted and the shroud and the actuation mechanism is mounted on the same axial side of the inlet passageway as the bearing housing.

Optionally where the at least one formation defines said complimentary recess, the recess is provided in a circumferential section of the cam ring that is of greater radial thickness than the remainder of the cam ring.

Optionally where the at least one formation defines said complimentary recess and the at least one co-operating formation is said radially extending formation and is part of the carrier member, the complimentary recess has an open end for receipt of the co-operating formation.

Optionally the cam member is provided with a plurality of said formations, distributed in the circumferential direction.

Optionally the carrier member is coupled to a plurality of said co-operating formations, distributed in the circumferential direction.

Optionally where the shroud comprises the movable wall member, the shroud also comprises the carrier member. Alternatively, the carrier member may be a separate entity to the shroud.

The nozzle ring may comprise the movable wall member. In this case, the nozzle ring may comprise the carrier member.

Optionally at least one seal is provided between the movable wall member and an adjacent surface such so as to substantially prevent exhaust gas from the inlet passageway passing outboard of the seal.

The seal may be mounted to the movable wall member, to move axially with the movable wall member. Alternatively, the seal may be axially fixed relative to said adjacent surface.

Where the shroud comprises said movable wall member, the shroud may be slidably mounted in the nozzle ring, with the at least one seal provided between a surface of the shroud and an opposed surface of the nozzle ring. The at least one seal may be provided between an annular axially extending flange of the seal, that extends inboard from a radial wall of the shroud that forms the movable wall member and an opposed surface of the nozzle ring.

Alternatively, or additionally, optionally said annular axially extending flange forms a radially inner flange, wherein the shroud comprises a radially outer annular axially extending flange that extends inboard from a radial wall of the shroud, wherein the at least one seal is provided between the radially outer flange and an opposed surface of the nozzle ring.

The nozzle ring may comprise a heat shield integrally formed with the nozzle ring and disposed between the turbine wheel and a component of the variable geometry turbine assembly, arranged to protect said component from the hot gases in the turbine.

The heat shield may be formed by a radially inner section of the nozzle ring, disposed between the turbine wheel and said component of the variable geometry turbine assembly.

The heat shield section may be made of a heat resistant material, including stainless steel (e.g. 304 or pI33), Inconel or any suitable heat resistant material.

The variable geometry turbine assembly may comprise a biasing member arranged to bias the tips of the guide vanes into contact with the facing wall. The biasing member may be a resiliently deformable annular member.

Optionally the heat shield is not attached to the nozzle ring and the biasing member is arranged to bias the tips of the guide vanes into contact with the facing wall without exerting an inboard axial force on the heat shield. In this regard, the heat shield may comprise an annular lip that is disposed outboard of the biasing member.

Preferably the actuation mechanism is arranged such that as the cam member is rotated relative to the carrier member in first and second rotational directions, the carrier member, and so the movable wall member, is moved in the first and second axial directions respectively.

Preferably the second axial direction is opposite to the first axial direction.

Preferably the second rotational direction is opposite to the first rotational direction.

The variable geometry turbine assembly may further comprise a support member comprising an annular wall, wherein the carrier member is axially slidably mounted on a radially outer surface of the annular wall of the support member. The carrier member may be mounted directly on the support member.

Preferred embodiments of the variable geometry turbine assembly of the first to the third aspects of the disclosure are the first to the fourth embodiments of the disclosure shown in FIGS. 1 to 95. The variable geometry turbine assembly of the first to the third aspects of the disclosure may have any of the features of the first to the fourth embodiments.

A wall member of the variably geometry turbine assembly may be provided with a formation that is arranged to engage with a complimentary formation on the nozzle ring, the carrier member, the cam member and/or the support member such that when the formations are engaged, the nozzle ring, carrier member, cam member and/or the support member is in a specific rotational orientation about the turbine axis.

The formation and complimentary formation may be a recess or protrusion, or vice versa. The wall member may be a wall member of a bearing housing.

The support member may be provided with the complimentary formation, such that when the formations are engaged, the support member is in a specific rotational orientation about the turbine axis, relative to the bearing housing. The support member may be provide with a second formation for engagement with a second complimentary formation on the nozzle ring or shroud such that when the second formation and second complimentary formation are engaged the nozzle ring or shroud, respectively, is in a specific rotational orientation about the turbine axis, relative to the support member.

The second formation and second complimentary formation may be a recess or protrusion, or vice versa.

According to a fourth aspect of the disclosure there is provided a variable geometry turbine assembly comprising:

- a turbine wheel mounted within a turbine housing for rotation about a turbine axis,
- an annular inlet passageway extending radially inwards towards the turbine wheel;
- the annular inlet passageway being defined between a surface of a movable wall member and a facing wall of the variable geometry turbine assembly;
- the movable wall member being movable in the axial direction so as to vary the size of the annular inlet passageway,
- and an actuation mechanism arranged to move the movable wall member axially relative to the facing wall;
- the actuation mechanism comprising:
- a carrier member, the carrier member being movable in the axial direction and coupled to the movable wall member such that as the carrier member is moved in the axial direction, the moveable wall member is moved in the axial direction, the carrier member having an annular wall provided with at least one radially extending bore;

at least one radially extending coupling element received in the at least one radially extending bore in the annular wall of the carrier member such that as the at least one coupling element is moved in the axial direction, the carrier member is moved in the axial direction;

a cam member mounted for rotation about the turbine axis, the cam member having an annular wall provided with at least one slot defined by at least one surface of the annular wall, the at least one slot extending in both the circumferential direction and the axial direction;

the at least one coupling element also being received in the at least one slot in the cam member, wherein a wall member is provided with at least one axially extending slot, the at least one coupling element also being received in at least one axially extending slot;

and wherein the actuation mechanism is arranged such that as the cam member is rotated about the turbine axis, the at least one slot in the annular wall of the cam member is moved relative to the at least one coupling element, with the at least one surface of the cam member that defines the at least one slot acting on the at least one coupling element to move the at least one coupling element in a the axial direction, along the at least one axially extending slot in said wall member, thereby moving the carrier member in the axial direction and thereby moving the movable wall member in the axial direction, so as to vary the width of the inlet passageway.

This is advantageous in that it provides a relatively compact variable geometry turbine arrangement. In addition, the cam member, carrier member and movable wall member can be formed as a self-contained cartridge that is relatively compact and easy to install.

Furthermore, the above arrangement does not require axial push rods to move the moveable wall member and so does not require the sealing arrangement necessary where push rods are used, which is relatively expensive, wears easily and requires water cooling. Therefore the above arrangement is relatively inexpensive, durable and compact.

The facing wall may be a facing wall of the housing.

Preferably the actuation mechanism is arranged such that as the cam member is rotated about the turbine axis in first and second rotational directions, the at least one slot in the cam member is moved relative to the at least one coupling element, with the at least one surface of the cam member that defines the at least one slot acting on the at least one coupling element to move the at least one coupling element in first and second axial directions respectively, along the at least one axially extending slot in said wall member, thereby moving the carrier member in the first and second axial directions respectively and thereby moving the movable wall member in the first and second axial directions respectively.

Preferably the second axial direction is opposite to the first axial direction.

Preferably the second rotational direction is opposite to the first rotational direction.

The carrier member may be axially fixed relative to the movable wall member. The carrier member may be rotationally fixed relative to the movable wall member. The carrier member may be fixed directly to the movable wall member The carrier member may be arranged such that it is rotationally fixed about the turbine axis. In this regard, preferably as the carrier member moves axially, it does not rotate about the turbine axis.

The at least one radially extending bore in the annular wall of the carrier member may extend along a longitudinal axis that is substantially parallel to the radial direction. The longitudinal axis of the at least one radially extending bore may be substantially straight.

The at least one coupling element may be axially fixed relative to the carrier member.

The at least one radially extending bore in the annular wall of the carrier member and the at least one coupling element may be arranged such that as the at least one coupling element is moved in the first and second axial directions, the carrier member is moved in the first and second axial directions respectively.

The at least one radially extending bore may have an axial extent that is substantially the same as, or slightly greater than, the axial extent of the at least one coupling element such that as the at least one coupling element is moved in the first and second axial directions, the carrier member is moved in the first and second axial directions respectively.

The annular wall of the carrier member may have a radially inner and/or outer surface that extends substantially parallel to the axial direction.

The annular wall of the carrier member and the annular wall of the cam member may be substantially concentric. The annular wall of the carrier member and the annular wall of the cam member may be substantially concentric with the turbine axis.

The cam member may be rotationally mounted on, and supported for rotation by, the carrier member. In this case, the carrier member may be mounted radially inwardly of the cam member. A radially inner surface of the cam member may bear against a radially outer surface of the annular wall of the carrier member, as the cam member rotates and/or as the carrier member moves axially. The at least one radially extending bore may extend radially inwardly from a first end, provided in a radially outer surface of the carrier member, to a second end.

Alternatively, the cam member may be mounted radially inwardly of the carrier member. In this case, the at least one radially extending bore may extend radially outwardly from a first end, provided in a radially inner surface of the carrier member, to a second end.

In each case, the second end of the bore may be closed, such that the bore is a blind bore.

The at least one coupling element may be elongate, having a longitudinal axis that is substantially parallel to the radial direction. The longitudinal axis of the at least one coupling element may be substantially straight.

The at least one coupling element may be a pin. The at least one coupling element may be substantially cylindrical.

The cam member may be rotationally mounted such that it is substantially fixed in the axial direction as it rotates. The cam member may be housed between first and second opposed radially extending surfaces that substantially fix the cam member in the axial direction as it rotates. The first and second radially extending surfaces may be a surface of a wall of the turbine housing and a surface of a wall of a bearing housing of the variably geometry turbine assembly respectively.

The annular wall of the cam member may have a radially inner and/or outer surface that extends substantially parallel to the axial direction.

The at least one slot in the annular wall of the cam member may extend substantially through the radial thickness of the annular wall.

The at least one slot in the annular wall of the cam member may be generally elongate, extending along a longitudinal axis.

The longitudinal axis of the at least one slot may be inclined at a substantially constant angle relative to the radial plane. In this respect, the radial plane is a plane that is substantially perpendicular to the turbine axis.

The longitudinal axis of the at least one slot may be inclined at an angle relative to the radial plane that varies along its length. This is advantageous in that it allows for a desired axial movement of the movable wall member for a certain rotational movement of the cam member.

In this case, the angle of the longitudinal axis relative to the radial plane may decrease from a first end of the slot to a second end of the slot such that the at least one slot forms a concave curve. The angle of the longitudinal axis relative to the radial plane may increase and then decrease from a first end of the slot to a second end of the slot such that the at least one slot forms a curved wave shape.

A surface of the wall member that defines the at least one axially extending slot in the wall member may be arranged such that as the at least one surface of the annular wall member of the cam member that defines the at least one slot acts on the at least one coupling element to move the at least one coupling element in the axial direction, along the at least one axially extending slot in the wall member, the surface of the wall member that defines the at least one axially extending slot reacts the force applied to the at least one coupling element by the at least one surface of the annular wall member of the cam member that defines the at least one slot such that the at least one coupling element is moved in the axial direction along the axially extending slot.

The at least one axially extending slot may extend along a longitudinal axis that does not extend in the circumferential direction (i.e. the circumferential direction relative to the turbine axis). The at least one axially extending slot may be substantially straight in the axial direction.

Optionally the at least one axially extending slot has a width in the circumferential direction that is substantially equal to, or slightly greater than, the width of the at least one coupling element in the circumferential direction such that the at least one coupling element is prevented from moving in the circumferential direction as it moves along the at least one axially extending slot.

The variable geometry turbine assembly may comprise an annular wall member, wherein the cam member is mounted radially inwardly of the annular wall member such that a radially outer surface of the annular wall of the cam member is opposed and adjacent to a radially inner surface of the annular wall member. The radially outer surface of the annular wall of the cam member may bear against the radially inner surface of the annular wall member as the cam member rotates.

The wall member that is provided with said at least one axially extending slot may be a wall member of a bearing housing of the variable geometry turbine assembly. Alternatively, said housing may be any other housing of the variable geometry turbine assembly.

The wall member that is provided with said at least one axially extending slot may be said annular wall member.

The at least one slot provided in the annular wall of the cam member, the at least one radially extending bore provided in the annular wall of the carrier member, the at least one axial slot provided in said wall member and the at least one coupling element may be a plurality of said slots, radially extending bores, axial slots and coupling elements respectively, wherein each coupling element is received in a respective said radially extending bore in the carrier member, in a respective said slot in the annular wall of the cam member and in a respective said axially extending slot in said wall member.

The plurality of radially extending bores in the annular wall of the carrier member may be distributed in the circumferential direction about the annular wall of the carrier member.

The plurality of slots in the annular wall of the cam member may be distributed in the circumferential direction about the annular wall of the cam member.

The plurality of axially extending slots in the wall member may be distributed in the circumferential direction about said wall member.

The variable geometry turbine assembly may further comprise a support member comprising an annular wall, wherein the carrier member is axially slidably mounted on a radially outer surface of the annular wall of the support member. The carrier member may be mounted directly on the support member.

The radially inner and/or radially outer surface of the annular wall of the support member may extend substantially parallel to the axial direction.

The support member may be made of stainless steel.

The support member and/or the carrier member may be provided with a coating that acts to reduce friction between the carrier member and the support member. Additionally, or alternatively, the support member may be provided with a coating of a material that is resistant to wear. The coating may be CM11. The support member and/or carrier member may be subjected to a boronised surface treatment.

The support member may be substantially fixed in the axial direction. The support member may be mounted on and fixed to a housing of the variable geometry turbine assembly. The housing may be a bearing housing.

At least one sealing element may be provided between the support member and the housing so as to provide a seal between the support member and the housing. The housing may be a bearing housing.

The at least one sealing element may be an annular seal. The at least one sealing element may extend substantially around the inner circumference of the support member. The at least one sealing element may be fixedly attached to the support member or the housing. The at least one sealing element may be mounted in a circumferential groove defined in the housing or in the support member.

At least one sealing element may be provided between the carrier member and the support member so as to provide a seal between the carrier member and the support member as the carrier member moves axially relative to the support member. The at least one sealing element may be an annular seal. The at least one sealing element may extend substantially around the inner circumference of the carrier member.

The at least one sealing element may be fixedly attached to the carrier member. The at least one sealing element may be mounted in a circumferential groove defined in the carrier member. Alternatively, the at least one sealing element may be fixedly attached to the support member. In this case, the at least one sealing element may be mounted in a circumferential groove defined in the support member.

Instead of being axially slidably mounted a support member, the carrier member may be axially slidably mounted on a housing of the variable geometry turbine assembly, such as a bearing housing.

The variable geometry turbine assembly may comprise a nozzle ring. The nozzle ring may be provided with a plurality of guide vanes distributed circumferentially about the nozzle ring that extend into the annular inlet passageway. Each guide vane may extend from a root to a tip.

The nozzle ring may be axially fixed relative to the facing wall of the housing. The nozzle ring may be axially and/or rotationally fixed to the support member.

The variable geometry turbine assembly may comprise an annular shroud. The annular shroud may comprise an annular wall provided with a plurality of slots, wherein each slot is arranged to receive a respective guide vane of the nozzle ring as the shroud is moved axially relative to the nozzle ring.

The moveable wall member may be the annular wall of a shroud.

The variable geometry turbine assembly may comprise a biasing member arranged to bias the tips of the guide vanes into contact with the facing wall of the housing. The biasing member may be a resiliently deformable annular member.

Alternatively, the movable wall member may be the nozzle ring. In this case the facing wall of the housing may be the annular wall of the shroud.

The actuation mechanism may be provided on the same axial side of the annular inlet passageway as the movable wall member. Alternatively, the actuation mechanism may be provided on the opposite axial side of the annular inlet passageway to the movable wall member.

The actuation mechanism may be mounted on the same side of the annular inlet passageway as a bearing housing of the variable geometry turbine assembly. Alternatively, the actuation mechanism may be mounted on the same side of the annular inlet passageway as the turbine housing.

The actuation mechanism may be mounted between a bearing housing and a turbine housing of the variable geometry turbine assembly.

The facing wall of the housing may be a wall of the turbine housing. Alternatively, the facing wall of the may be a wall of any other housing of the variably geometry turbine assembly, including a wall of a bearing housing.

The variable geometry turbine assembly may further comprise an actuator coupled to the cam member so as to rotate the cam member about the turbine axis. The actuator may be coupled to the cam member by rotatable arm, wherein the cam member is provided with a formation that engages with the arm such that rotation of the arm by the actuator rotates the cam member about the turbine axis. The formation may be a radially extending protrusion that defines a cavity for receipt of the arm.

The actuator may be any suitable actuator, including an electrical, pneumatic or hydraulic actuator.

The carrier member may be provided with at least one recessed portion so as to provide clearance for the rotation of the arm. The recess may be in the radial and/or axial directions. The carrier member may be provided with a plurality of said recessed portions distributed in the circumferential direction.

Where the nozzle ring is axially fixed, the nozzle ring may comprise a heat shield integrally formed with the nozzle ring and disposed between the turbine wheel and a component of the variable geometry turbine assembly, arranged to protect said component from the hot gases in the turbine.

The heat shield may be formed by a radially inner section of the nozzle ring, disposed between the turbine wheel and said component of the variable geometry turbine assembly.

The heat shield section may be made of a heat resistant material, including stainless steel (e.g. 304 or pI33), Inconel or any suitable heat resistant material.

The carrier member, movable wall member, cam member and the at least one coupling element may form a cartridge assembly. Where the variable geometry turbine assembly comprises said support member, the support member and optionally the nozzle ring may also form part of the cartridge assembly.

A wall member of the variably geometry turbine assembly may be provided with a formation that is arranged to engage with a complimentary formation on nozzle ring, the carrier member, the cam member and/or the support member such that when the formations are engaged, the nozzle ring, carrier member, cam member and/or the support member is in a specific rotational orientation about the turbine axis.

The formation and complimentary formation may be a recess and protrusion, or vice versa. The wall member may be a wall member of a bearing housing.

Any of the features of the fourth aspect of the disclosure may be combined with any of the features of any of the preceding aspects of the disclosure, in any combination. Similarly, any of the features of the preceding aspects of the disclosure may be combined with any of the features of the fourth aspect of the disclosure, in any combination.

A preferred embodiment of the variable geometry turbine assembly of the fourth aspect of the disclosure is the first embodiment of the disclosure shown in FIGS. 1 to 24*c*. The variable geometry turbine assembly of the fourth aspect of the disclosure may have any of the features of the first embodiment.

An actuator may be coupled to the cam member so as to rotate the cam member. The actuator may be any suitable actuator, including a pneumatic, hydraulic or electric actuator.

According to a fifth aspect of the disclosure there is provided an actuation mechanism assembly comprising an actuation mechanism for moving a movable wall member, a surface of which defines, with a facing wall, an annular inlet passageway of a turbine, so as to vary the width of the annular inlet passageway, the actuation mechanism comprising:

a carrier member, the carrier member being movable in an axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

the actuation member assembly further comprising a nozzle ring having a plurality of circumferentially distributed inlet vanes and an annular shroud provided with a plurality of slots for receiving the inlet vanes of the nozzle ring as the shroud is moved axially relative to the nozzle ring;

wherein the shroud comprises the movable wall member;

and the nozzle ring and shroud are mountable on the same axial side of the inlet passageway.

According to a sixth aspect of the disclosure there is provided an actuation mechanism for moving a movable wall member, a surface of which defines, with a facing wall, an annular inlet passageway of a turbine, so as to vary the width of the annular inlet passageway, the actuation mechanism comprising:

an annular carrier member, the carrier member being movable in an axial direction and for coupling to the movable wall member such that as the carrier member is moved in the axial direction, the moveable wall member is moved in the axial direction a cam member mounted for rotation;

the cam member is provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess to receive the radially extending formation, the at least one formation extending in both the circumferential direction and the axial direction;

the actuation mechanism is arranged such that as the cam member is rotated, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member and the carrier member axially overlap for at least one axial position of the movable wall member.

According to a seventh aspect of the disclosure there is provided there is provided an actuation mechanism assembly comprising an actuation mechanism and a movable wall member, wherein the actuation mechanism is for moving the movable wall member, a surface of which defines, with a facing wall, an annular inlet passageway of a turbine, so as to vary the width of the annular inlet passageway, the actuation mechanism comprising:

a carrier member, the carrier member being movable in an axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member is disposed radially outwardly of the movable wall member.

According to an eighth aspect of the disclosure there is provided an actuation mechanism for moving a movable wall member, a surface of which defines, with a facing wall of a housing, an annular inlet passageway of a turbine, so as to vary the width of the annular inlet passageway, the actuation mechanism comprising:

a carrier member for coupling to a movable wall member, a surface of which defines, with a facing wall of a housing, an annular inlet passageway of a turbine, such that as the carrier member is moved in the direction of a longitudinal axis of the carrier member, the moveable wall member is moved in the axial direction, the carrier member having an annular wall provided with at least one radially extending bore;

at least one radially extending coupling element being received in the at least one radially extending bore in the annular wall of the carrier member such that as the at least one coupling element is moved in the axial direction, the carrier member is moved in the axial direction;

a cam member mounted for rotation about said axis, the cam member having an annular wall provided with at least one slot defined by at least one surface of the annular wall, the at least one slot extending in both the circumferential direction and the axial direction;

the at least one coupling element also being received in the at least one slot in the cam member;

the at least one coupling element being for receipt in at least one axially extending slot in a wall member such that as the cam member is rotated about said axis, the at least one slot in the annular wall of the cam member is moved relative to the at least one coupling element, with the at least one surface of the cam member that defines the at least one slot acting on the at least one coupling element to move the at least one coupling element in a the axial direction, along the at least one axially extending slot in said wall member, thereby moving the carrier member in the axial direction and thereby moving the movable wall member in the axial direction, so as to vary the width of the inlet passageway.

According to a ninth aspect of the disclosure there is provided a turbomachine comprising a variable geometry turbine assembly according to any of the first to the fourth aspects of the disclosure.

The turbomachine may comprise a bearing housing arranged to house at least one bearing that rotatably supports a shaft on which the turbine wheel is mounted and wherein the wall member provided with the at least one axially extending slot is a wall member of the bearing housing.

The turbomachine may be a turbocharger, wherein the turbine wheel is mounted on a shaft, the turbocharger comprising a compressor having an impeller wheel rotatably mounted within a compressor housing and coupled to the shaft such that rotation of the turbine wheel rotates the compressor wheel thereby drawing air in through an inlet of the compressor, compressing the air and passing it to an outlet of the compressor.

Any features of any of the above aspects of the disclosure may be combined with any features of any other aspect of the disclosure in any combination. In this regard, the actuation mechanism of any of the fifth to the eighth aspects of the disclosure may have any feature of the variable geometry turbine assembly of any preceding aspect of the disclosure.

BRIEF DESCRIPTION OF THE DRAWINGS

Specific embodiments of the present disclosure will now be described, by way of example only, with reference to the accompanying drawings, in which:

FIG. 2 is an exploded perspective view of part of a variable geometry turbine and of a bearing housing of the variable geometry turbocharger shown in FIG. 1;

FIG. 27 is a view corresponding to that of FIG. 26, but with a circumferential section cut away for illustrative purposes;

FIG. 71 is an axial cross section through a variable geometry turbocharger according to a fourth embodiment of the present disclosure;

FIG. 72 is an exploded perspective view of part of a variable geometry turbine and of a bearing housing of the variable geometry turbocharger shown in FIG. 71;

DETAILED DESCRIPTION

Figure 1:
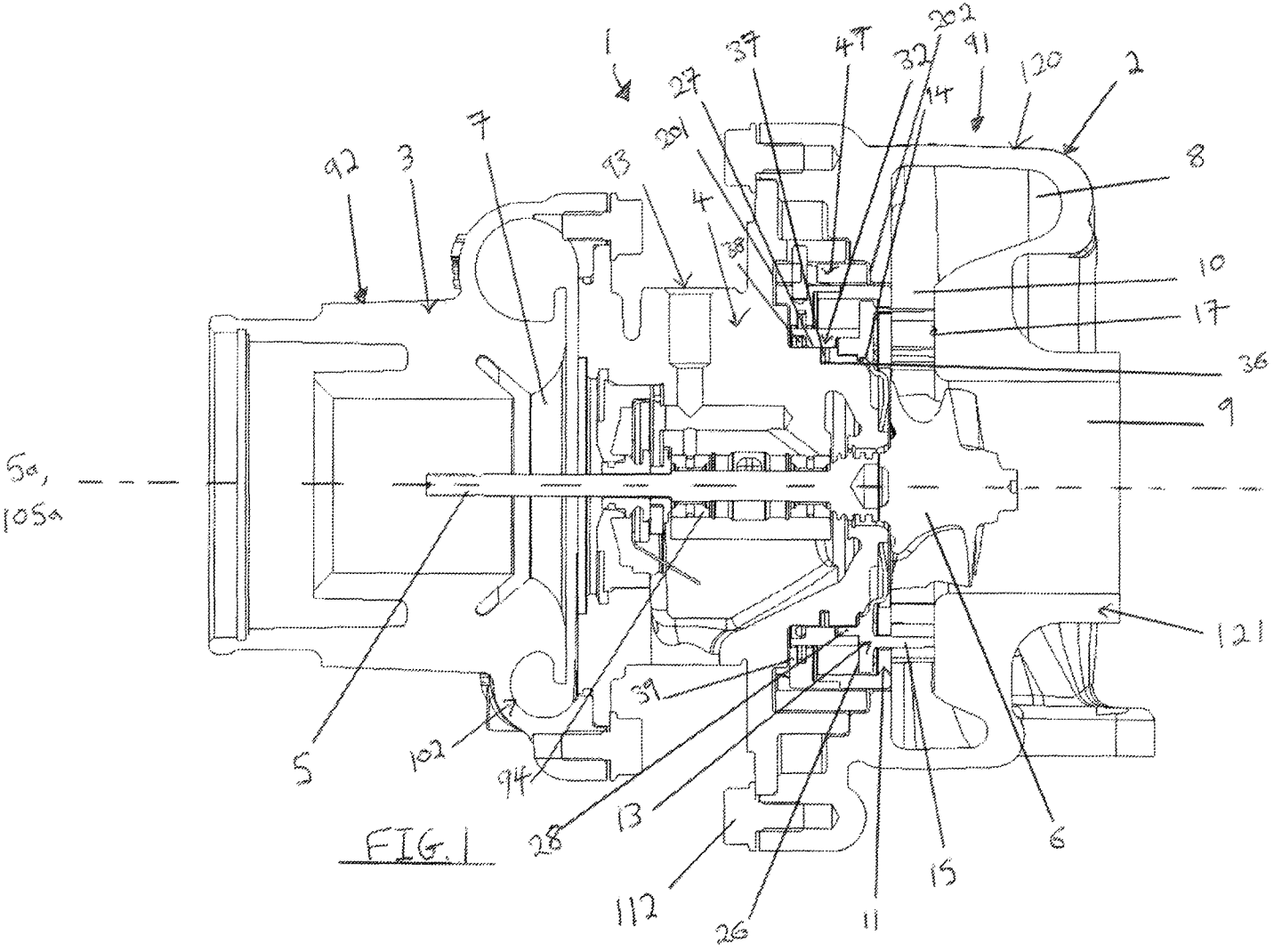
FIG. 1 is an axial cross section through a variable geometry turbocharger according to a first embodiment of the present disclosure.
Figure 7:
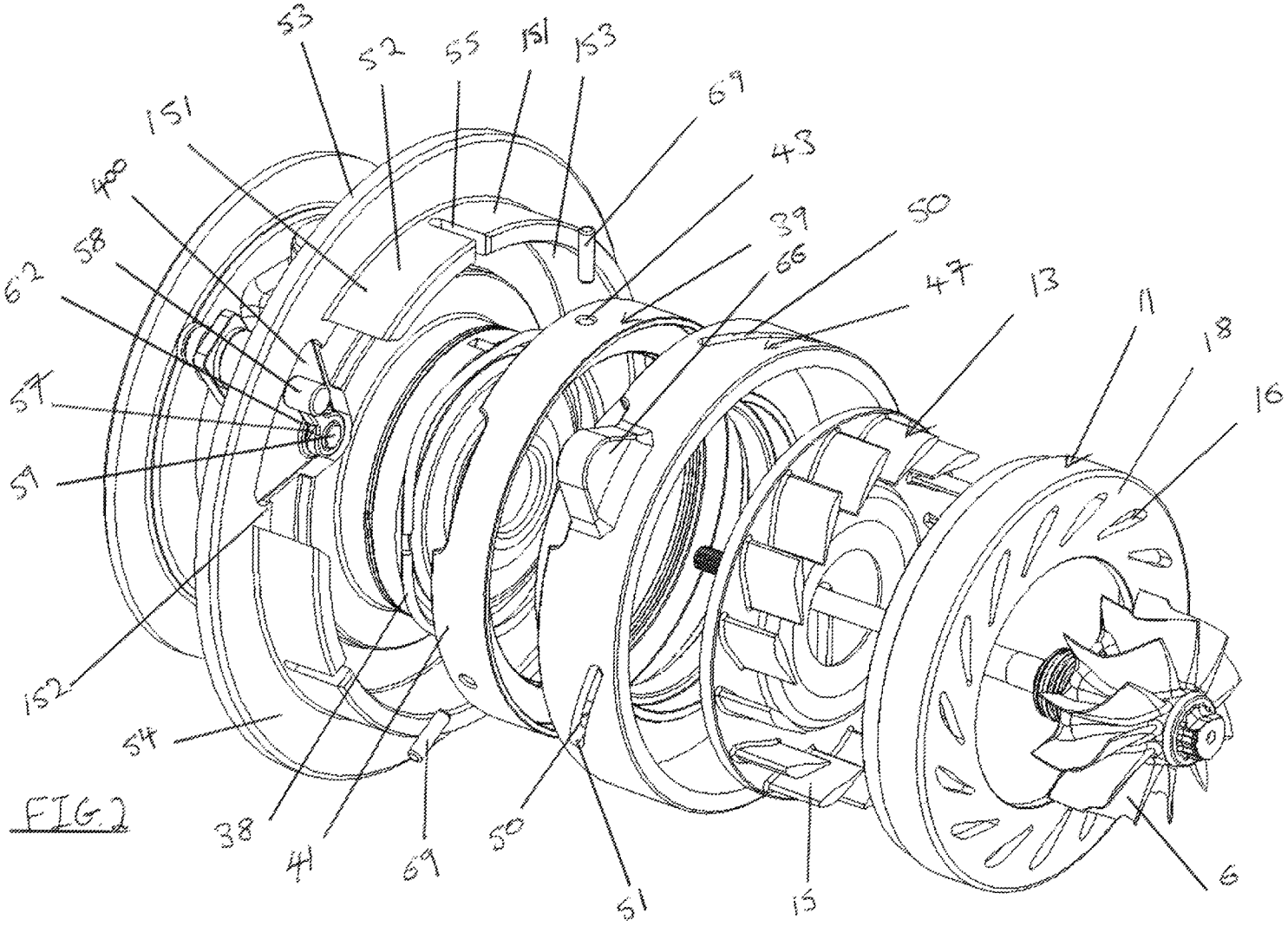
FIG. 7 is an axial cross-sectional view of the nozzle ring shown in FIG. 6.
Figure 3:
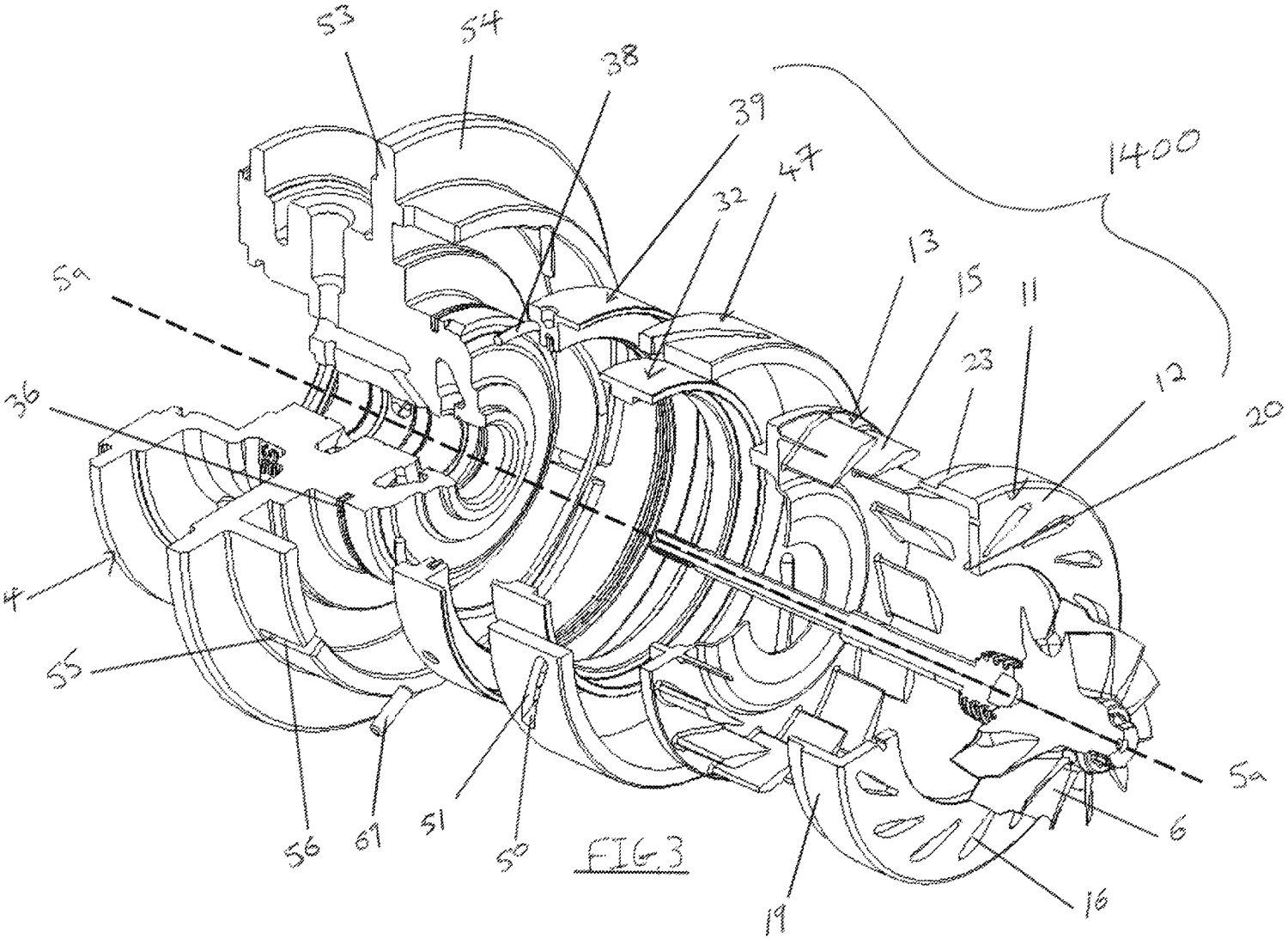
FIG. 3 is a view corresponding to that of FIG. 2, but with a circumferential section cut away for illustrative purposes.
Figure 4:
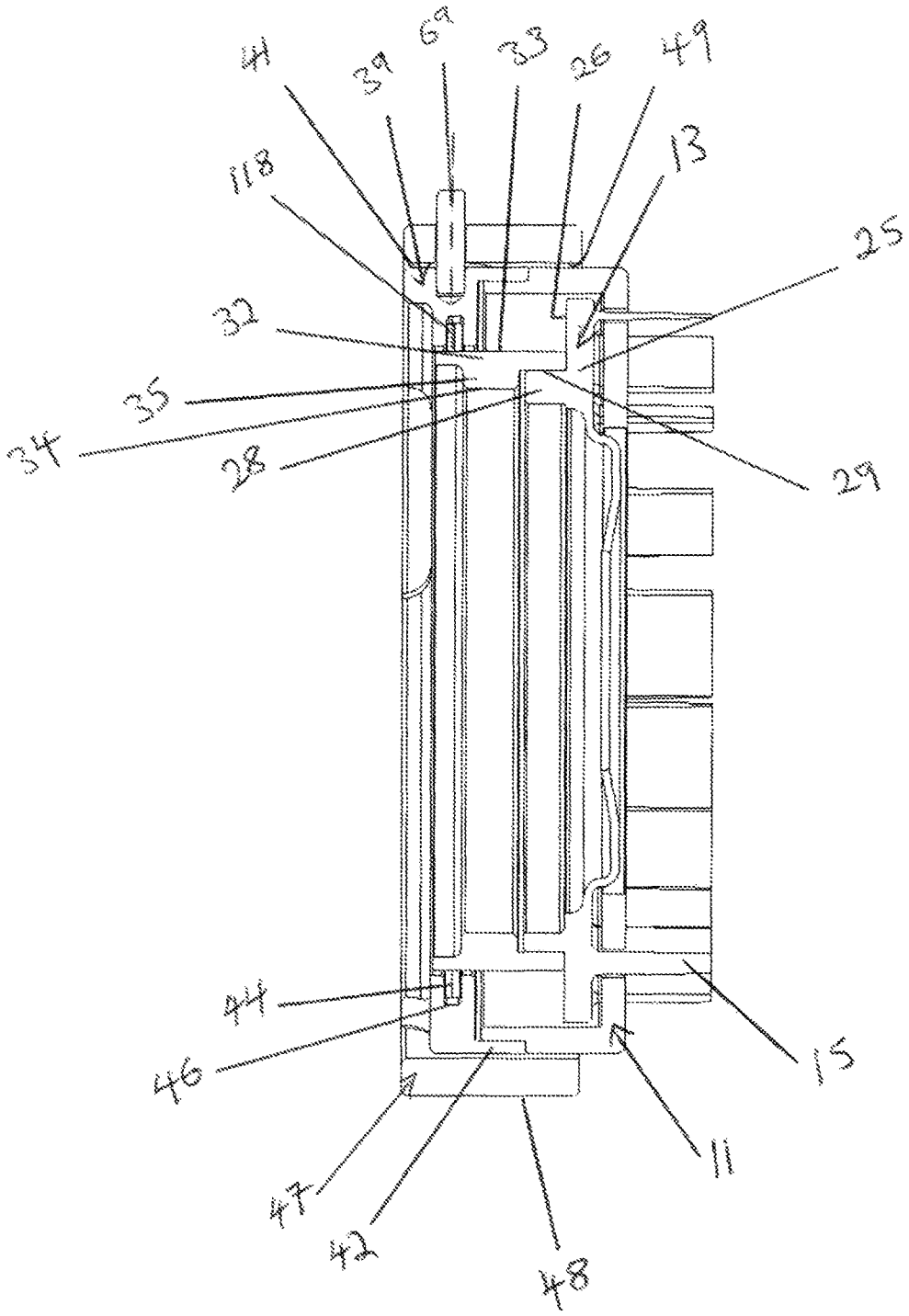
FIG. 4 is an axial cross-section through a cam member, carrier member, support member, shroud and nozzle ring of the variable geometry turbine shown in FIGS. 1 to 3.

Referring to FIGS. 1 to 24 there is shown a variable geometry turbocharger 1 comprising a variable geometry turbine assembly according to a first embodiment of the present disclosure. The variable geometry turbocharger 1 comprises a variable geometry turbine 61 connected to a compressor 92 by a bearing assembly 93.

In more detail, the variable geometry turbine 91 comprises a turbine housing 2 that is connected to a compressor housing 3 of the compressor 92 by a central bearing housing 4 of the bearing assembly 93.

The turbocharger 1 has a turbocharger axis 5*a*. The turbocharger 1 is generally symmetric about the turbocharger axis 5*a*. The variable geometry turbine 91 has a turbine axis 105*a*, which is coincident with and substantially parallel to the turbocharger axis 5*a*.

It will be appreciated that, unless otherwise stated, references to 'radially extending', 'radial', 'axially extending', 'axial', 'circumferentially extending' and 'circumferential' are in relation to the turbocharger axis 5*a* (and therefore also the turbine axis 105*a*).

A turbocharger shaft 5 extends from the turbine housing 2 to the compressor housing 3 through the bearing housing 4. A turbine wheel 6 is mounted on one end of the shaft 5 for rotation within the turbine housing 2 about the turbocharger axis 5*a*. The compressor wheel 7 is mounted on the other end of the shaft 5 for rotation within the compressor housing 3. The shaft 5 rotates about the turbocharger axis 5*a* and is supported for rotation by bearings 94 located in the bearing housing 4.

The turbine housing 2 defines an inlet volute 8 to which gas from an internal combustion engine (not shown) is delivered. The exhaust gas flows from the inlet volute 8 to an axial outlet passageway 9 via an annular inlet passageway 10 and the turbine wheel 6.

References to 'inboard' and 'outboard' are in relation to the annular inlet passageway 10.

Gas flowing from the inlet volute 8 to the outlet passageway 9 passes over the turbine wheel 6 and as a result torque is applied to the shaft 5 to drive the compressor wheel 7. Rotation of the compressor wheel 7 within the compressor housing 3 pressurises ambient air in an axial inlet 101 defined by the compressor housing 3 and delivers the pressurised air to an annular outlet volute 102 from which it is fed to an internal combustion engine (not shown). Details of the compressor 92 may be entirely conventional (for instance they may correspond to those of a known compressor) and therefore will not be described in further detail.

The inboard portion 110 of the bearing housing 4 (see below) and the turbine 91 together form a variable geometry turbine assembly according to a first embodiment of the disclosure.

The present disclosure is suitable for, but not limited to, a turbocharger. However, since the disclosure relates to the nature of a variable geometry turbine assembly, other details of a turbocharger incorporating the variable geometry turbine assembly of the present disclosure, such as other details of the bearing housing 4 and the compressor 3 will not be described in any further detail.

The turbine housing 2 comprises an inlet portion 120 and an outlet portion 121 which define the inlet volute 8 and the axial outlet passageway 9 respectively. The inlet portion 120 is attached to an axially inboard portion 110 (see FIG. 18) of the bearing housing 4 by a plurality of circumferentially spaced bolts 112. It will be appreciated that the turbine housing 2 may be fixedly attached to the bearing housing 4 by any suitable means of attachment, including by a V-band.

An annular cavity 24 is defined between the inboard section 110 of the bearing housing 4 and the inlet portion 120 of the turbine housing 2. The annular cavity 24 is substantially centred on the turbocharger axis 5*a*.

Figure 12:
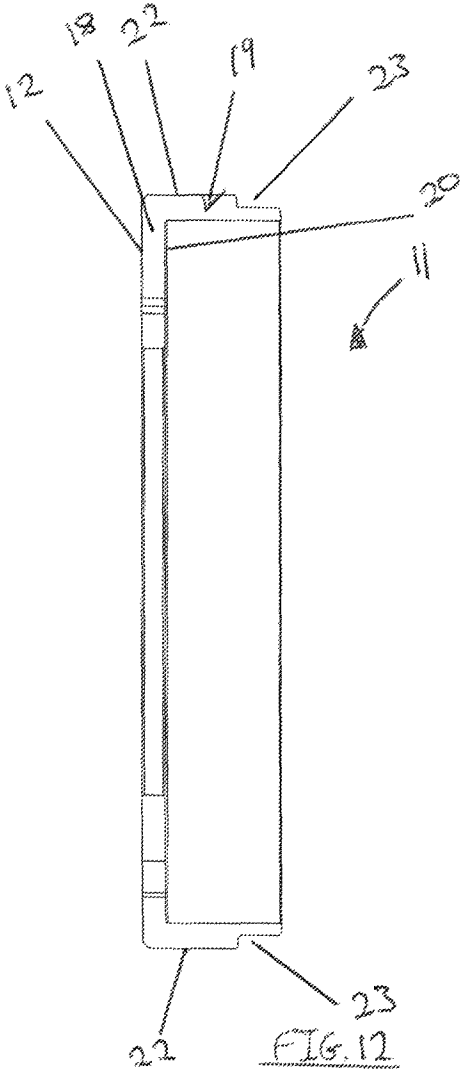
FIG. 12 is an axial cross-sectional view of the shroud shown in FIG. 11.
Figure 11:
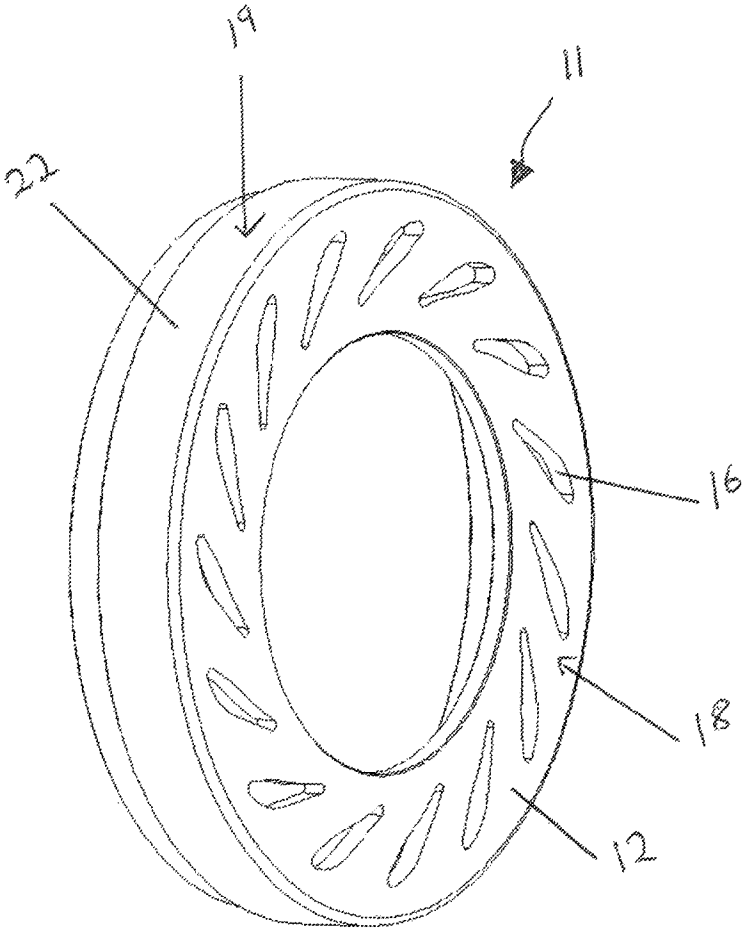
FIG. 11 is a front perspective view of a shroud of the variable geometry turbine shown in FIGS. 1 to 3.
Figure 13:
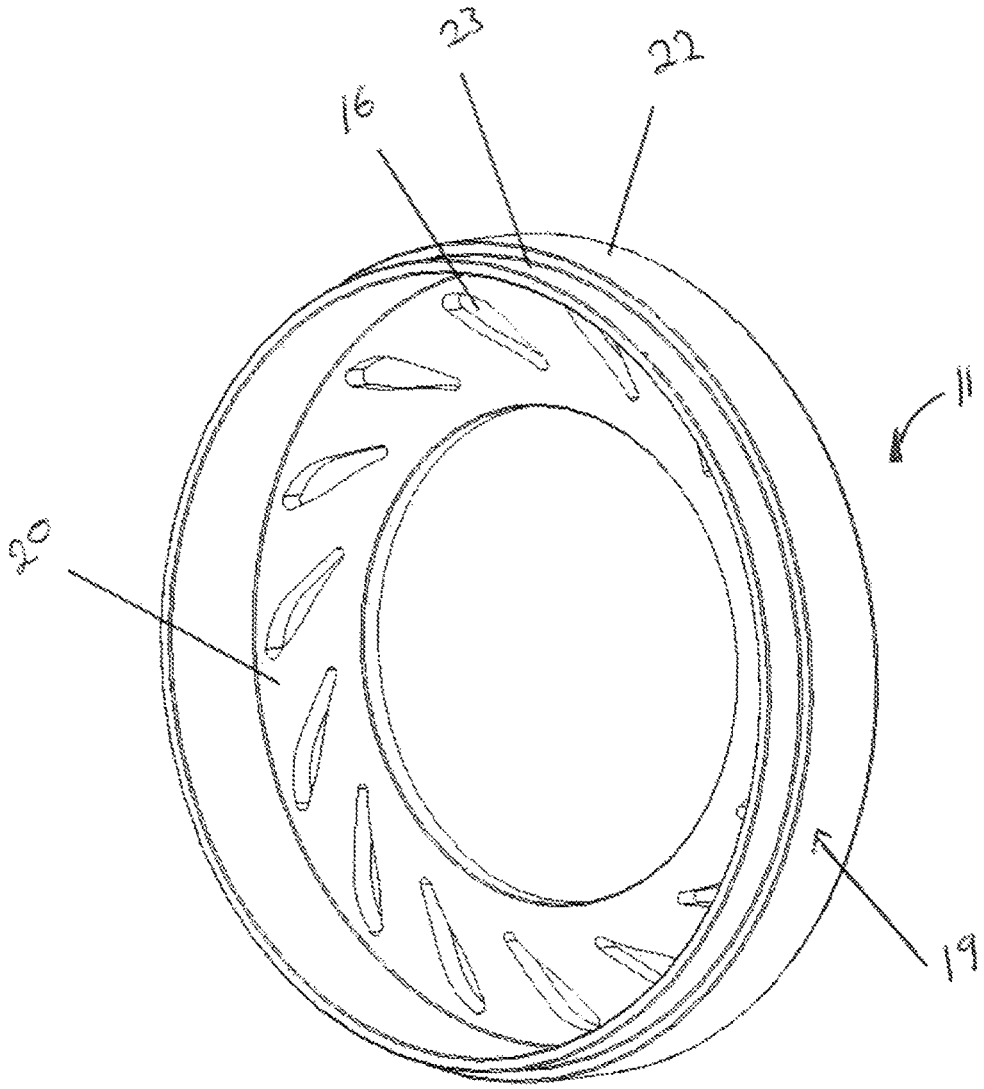
FIG. 13 is a rear perspective view of the shroud shown in FIGS. 11 and 12.

The variable geometry turbine 91 comprises an annular shroud 11 (as shown in more detail in FIGS. 11 to 13). The shroud 11 is generally annular and is substantially centered on the turbocharger axis 5*a* The shroud 11 comprises a radial annular wall 18 that has a radial inboard surface 12 and a radial outboard surface 20. The inboard and outboard radial surfaces 12, 20 are generally annular, are substantially centered on the turbocharger axis 5*a* and extend in the radial direction, substantially perpendicular to the turbocharger axis 5*a*.

The annular wall 18 is provided with a plurality of slots 16, wherein each slot 16 is arranged to receive a respective guide vane 15 of the nozzle ring 13 as the shroud 11 is moved axially relative to the nozzle ring 13 (see below).

The annular wall 18 forms a movable wall member to vary the width of the inlet passageway (as described in more detail below).

The shroud 11 further comprises an axially extending annular flange 19 that extends, in the axially outboard direction, away from the outer radial periphery of the axially outboard surface 20 of the shroud 11. The axially extending annular flange 19 is substantially parallel to the turbocharger axis 5*a*. The axially extending flange 19 has a section 23 towards its outboard end that is of reduced thickness, such that it defines an annular step.

The annular inlet passageway 10 is defined between the axially inboard surface 12 of the shroud 11 and a facing inboard surface 17 of the turbine housing 2. The facing inboard surface 17 of the turbine housing 2 is generally annular, is substantially centered on the turbocharger axis 5*a* and extends in the radial direction, substantially perpendicular to the turbocharger axis 5*a*. As will be described in more detail below, the shroud 11 is axially slidably mounted within the cavity 24, for axial movement relative to the inboard surface 17 of the turbine housing 2, so as to vary the width of the inlet passageway 10.

In this respect, the width of the inlet passageway 10 is varied to optimize gas flow velocities over a range of mass flow rates so that the power output of the turbine 91 can be varied to suit varying engine demands. For instance, when the volume of exhaust gas being delivered to the turbine 91 is relatively low, the velocity of the gas reaching the turbine wheel 6 is maintained at a level which ensures efficient turbine operation by reducing the size of the annular inlet passageway 10.

The inboard surface 12 (and the outboard surface 20) of the radial wall 18 of shroud 11 is provided on the same axially inboard side of the annular inlet passageway 10 as the bearing housing 4.

The variable geometry turbine 91 further comprises a fixed nozzle ring 13 (as shown in more detail in FIGS. 6 to 8), mounted within the cavity 24. The nozzle ring 13 is located within the radially outer, axially extending flange 19 of the shroud 11.

The nozzle ring 13 is generally annular and is substantially centered on the turbocharger axis 5*a* The nozzle ring 13 comprises an annular radially extending wall 25 having an axially inboard surface 14 and an axially outboard surface 26. The inboard and outboard surfaces 14, 26 extend in the radial direction, substantially perpendicular to the turbocharger axis 5*a*.

A plurality of circumferentially distributed inlet vanes 15 extend axially inboard from the inboard surface 14, into the annular inlet passageway 10. The vanes 15 each extend axially inboard from a root, at said inboard surface 14, to a tip, distal to said inboard surface 14. The inlet vanes 15 are arranged so as to deflect gas flowing through the inlet passageway 10 towards the direction of rotation of the turbine wheel 6.

In this respect, the radially extending wall 25 of the nozzle ring 13 is disposed axially outboard of the radial wall 18 of the shroud 11, with the inlet vanes 15 of the nozzle ring 13 extending through axial slots 16 in the radial wall 18 of the shroud 11, into the annular inlet passageway 10.

The nozzle ring 13 is fixed, both axially and rotationally, to the bearing housing 4. In this respect, an annular flange 28 extends from a radially outer section of the outboard surface 26 of the nozzle ring 13 in the axially outboard direction. A radially inner surface of the axially extending flange 28 is mounted on a radially outer surface 27 (see FIG. 1) of the inboard portion 110 of the bearing housing 4.

The nozzle ring 13 comprises an integral heat shield 31 formed by a radially inner annular portion of the nozzle ring 13.

The heat shield 31 of the nozzle ring 13 extends radially inwardly from a radially inner section of the inboard surface 14 of the radial wall 25 of the nozzle ring. The heat shield 31 is bent in the axial and radial directions to form an axial section 311 and a radial section 312. The axial section 311 extends from the radially inner periphery of the radial wall 25 of the nozzle ring 13, in the axially inboard direction. The radial section 312 is substantially axially aligned with the inboard surface 12 of the shroud 11. The radial section 312 extends radially inwardly, from an inboard end of the axial section 311, to substantially cover the region of the bearing housing 4 between the bearing housing 4 and the turbine wheel 6. Accordingly, the heat shield 31 protects this section of the bearing housing 4 from the hot exhaust gases in the turbine 2. The heat shield is made of a heat resistant material in the form of stainless steel (e.g. 304 or pI33) or Inconel. It will be appreciated that any suitable heat resistant material may be used.

The nozzle ring 13 is axially fixed to a support member 32, as described in more detail below.

The support member 32 is a substantially annular ring that is centered on the turbocharger axis 5*a*. The support member 32 is shown in more detail in FIGS. 4, 9 and 10.

The support member 32 comprises a generally annular wall member 131 having radially inner and outer annular surfaces 34, 33 respectively. The annular wall member 131 (and the radially inner and outer surfaces 34, 33) extend substantially parallel to the axial direction 5*a*.

The support member 32 is substantially fixed in the axial direction. In this regard, the radially inner surface 34 of the support member 32 is mounted on and axially (and rotationally) fixed to the radially outer surface 27 of the bearing housing 4.

The support member 32 is mounted on the bearing housing 4 with a slight radial clearance from the radially outer surface 27 of the bearing housing in order to ensure an axial sliding fit, for assembly. Tolerancing is applied to minimize 'slop' between these two components due to thermal expansion.

The radially inner surface 34 is provided, substantially midway along its axial length, with a radially inwardly extending annular flange 35. The support member 32 is mounted on the radially outer surface 27 of the inboard portion 110 of the bearing housing 4. In more detail, a radially inner surface 132 of the annular flange 35 is mounted on said radially outer surface 27 of the bearing housing 4. The support member 32 is mounted within the cavity 24, axially outboard of the radial wall 25 of the nozzle ring 13. The annular flange 35 and the radially inner surface 34 of the support member 32 form a stepped arrangement that is welded to a complimentary stepped arrangement formed by the radially outer surface 29, and an axially outboard end, of the axially extending flange 28 of the nozzle ring 13. In this way, the nozzle ring 13 is fixedly attached, both axially and rotationally, to the support member 32. It will be appreciated that the nozzle ring 13 may be fixedly attached to the support member 32 by any suitable means, including brazing.

An annular groove 36 is provided in the radially outer surface 27 of the inboard portion 110 of the bearing housing 4 (see FIG. 1). An annular ring seal 37 is located within the annular groove 36 and provides a seal between the radially outer surface 27 of the bearing housing 4 and the radially inner surface 132 of the annular flange 35 of the support member 32. This sealing arrangement prevents gas from flowing from the annular inner passageway 10, passed the ring seal 37. This facilitates the maintenance of a desired pressure differential across the radial wall 18 of the shroud 11. The seal 37 stops flow of gas into the cavity 24 between bearing housing and nozzle ring, maintaining the pressure differential for load balance.

A resiliently deformable annular tolerance ring 38 (see FIGS. 1 and 2) is sandwiched between the axially outboard side of the annular flange 35 of the support member 32 and an opposed surface of the bearing housing 4. The tolerance ring 38 provides an axially inboard force to the nozzle ring 13 via the support member 32. In this regard, as the turbine housing 2 is bolted onto the bearing housing 4, the facing wall 17 of the turbine housing 2 exerts a force on the tips of the inlet vanes 15, and therefore the nozzle ring 13, in the direction away from said facing wall 17, which acts to compress the tolerance ring 38. This pre-loads the tolerance ring 38, which causes it to exert a force in the opposite direction on the nozzle ring 13 via the support member 32, which is free floating on the bearing housing 4. In this regard, the support member 32 is slidably mounted on the bearing housing 4. This ensures that contact is maintained between the tips of the inlet vanes 15 and said facing wall 14 regardless of turbine gas pressure and pulsations. This also minimizes the flow of gas over the tips of the vanes 15 at small diffuser passageway 10 widths, thereby improving efficiency.

The inboard surface 14 of a radially outer section of the annular wall 25 of the nozzle ring 13 acts a stop that limits the axial position, in the outboard direction, of the shroud 11. In this regard, as the shroud 11 moves in the outboard direction (see below), the outboard surface 20 of the annular wall 18 of the shroud 11 abuts the inboard surface 14 of a radially outer section of the annular wall 25 of the nozzle ring 13, thereby acting as a stop to provide a desired maximum outboard position of the shroud 11.

The shroud 11 is moved in the axial direction, to vary the width of the annular inlet passageway 10, by the use of an actuation mechanism, which will now be described in detail.

Figure 15:
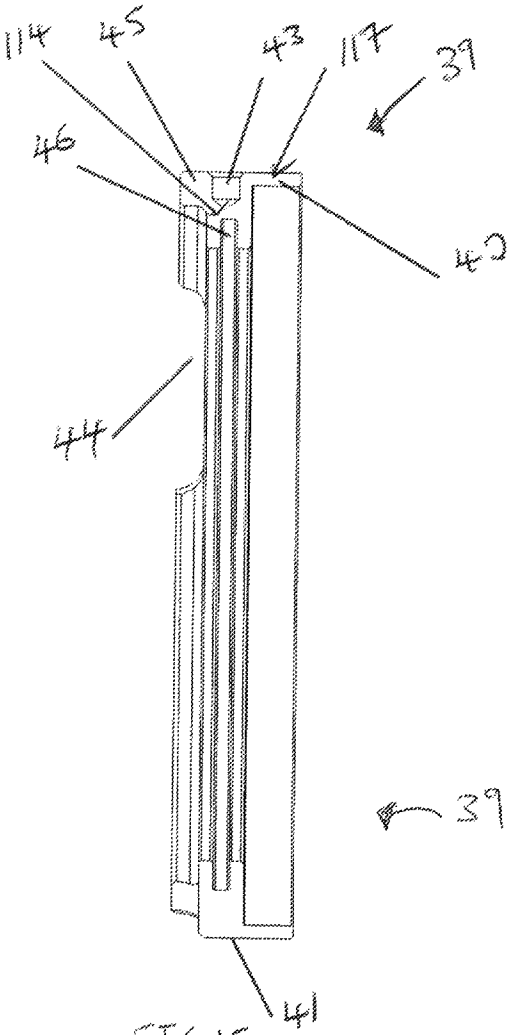
FIG. 15 is an axial cross-sectional view of the carrier member shown in FIG. 14.
Figure 14:
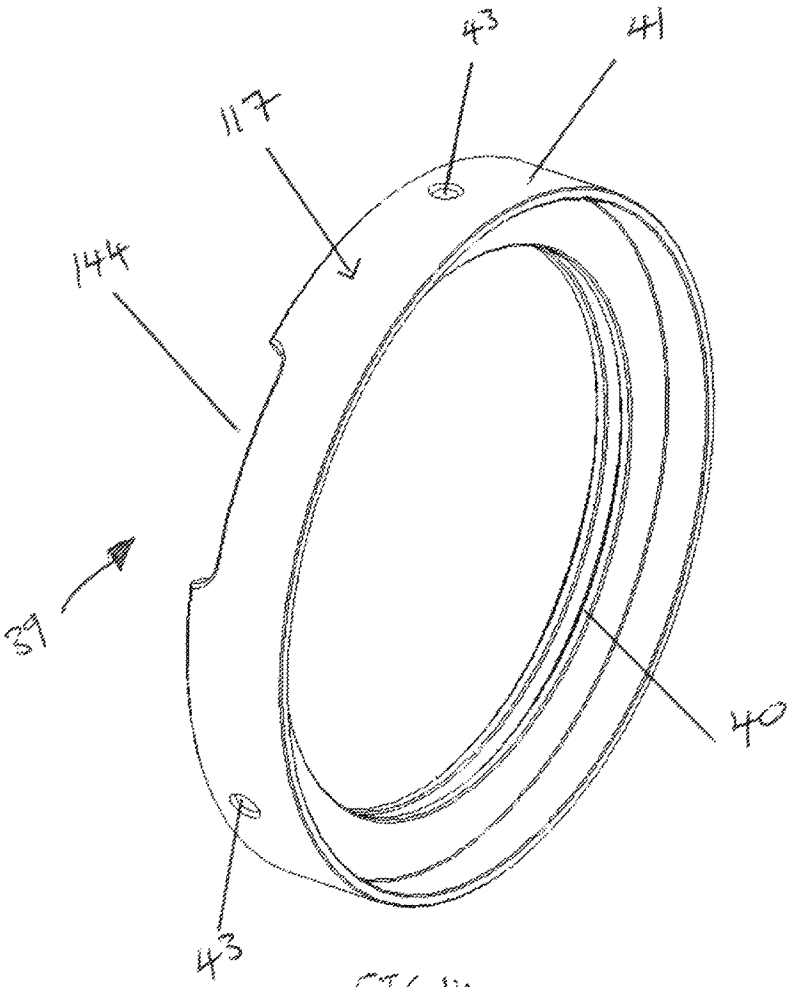
FIG. 14 is a front perspective view of a carrier member of the variable geometry turbine shown in FIGS. 1 to 3.
Figure 16:
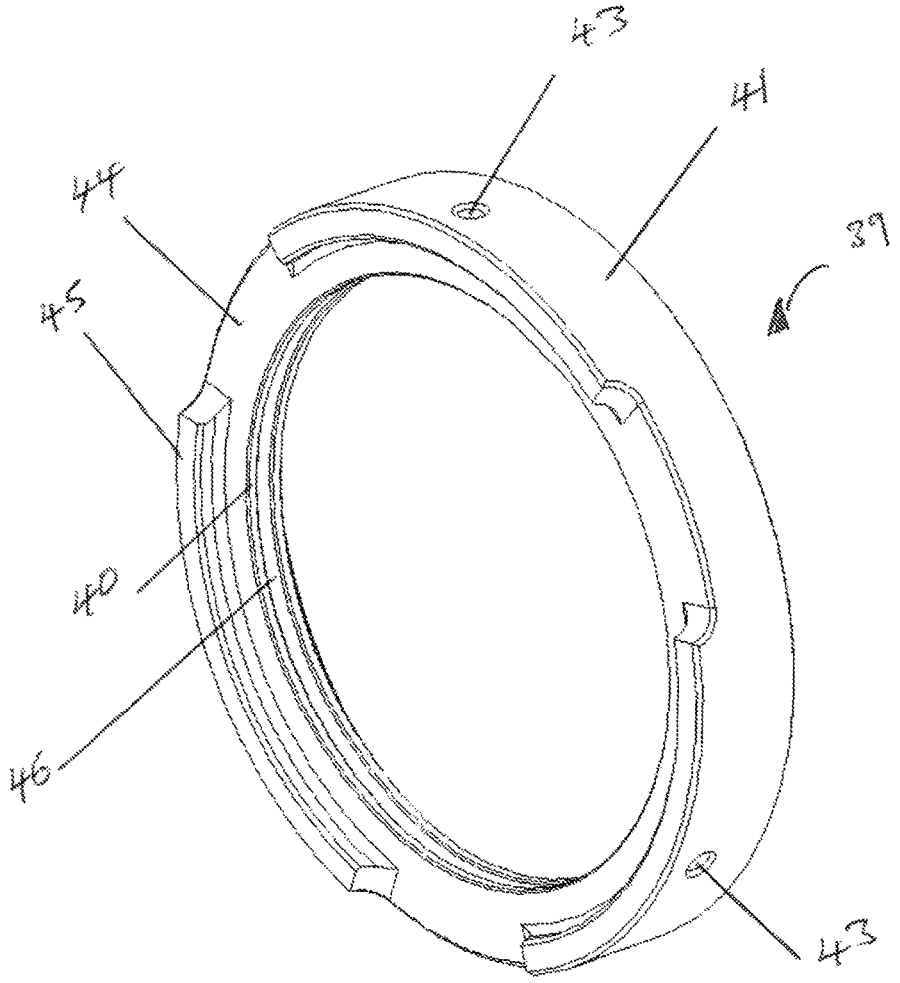
FIG. 16 is a rear perspective view of the carrier member shown in FIGS. 14 and 15.
Figure 18:
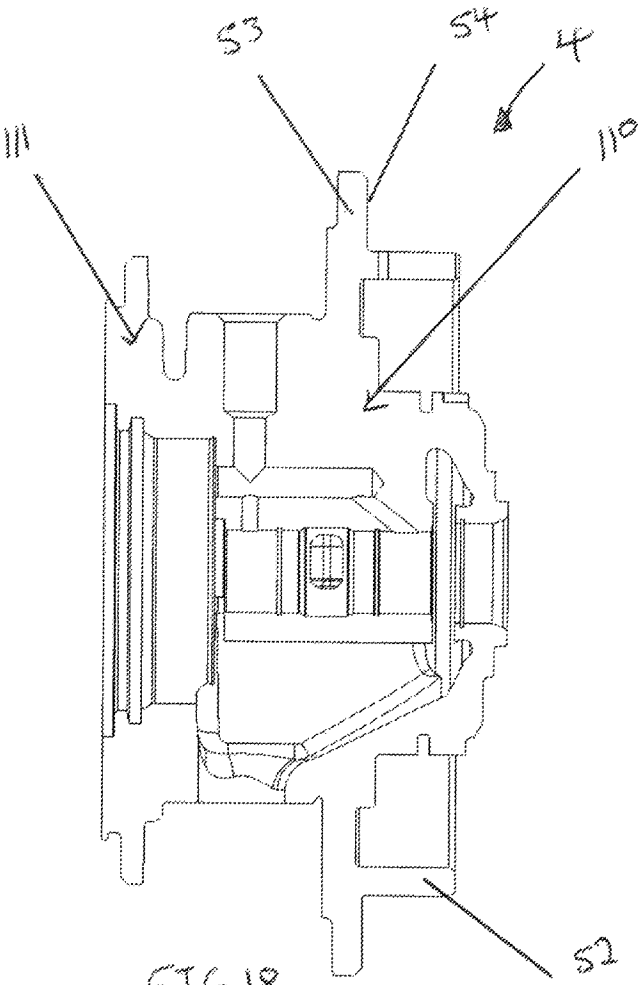
FIG. 18 is an axial cross-sectional view of the bearing housing shown in FIG. 17.
Figure 17:
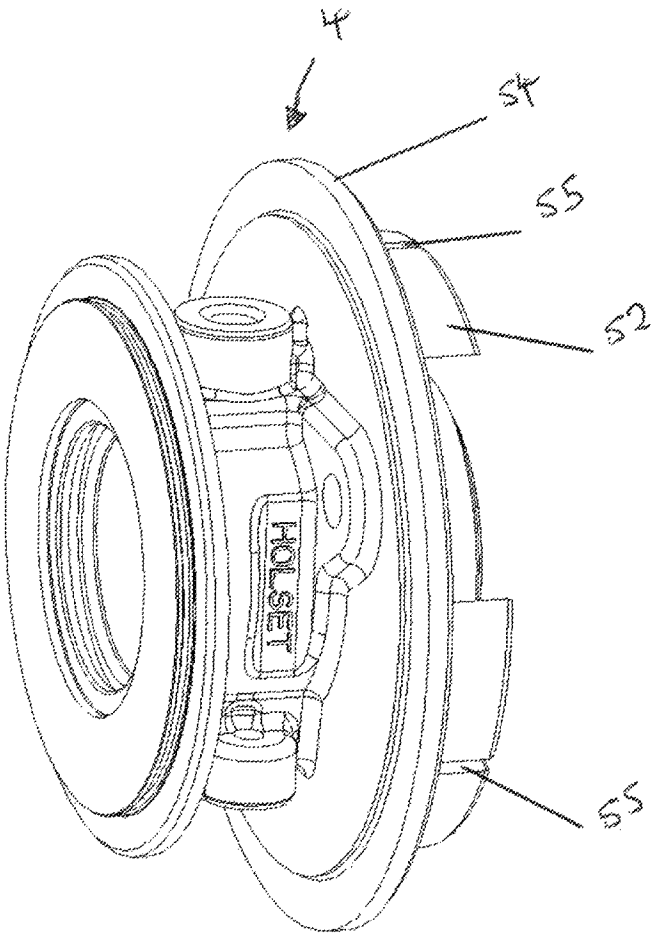
FIG. 17 is a rear perspective view of a bearing housing of the turbocharger shown in FIGS. 1 to 3.
Figure 20:
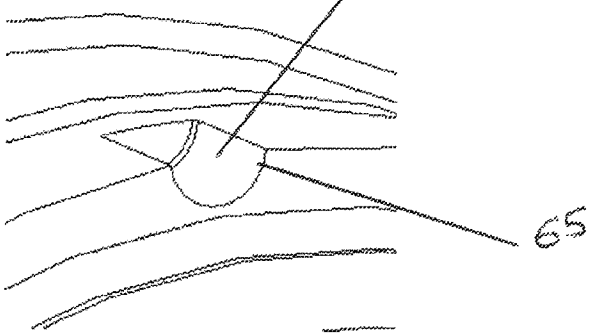
FIG. 20 is an enlarged perspective view of the region labelled 'A' in FIG. 19.
Figure 19:
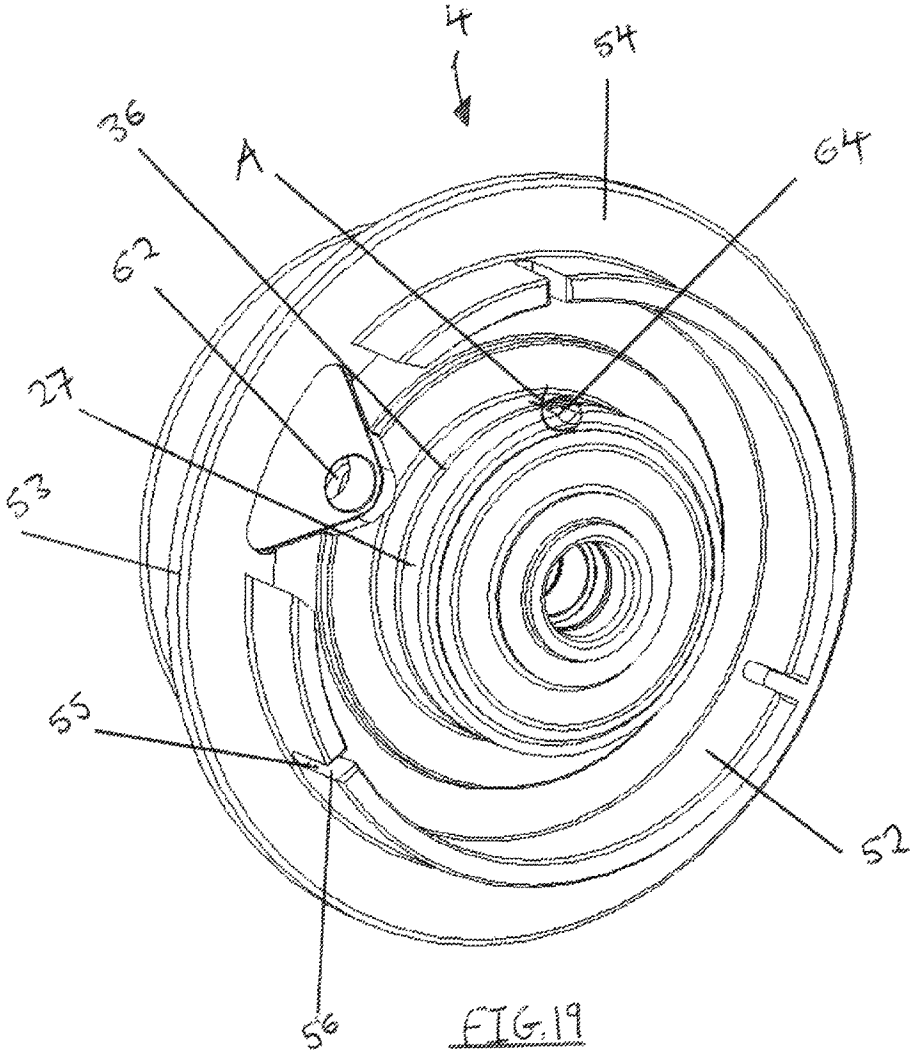
FIG. 19 is a front perspective view of the bearing housing shown in FIGS. 17 and 18.
Figure 21:
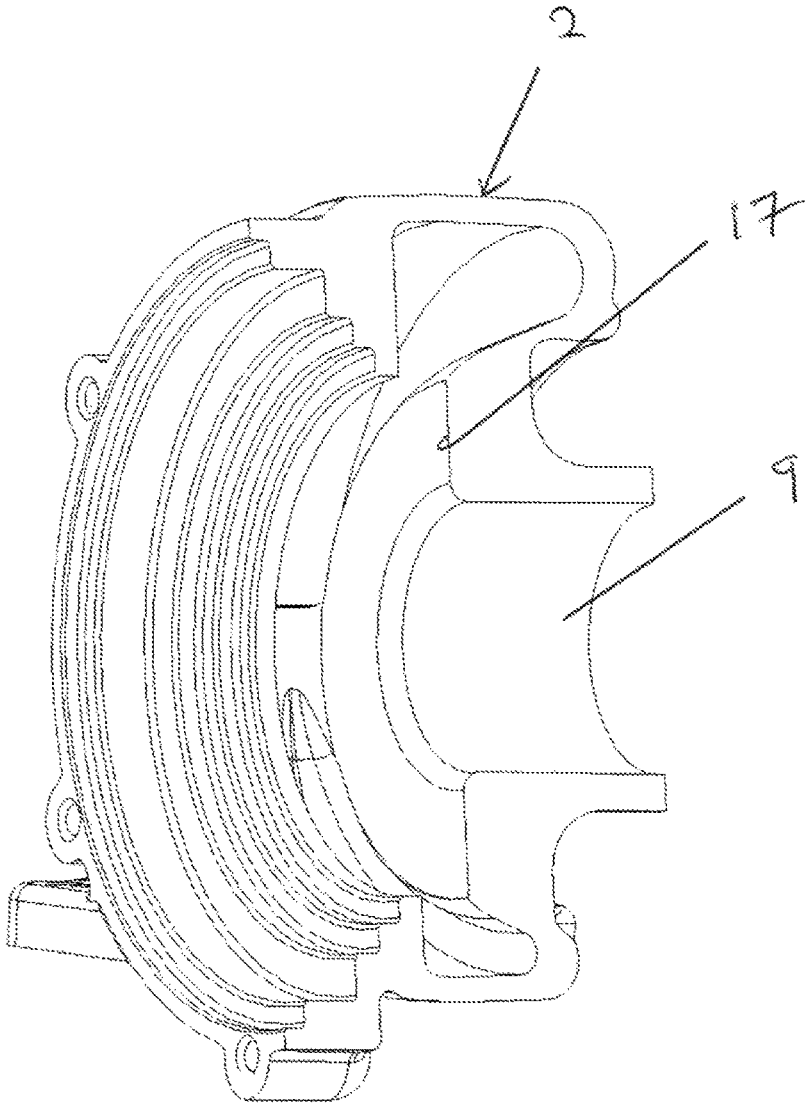
FIG. 21 is a cut away perspective view of a turbine housing of the turbocharger shown in FIGS. 1 to 3.

The actuation mechanism comprises a carrier member 39, as shown in more detail in FIGS. 14 to 16. The carrier member 39 is a substantially annular ring that is substantially centred on the turbocharger axis 5*a* The carrier member 39 comprises an annular wall 117 having radially inner and outer annular surfaces 40, 41. The annular wall 117 extends substantially parallel to the axial direction 5*a*. In this regard, the radially inner and outer surfaces 40, 41 of the annular wall 117 extend substantially parallel to the axial direction 5*a*.

An annular flange 114 extends radially inwardly from the radially inner surface 40. The annular flange 114 is substantially perpendicular to the axial direction 5*a*. An annular groove 46 is provided in the annular flange 114.

The annular wall 117 has axially inboard and outboard sections 42, 45 disposed on inboard and outboard sides of the annular flange 114. The outboard section 45 is of greater thickness than the inboard section 42.

The carrier member 39 is fixed, both axially and rotationally, to the shroud 11. Accordingly, as the carrier member 39 moves axially, the shroud 11 is moved axially with the carrier member 39. The carrier member 39 is fixed directly to the shroud 11. In this respect, a radially inner surface of the inboard section 42 of the annular wall 117 is welded to a radially outer surface of the outboard section of reduced thickness 23 of the axial flange 19 of the shroud 11. It will be appreciated that carrier member 39 may be fixedly attached to the shroud 11 by any suitable means, including brazing.

The annular wall 117 is provided with a plurality of radial bores 43. Specifically, the annular wall 117 is provided with three radial bores 43 circumferentially distributed about the annular wall 117. The radial bores 43 are equally circumferentially spaced around the annular wall.

Each radial bore 43 extends radially inwardly from a first end provided in the radially outer surface 41 of the carrier member 39, along a longitudinal axis that is substantially parallel to the radial direction, to a second end. The longitudinal axis of each radially extending bore is substantially straight.

Each radial bore 43 terminates before the radially inner surface 40 of the carrier member 39 so that its second end is closed and forms a blind bore 43. Each bore 43 has a substantially circular cross-sectional shape about its longitudinal axis. Each bore 43 is for receipt of a substantially cylindrical pin 69 (as discussed in more detail below).

The axially outboard section 45 of the annular wall 117 is provided with a plurality of axially extending recesses 44 distributed circumferentially about the annular wall 117. When the carrier member 39 is mounted in position, one of its recesses is adjacent to an arm 60 of a rotatable arm assembly 57 and provides clearance for the arm 60 to rotate, as described in more detail below.

The carrier member 39 is slidably mounted on the radially outer surface 33 of the support member 32 for movement in the axial direction. The carrier member 39 is mounted directly on the support member 32. In more detail, a substantially annular seal 44 is received within the annular groove 46 in the flange 114 of the carrier member 39 between the flange 114 and the radially outer surface 33 of the support member 32. The annular seal 44 seals the carrier member 39 against the support member 32 as the carrier member 39 moves axially relative to the support member 32. This prevents gases flowing from the annular inlet passageway 10 axially outboard of the carrier member 39, which helps to maintain a desired pressure differential across the carrier member 39.

Figure 5:
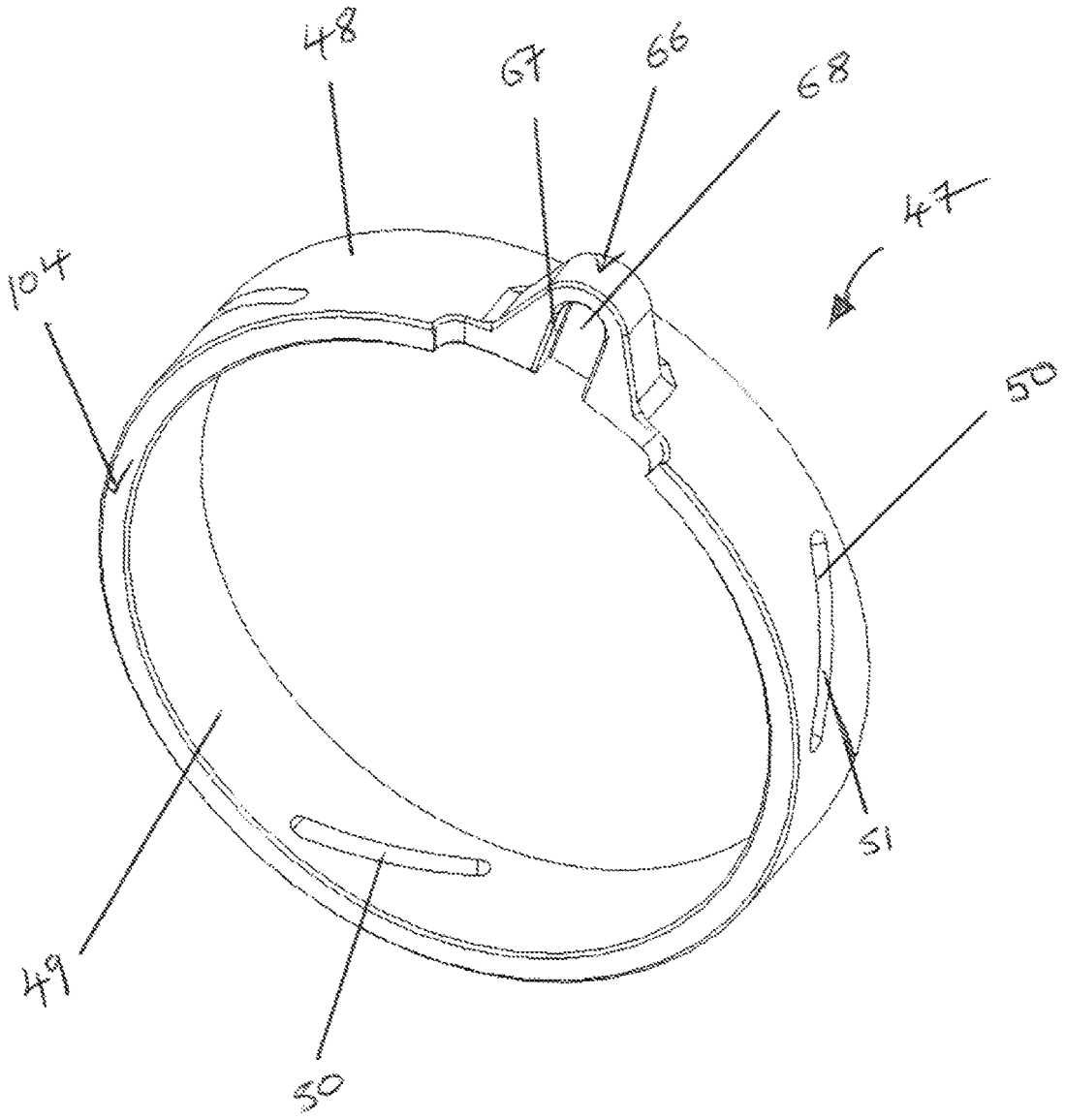
FIG. 5 is a rear perspective view of a cam member of the variable geometry turbine shown in FIGS. 1 to 3.
Figure 7:
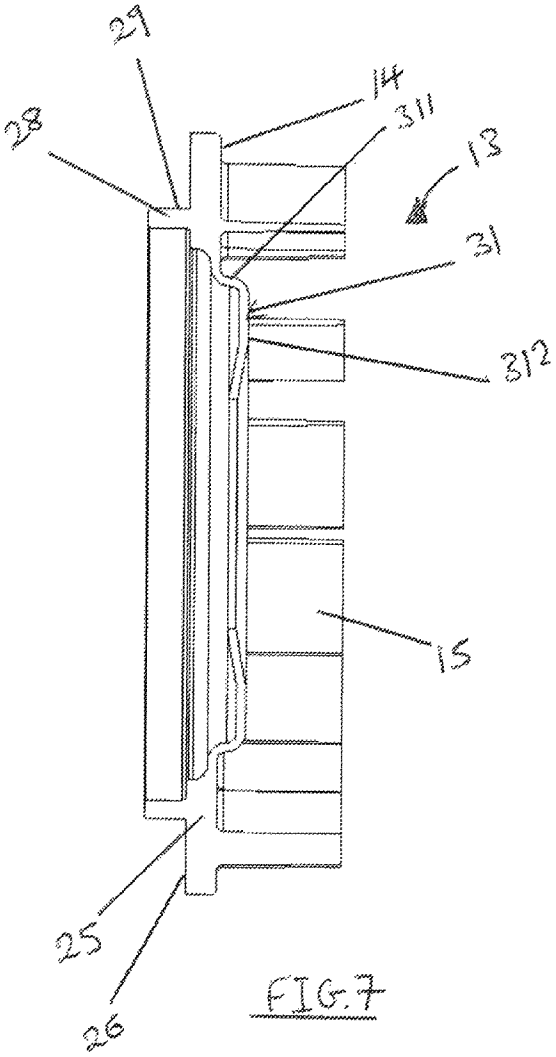
Figure 6:
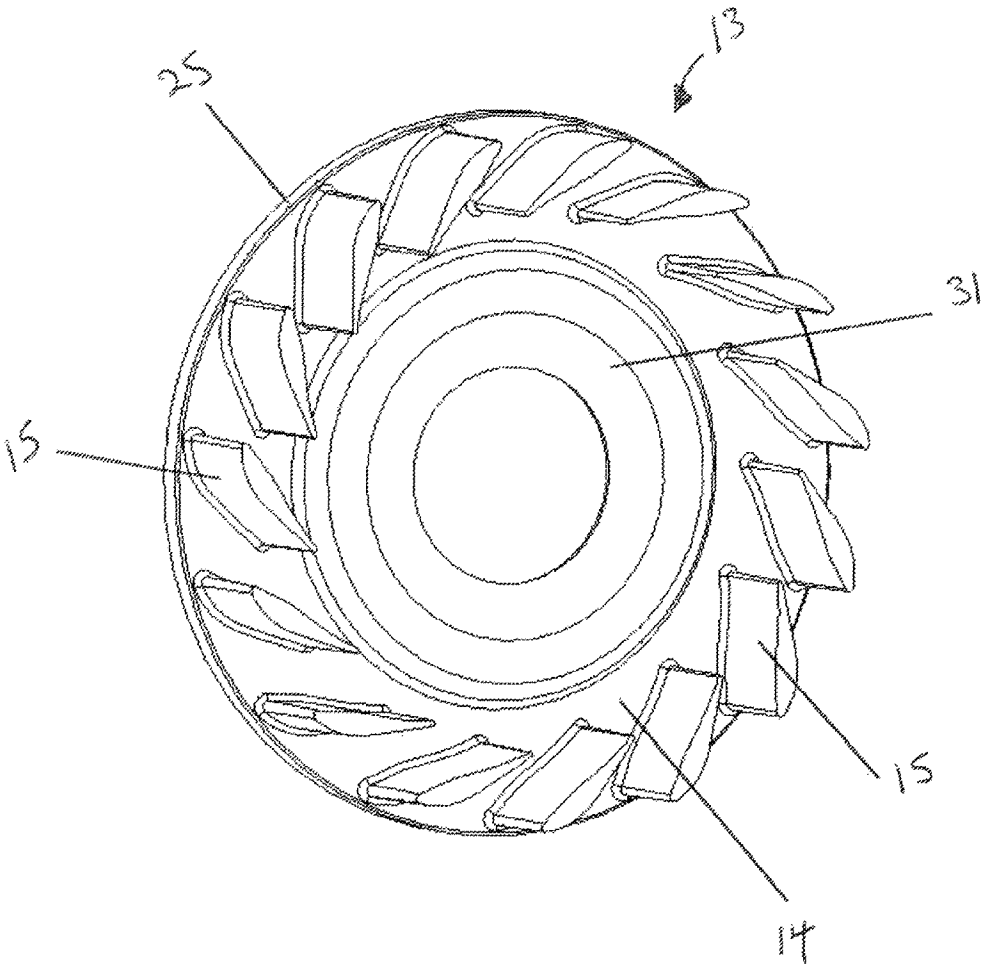
FIG. 6 is a front perspective view of a nozzle ring of the variable geometry turbine shown in FIGS. 1 to 3.
Figure 8:
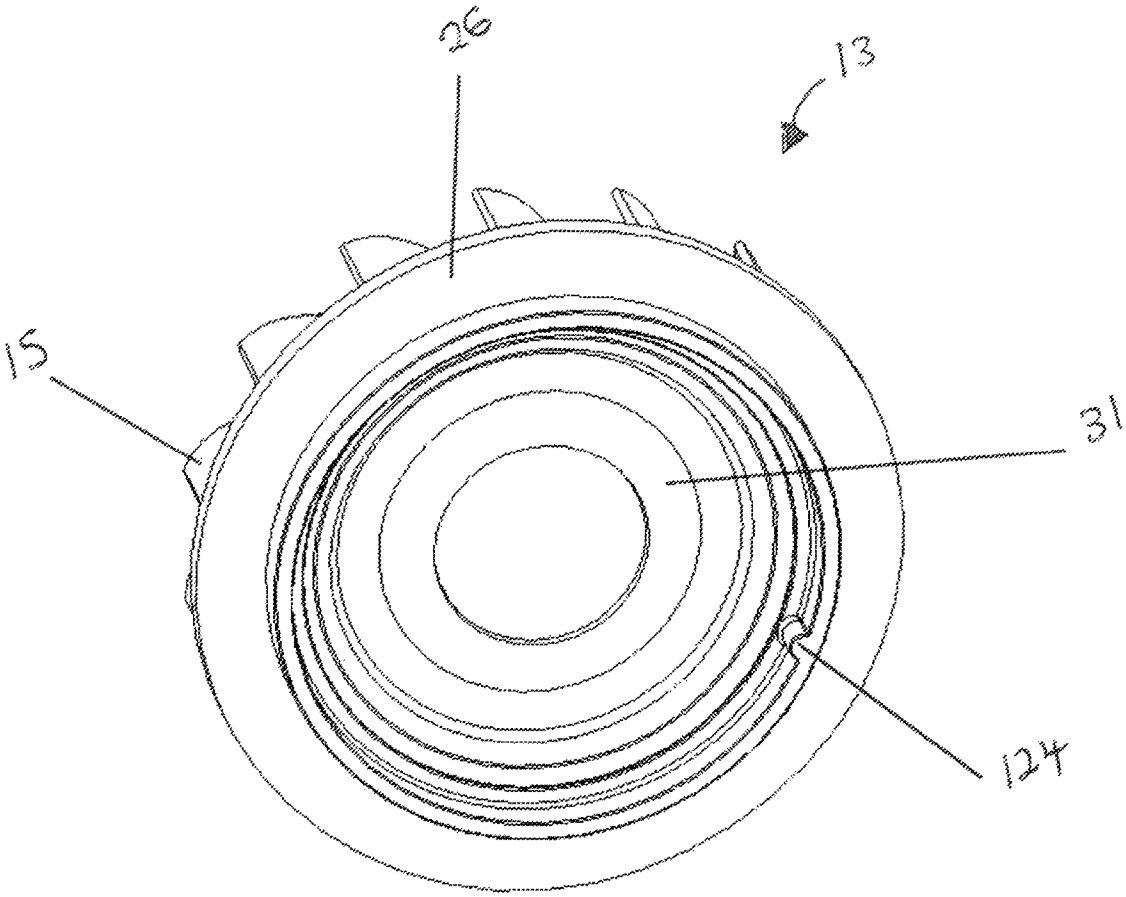
FIG. 8 is a rear perspective view of the nozzle ring shown in FIGS. 6 and 7.
Figure 10:
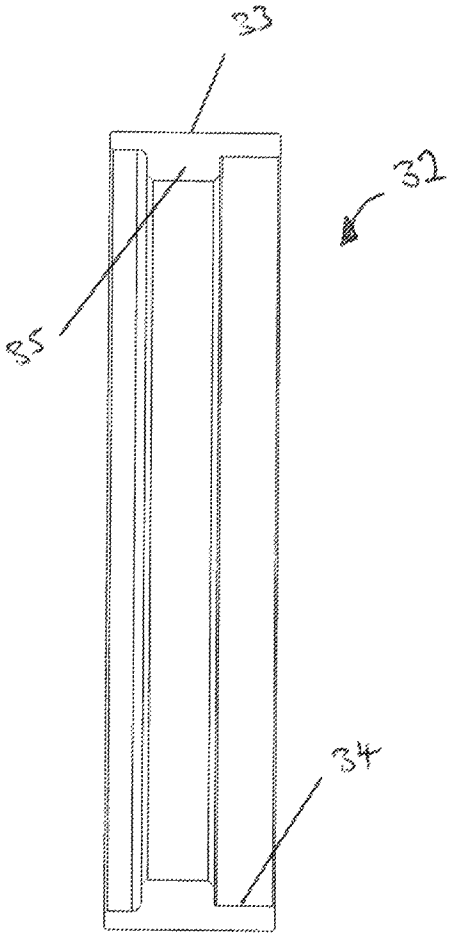
FIG. 10 is an axial cross-sectional view of the support member shown in FIG. 9.
Figure 9:
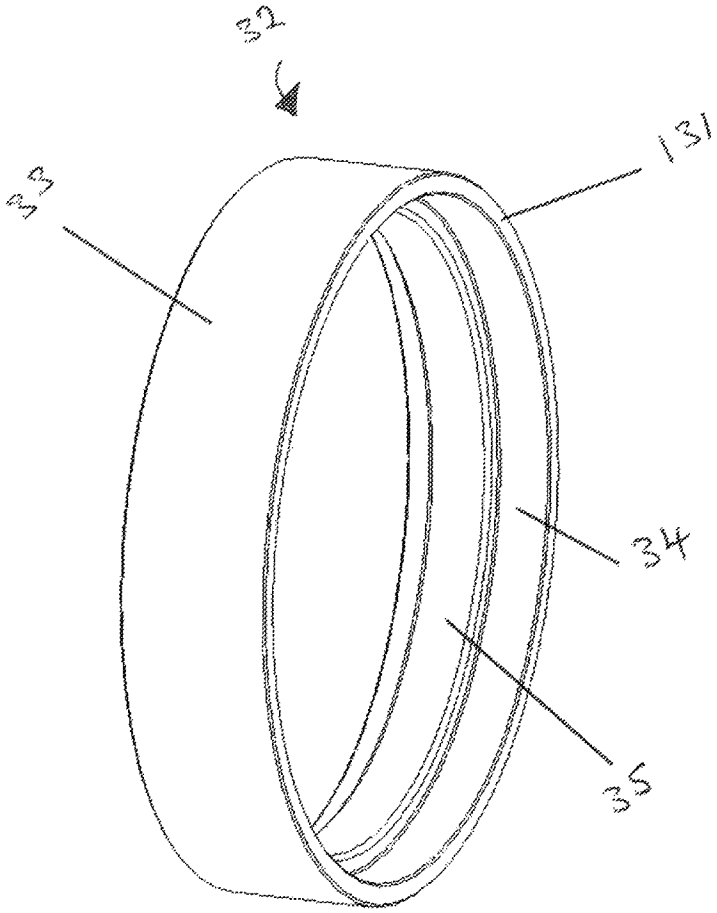
FIG. 9 is a front perspective view of a support member of the variable geometry turbine shown in FIGS. 1 to 3.

The actuation mechanism further comprises a cam member 47, as shown in more detail in FIG. 5. The cam member 47 is a substantially annular ring that is substantially centred on the turbocharger axis 5*a*. The cam member 47 comprises an annular wall 104 having radially inner and outer annular surfaces 49, 48. The annular wall 104 (and its radially inner and outer annular surfaces 49, 48) extends substantially parallel to the axial direction 5*a*.

A plurality of slots 50 are provided in the annular wall 104 and are defined by respective inner surfaces 51 of the annular wall 104. Each slot is generally elongate and extends along a longitudinal axis 50*a* (see FIGS. 5 and 24*a*). Each slot extends substantially through the radial thickness of the annular wall 104.

In the currently described embodiment there are three slots 50. Each slot 50 is substantially identical. The slots 50 are distributed in the circumferential direction around the annular wall 104, substantially equally spaced apart.

Each slot 50 extends in both the circumferential direction and the axial direction. In this respect, each slot 50 defines a part of a helix about the turbocharger axis 5*a*. Specifically, the longitudinal axis 50*a* of each slot 50 extends in both the circumferential direction and the axial direction 5*a*. In this respect, the longitudinal axis 50*a* of each slot 50 defines a part of a helix about the turbocharger axis 5*a*.

Figure 24A:
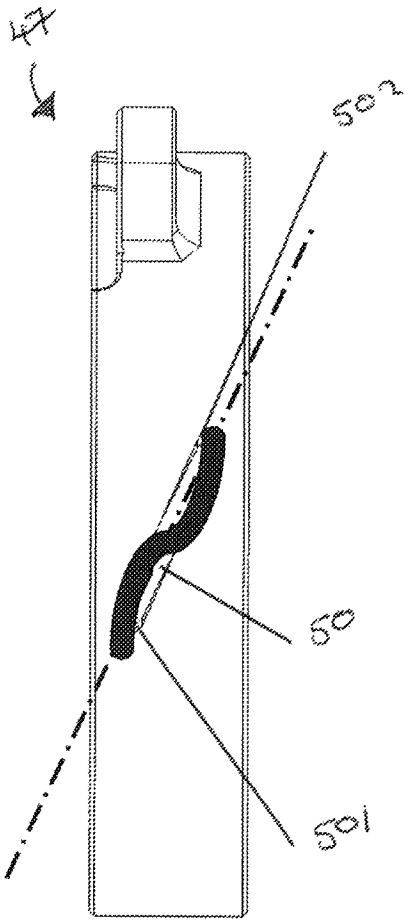
FIG. 24*a* is a side elevational view of the cam member shown in FIG. 5.

In the embodiment of the cam member 47 shown in FIGS. 5 and 24*a*, the longitudinal axis 50*a* of each slot 50 is inclined at a substantially constant angle relative to the radial plane. In this respect, the radial plane is a plane that is substantially perpendicular to the turbocharger axis 5*a*.

Figure 24B:
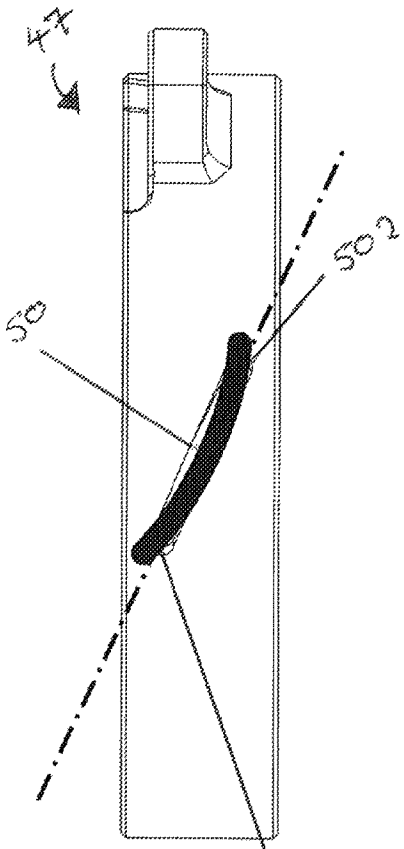
FIGS. 24*b* and 24*c* are views corresponding to that of FIG. 24*a* but where the slots in the annular wall of the cam member are of a different shape (where the shape of the slots is shown as a thicker darker line overlying the slot of FIG. 24*a*)
Figure 24C:
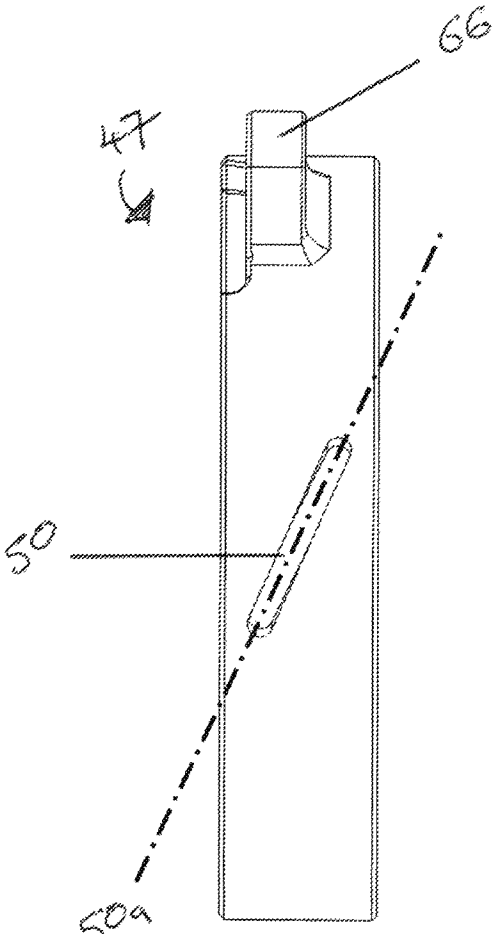
Figure 25:
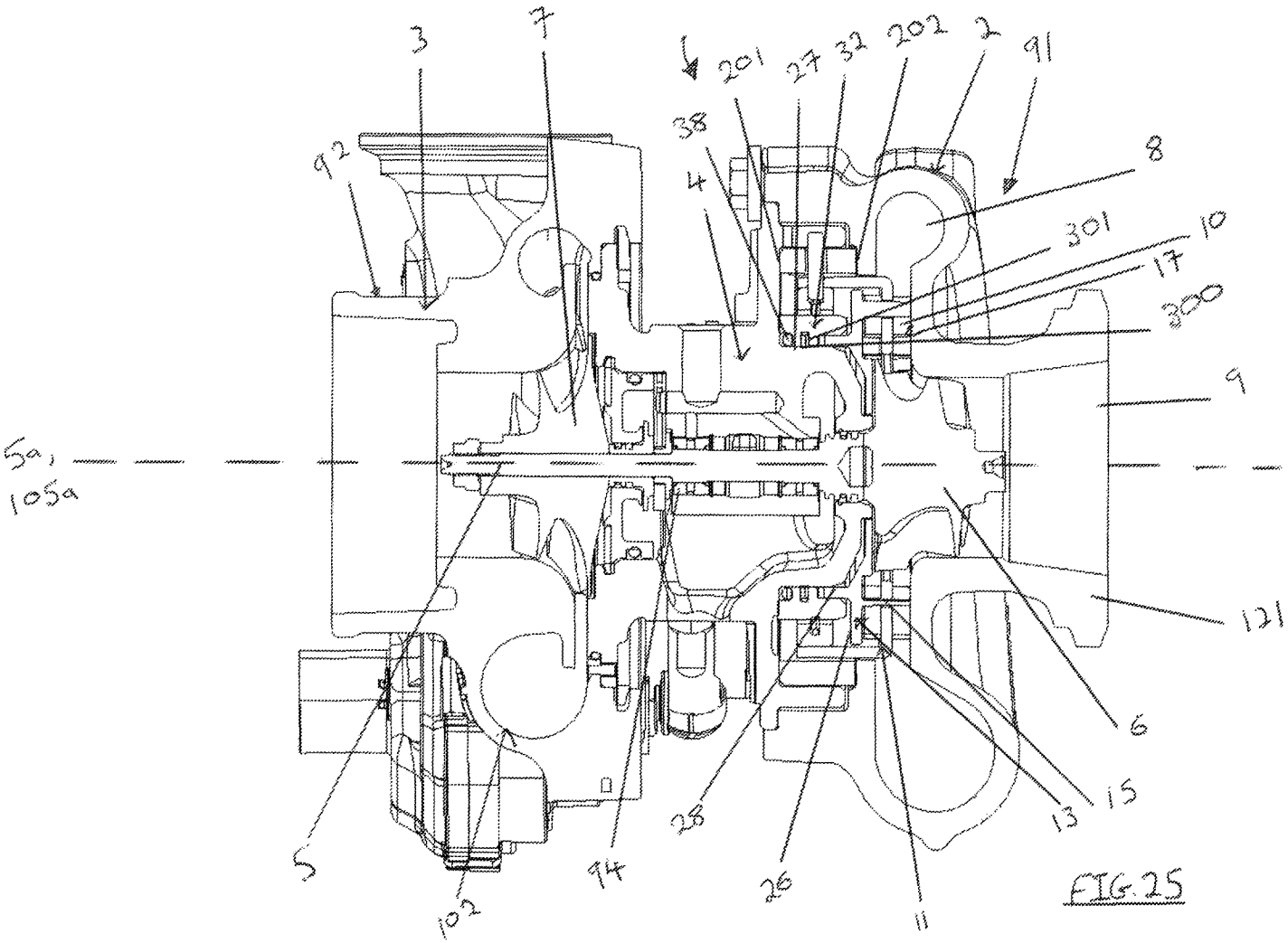
FIG. 25 is an axial cross section through a variable geometry turbocharger according to a second embodiment of the present disclosure.
Figure 26:
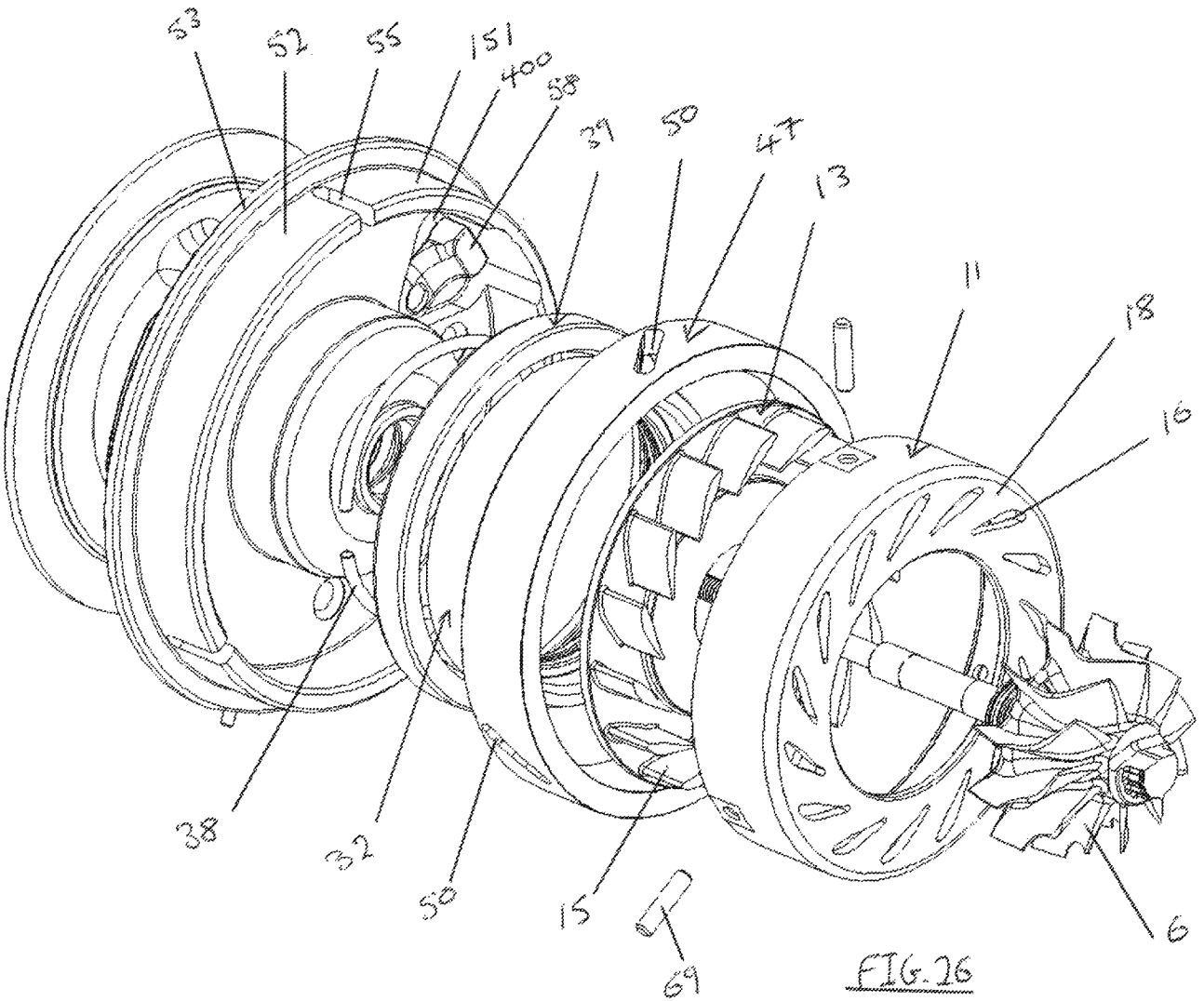
FIG. 26 is an exploded perspective view of part of a variable geometry turbine and of a bearing housing of the variable geometry turbocharger shown in FIG. 25.
Figure 17:
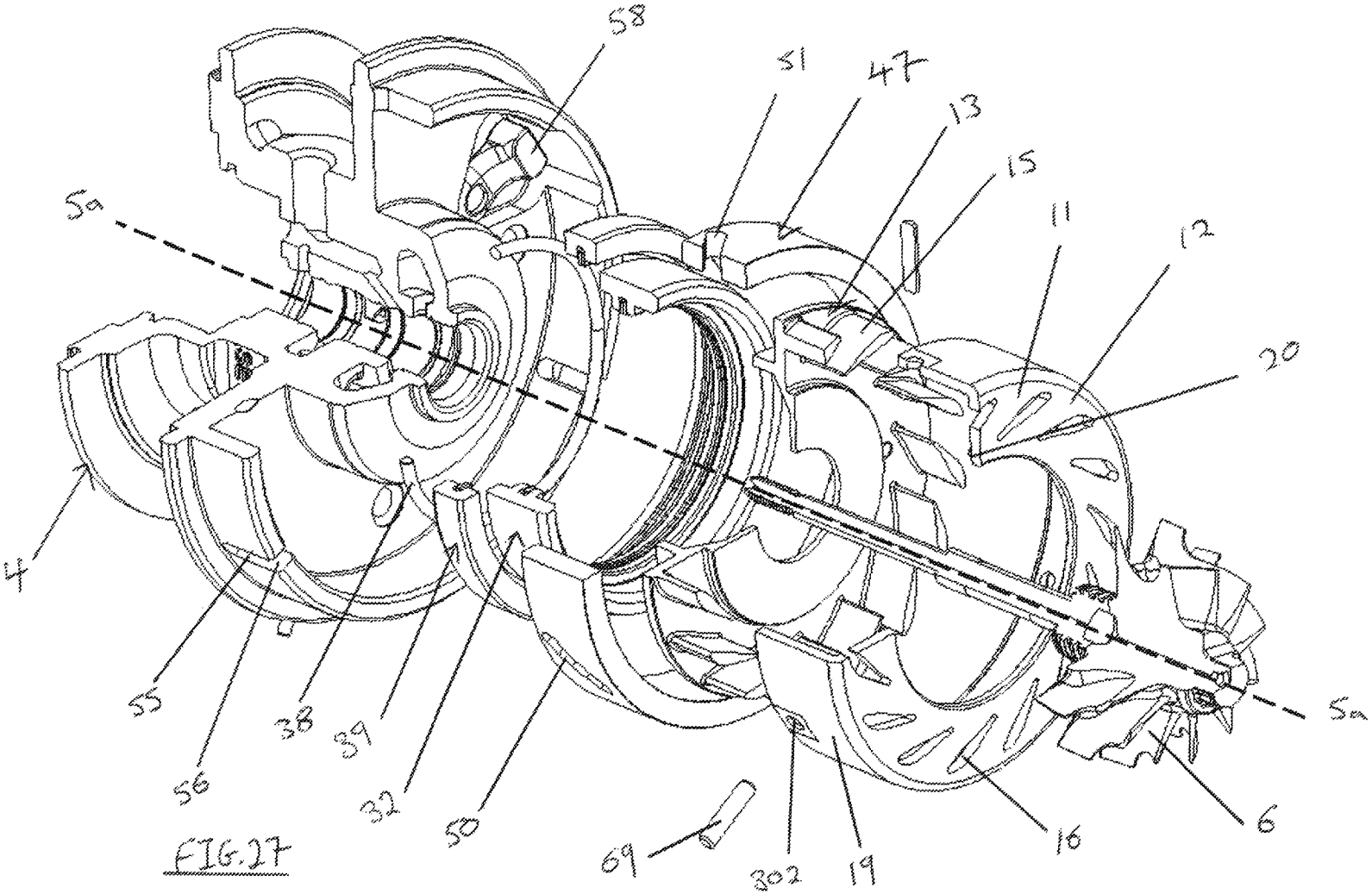
Figure 28:
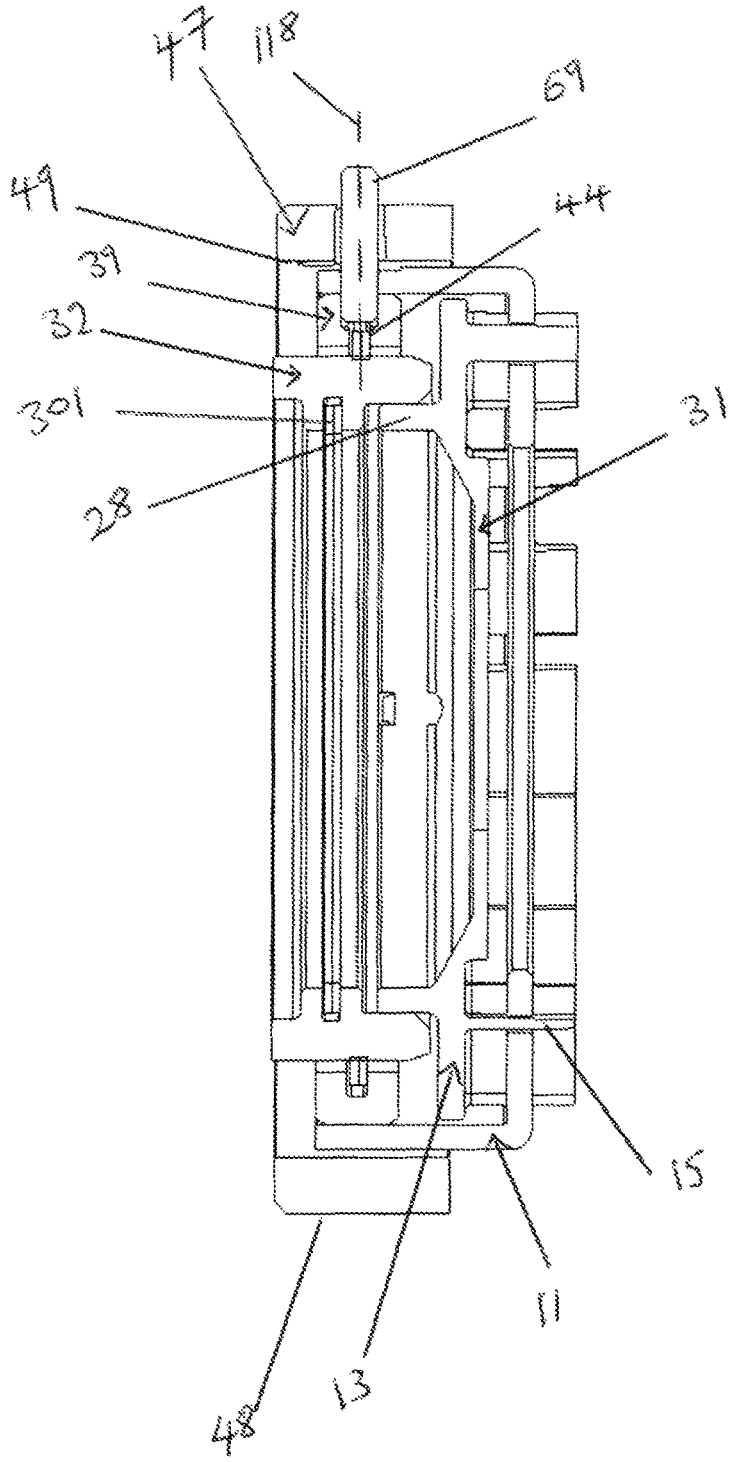
FIG. 28 is an axial cross-section through a cam member, carrier member, support member, shroud and nozzle ring of the variable geometry turbine shown in FIGS. 25 to 27.
Figure 29:
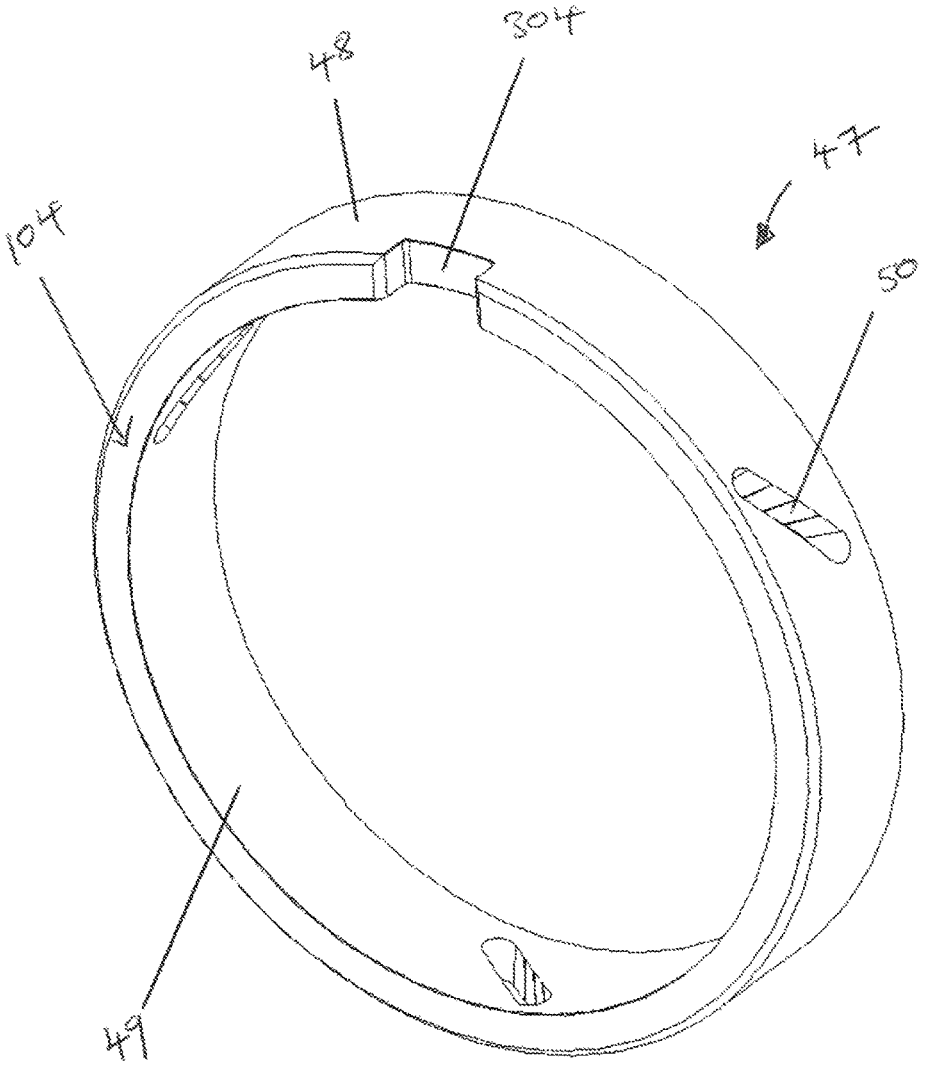
FIG. 29 is a rear perspective view of a cam member of the variable geometry turbine shown in FIGS. 25 to 27.
Figure 31:
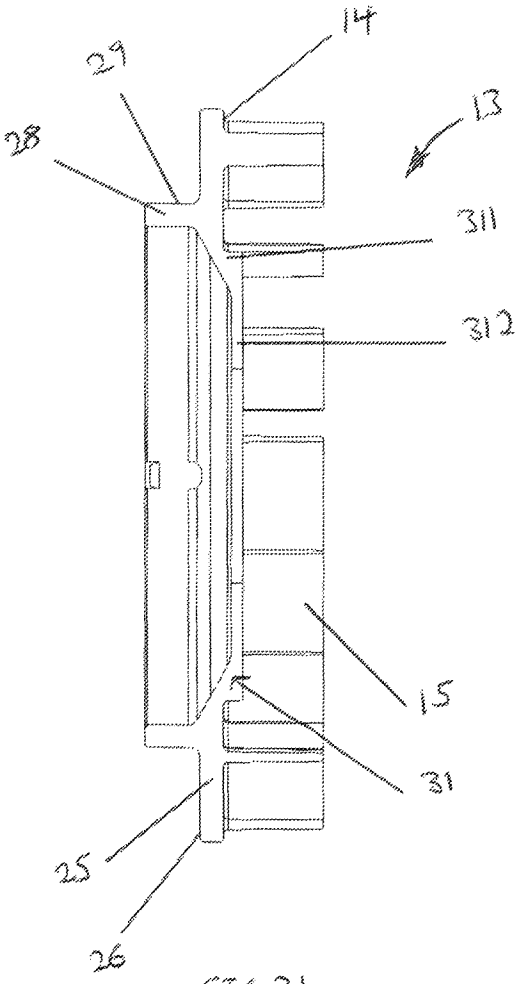
FIG. 31 is an axial cross-sectional view of the nozzle ring shown in FIG. 30.
Figure 30:
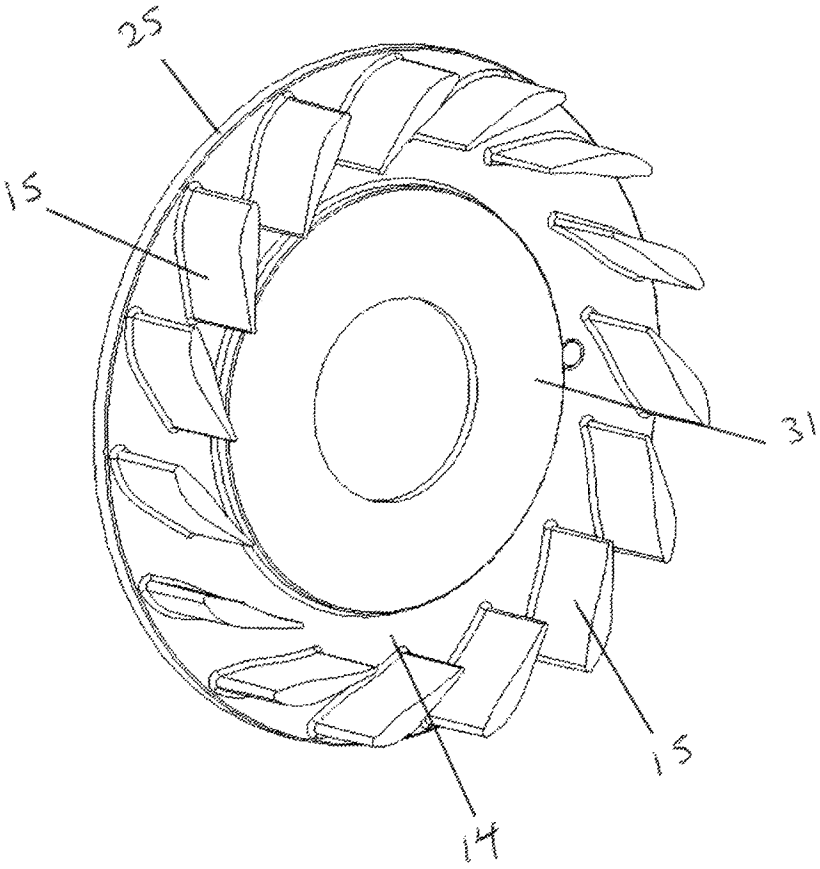
FIG. 30 is a front perspective view of a nozzle ring of the variable geometry turbine shown in FIGS. 25 to 27.
Figure 32:
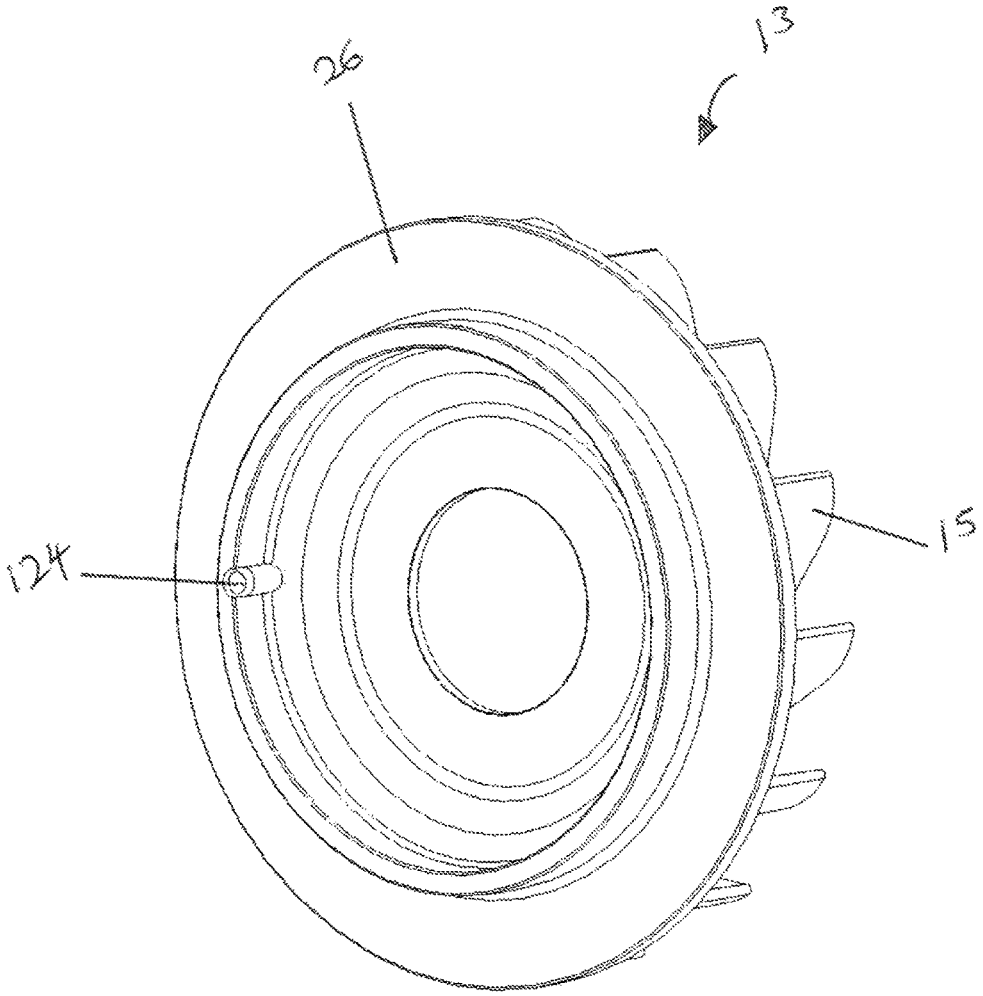
FIG. 32 is a rear perspective view of the nozzle ring shown in FIGS. 30 and 31.
Figure 34:
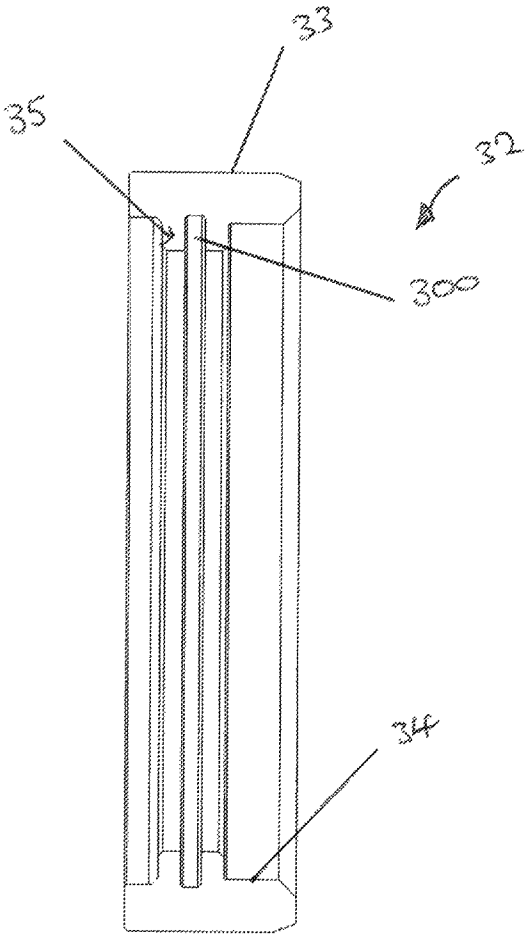
FIG. 34 is an axial cross-sectional view of the support member shown in FIG. 33.
Figure 33:
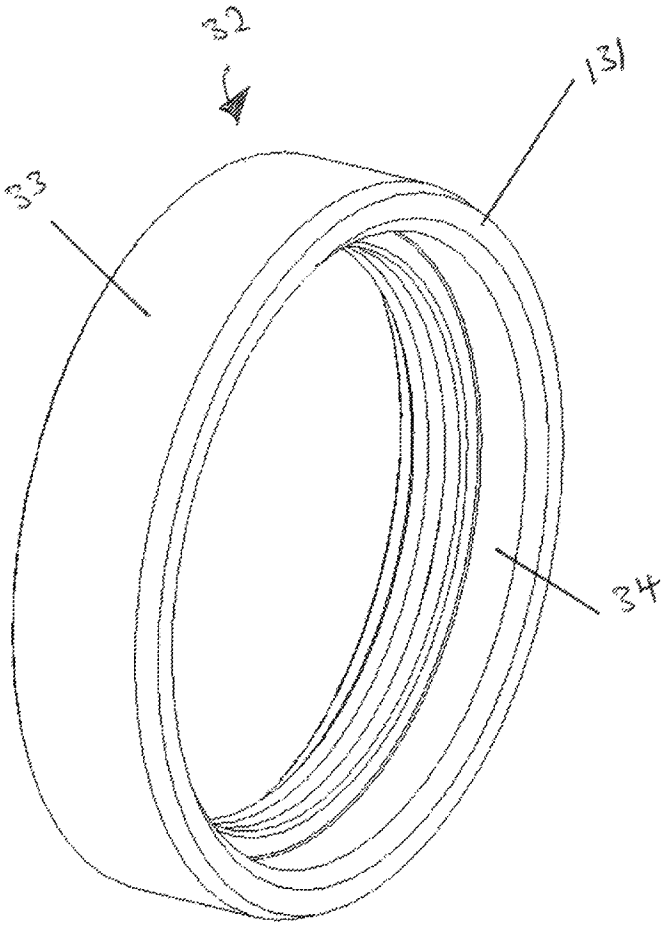
FIG. 33 is a front perspective view of a support member of the variable geometry turbine shown in FIGS. 25 to 27.
Figure 36:
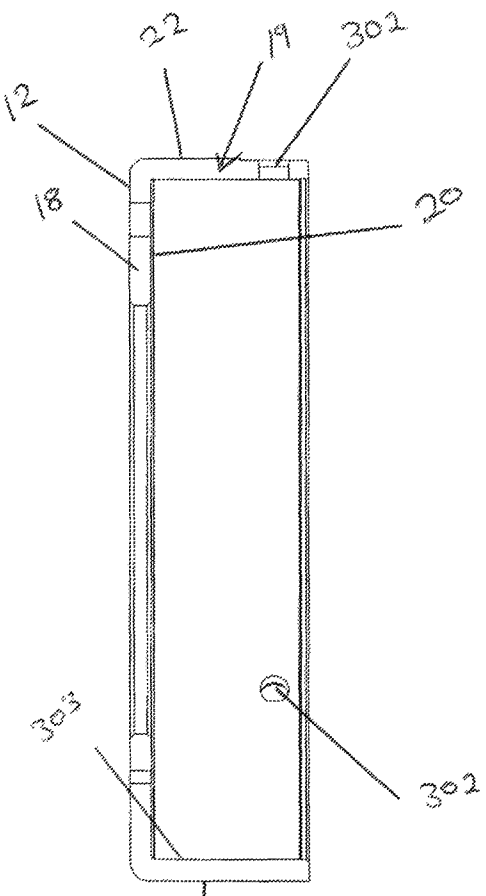
FIG. 36 is an axial cross-sectional view of the shroud shown in FIG. 35.
Figure 35:
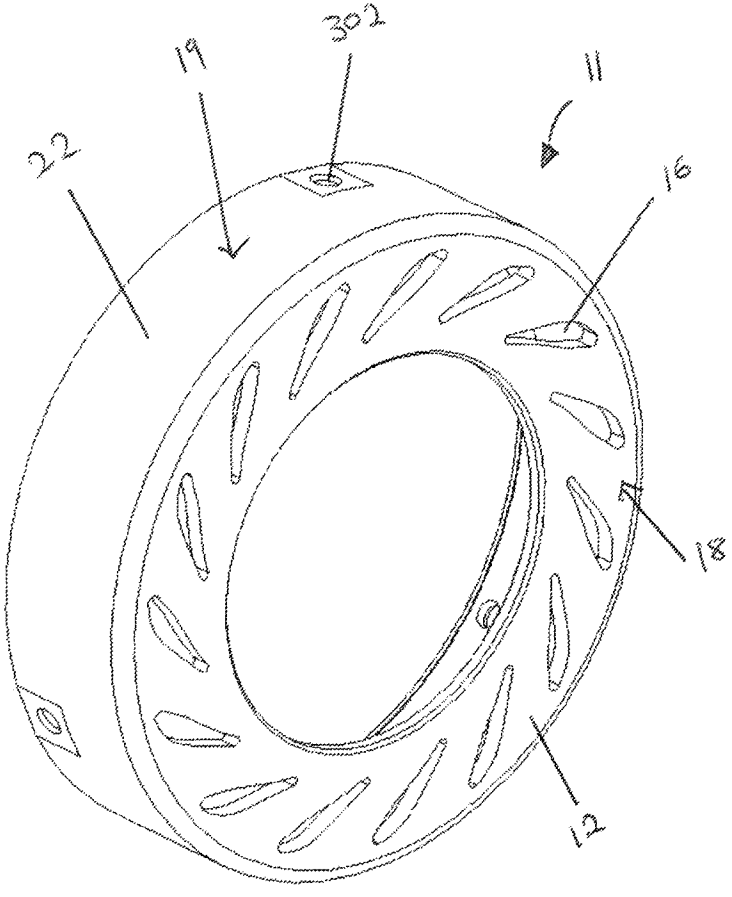
FIG. 35 is a front perspective view of a shroud of the variable geometry turbine shown in FIGS. 25 to 27.

In the embodiment of the cam member 47 shown in FIGS. 24*b* and 24*c*, the longitudinal axis 50*a* of each slot 50 is inclined at an angle relative to the radial plane that varies along its length. This is advantageous in that it allows for a desired axial movement of the shroud 11 for a certain rotational movement of the cam member 47.

In the embodiment of FIG. 24*b*, the angle of the longitudinal axis 50*a* relative to the radial plane decreases from a first end 501 of the slot 50 to a second end 502 of the slot 50 such that slot 50 forms a concave curve.

In the embodiment of FIG. 24*c*, the angle of the longitudinal axis 50*a* relative to the radial plane increases and then decreases from the first end 501 of the slot 50 to the second end 502 of the slot 50 such that the slot 50 forms a curved wave shape.

The cam member 47 is mounted for rotation about the turbocharger axis 5*a*. In this regard, the cam member 47 is rotatably mounted on, and radially outwardly of, the carrier member 39 and the axial extending flange 19 of the shroud 11. In this respect, the radially inner surface 49 of the cam member 47 is mounted on the radially outer surface 41 of the annular wall of the carrier member 39 and on an axial portion of the radially outer surface 22 of the axially extending flange 19 of the shroud.

The radially inner surface 49 of the cam member 47 bears against the radially outer surface 41 of the annular wall of the carrier member 39, as the cam member 47 rotates and as the carrier member 39 moves axially.

The annular wall 117 of the carrier member 39 and the annular wall 104 of the cam member 47 are substantially concentric with the turbocharger axis 5*a*.

The cam member 47 is sandwiched between opposed radially extending annular surfaces 201, 202 of the bearing housing 4 and turbine housing 2 respectively, such that the cam member 47 can rotate about the turbocharger axis 5*a* but is substantially fixed in the axial direction 5*a*, relative to the bearing and turbine housings 4, 2. The slots 50 have substantially corresponding circumferential positions to the radial bores 43 in the carrier member 39. Said radial surfaces 201, 202 are substantially perpendicular to the axial direction 5*a*.

The inboard portion 110 of the bearing housing 4 comprises an annular wall member 53. The annular wall member 53 has an axially inboard, radially extending annular surface 54. The surface 54 is substantially perpendicular to the axial direction 5*a*. An annular flange 52 extends axially inboard from the surface 54. The annular flange 52 has radially outer and inner surfaces 151, 153. The annular flange 52 is substantially centred on the axis 5*a* of the turbocharger. A circumferentially extending gap 152 is provided in the annular flange 52 so as to allow clearance for rotation of an arm 60 of a rotatable arm assembly 57 (as described in more detail below).

A set of three axially extending slots 55 is provided in the axially extending flange 52, distributed circumferentially about the annular flange 52. Each axial slot 55 is defined by a respective inner surface 56 of the annular flange 52. Each axial slot 55 extends axially outboard from the axially inboard end of the annular flange 52, forming an open end at the outboard end of the annular flange 52. The slot 55 terminates within the axial extent of the annular flange 52 so as to form a blind slot 55. Each axial slot 55 extends throughout the thickness of the annular flange 52, from its radially inner surface 153 to its radially outer surface 151. Each slot 55 is substantially straight in the axial direction 5*a*. The longitudinal axis of each slot 55 does not extend in the circumferential direction.

The cam member 47 is mounted radially inwardly of the annular flange 52. In this respect, the radially outer surface 48 of the annular wall 104 of the cam member 47 is disposed radially inwardly of the radially inner surface 153 of the annular flange 52 of the bearing housing 4, with a small radial clearance provided between said surfaces 48, 153. The arrangement is such as to allow for the rotation of the cam member 47 relative to the bearing housing 4. Alternatively the radially outer surface 48 of the annular wall 104 of the cam member 47 may bear against the radially inner surface 153 of the annular flange 52 of the bearing housing 4.

The actuation mechanism further comprises a set of three pins 69. Each pin 69 is generally elongate, extending along a longitudinal axis 118. Each pin 69 is substantially straight. The longitudinal axis 118 of each pin is substantially straight and is substantially parallel to the radial direction. Each pin 69 has a substantially circular cross-sectional shape about its longitudinal axis.

Each pin 69 is received within a respective said radial bore 43 in the carrier member 39. Each pin 69 is axially fixed relative to the carrier member 39. In this respect, each radially extending bore 43 has an axial extent that is substantially the same as, or slightly greater than, the axial extent of the respective pin 69 such that as the pin 69 is moved in the first and second axial directions, the carrier member 39 is moved in the first and second axial directions respectively. It will be appreciated that the first and second axial directions are the opposite directions parallel to the turbocharger axis 5*a*.

Each pin 69 protrudes radially outwardly from the respective bore 43 in the carrier member 39 and passes through a respective said slot 50 in the cam member 47. The pin 69 passes radially outwardly of the slot 50 into a respective said axial slot 55 in the annular flange 52 of the wall member 53 of the bearing housing 4.

Each pin 69 is slidable axially within the respective axial slot 55. However, the slot 55 is sized to substantially prevent rotation of the pin 69 about the turbocharger axis 5*a*. In this respect, the slot 55 is of a width, in the circumferential direction, that is substantially the same as that of the pin 69 such that the slot 55 prevents the rotation of the pin 69 about the turbocharger axis 5*a*. Accordingly, due to the engagement of the pins 69 within the radial bores 43 in the carrier member 39, the carrier member 39 is rotationally fixed relative to the bearing housing 4, about the turbocharger axis 5*a*.

The method of operation of the actuation mechanism will now be described. In order to move the shroud 11 axially, so as to vary the width of the annular inlet passageway 10, the cam member 47 is rotated about the turbocharger axis 5*a*. This causes movement of each slot 50 relative to the respective pin 69 that passes through the slot 50. Each inner surface 51 of the cam member 47 that defines a respective slot 50 engages the pin 69 received within the slot 50 and acts to move the pin 69 in the axial direction.

Due to the engagement of each pin 69 with the inner surface 56 of the annular flange 52 that defines the respective axial slot 55, the pin 69 is prevented from rotating. The reaction force exerted by this inner surface 56 on the pin 69, in combination with the force exerted on the pin by the rotating inner surface 51 that defines the respective slot 50, causes each pin 69 to move axially along the respective slot 56, in the inboard direction.

Due to the engagement of each pin 69 within the radial bores 43 in the carrier member 39, this causes the carrier member 39, and therefore the shroud 11 (which is fixed to the carrier member 39) to move in the axial direction. In this regard, the carrier member 39 slides axially on the support member 32.

The support member 32 is made of stainless steel, coated with a low friction material so as to facilitate the movement of the carrier member 39 over the support member 32. The coating material is also wear resistant so as to prevent wear of the support member 32 due to the movement of the carrier member 39 over it. In the described embodiment the coating is CM11 or the support member is subject to a boronised heat treatment.

Rotation of the cam member 47 in the anti-clockwise direction (when viewed looking from the turbine end in FIG. 2), acts to move the inboard surface 12 of the radial wall 18 of the shroud 11 towards the facing inboard surface 17 of the turbine housing 2. Rotation of the cam member 47 in the clockwise direction acts to move the inboard surface 12 of the radial wall 18 of the shroud 11 away from the facing inboard surface 17 of the turbine housing 2.

Figure 23:
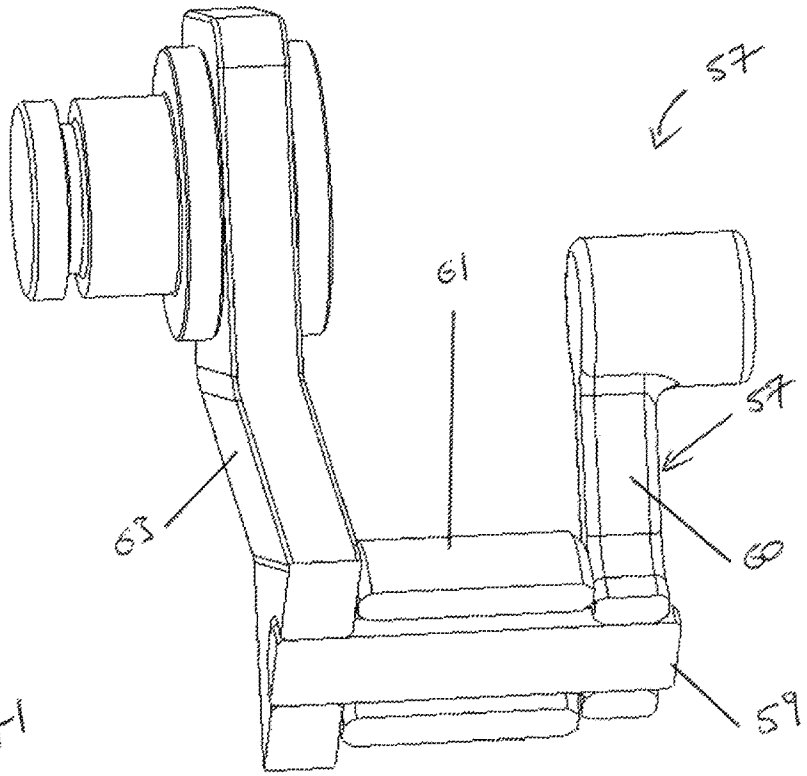
FIG. 23 is a cut away perspective view of the rotatable arm assembly shown in FIG. 22.
Figure 22:
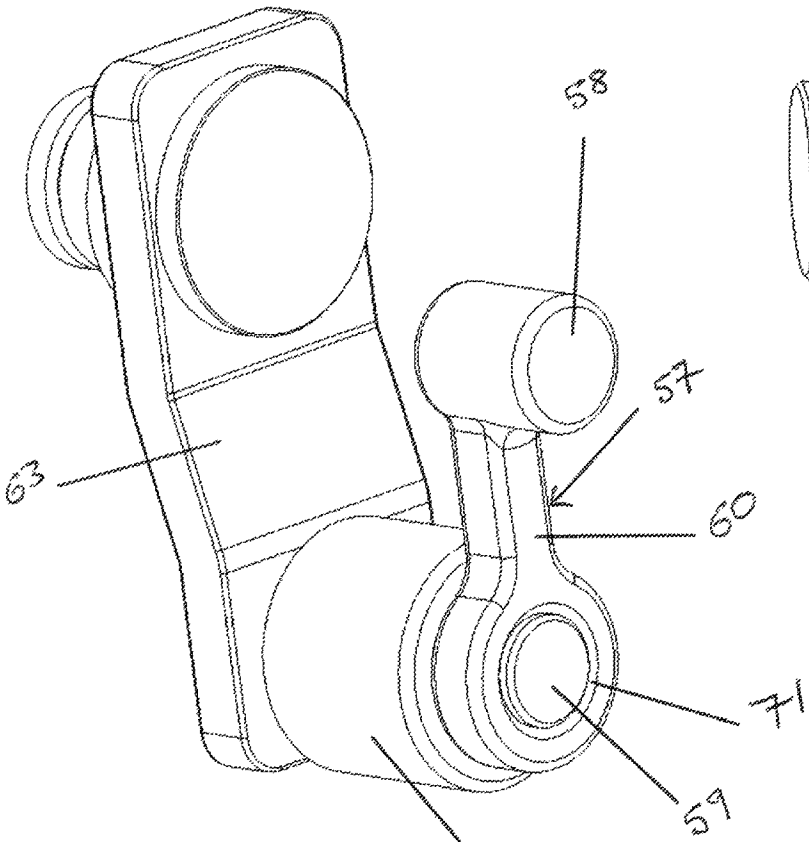
FIG. 22 is a perspective view of a rotatable arm assembly of the turbocharger shown in FIGS. 1 to 3.

The actuation mechanism further comprises a rotatable arm assembly 57 mounted to the bearing housing 4 (the rotatable arm assembly 57 is shown in more detail in FIGS. 22 and 23).

The rotatable arm assembly 57 comprises an elongate arm 60 that extends along a longitudinal axis and is pivotally mounted to the axially inboard surface 54 of the axially inboard wall member 53 of the bearing housing 4. A first end of the arm 60 is provided with an aperture 71 within which is received a first end of an elongate pin 59. The pin 59 extends along a longitudinal axis and passes through a generally cylindrical collar 61 which is received within a bore 62 in the axially inboard wall member 53. The collar 61 is rotationally fixed within the bore 62 by virtue of an interference fit.

The pin 59 is rotatable within the collar 61. The arm 60 is rotatably fixed to the pin 59 so as to rotate with the pin 59. In this respect, the pin 59 forms an interference fit within the aperture 71 in the first end of the arm 60.

A second end of the arm 60 is provided with an axially extending protrusion 58. The protrusion 58 is generally cylindrical, having a substantially circular cross-section about a longitudinal axis of the protrusion 58. The longitudinal axis of the protrusion 58 is substantially perpendicular to the longitudinal axis of the arm 60. A second end of the pin 59 is received within an aperture in an actuator arm 63. The second end of the pin 59 forms an interference fit with the aperture such that the pin 59 rotates with the actuator arm 63.

The actuator arm 63 is disposed on an axially outboard side of the wall member 53 and is connected to a pneumatic actuator (not shown). The actuator is arranged to rotate the actuator arm 63 so as to rotate the pin 59 about its longitudinal axis, which rotates the arm 60 about the longitudinal axis of the pin 59. The arm 60 and protrusion 58 are mounted within a recess 400 in the flange 53 of the bearing housing, for rotation within said recess 400. The recess 400 extends from the axially inboard surface of said flange 53, in the axially outboard direction and extends in the circumferential direction.

The recess 144 in the carrier member 39 that is proximal to the rotatable arm assembly 57 provides a clearance for the arm 60 to rotate.

In addition, the circumferentially extending gap 152 in the annular flange 52 so allows clearance for the arm 60 to rotate.

The cam member 47 is provided with a radially extending protrusion 66 which protrudes radially outwardly from the radially outer surface 48 of the cam member 47 (see FIG. 5). The protrusion 66 has an inner surface 67 which defines a cavity 68. The cavity 58 is sized and dimensioned to receive the axially extending protrusion 58 of the arm 60.

The protrusion 58 of the arm 60 is received within the cavity 68 such that it is rotationally fixed relative to the radial protrusion 66. Accordingly, the rotation of the arm 60 rotates the protrusion 58, which, by virtue of its engagement within the cavity 68, rotates the cam member 47 about the turbocharger axis 5*a*. The arm 60 is rotatable in either direction so as to rotate the cam member 47 in either rotational direction about the turbocharger axis 5*a*. This rotation of the cam member 47 acts to move the shroud 11 in either axial direction so as to vary the width of the annular inlet passageway 10, as described above.

The variable geometry turbine 91 (including the cam member 47, the pins 69, the carrier member 39, the support member 32, the shroud 11 and the nozzle ring 13) and the annular axially extending flange 52 provided with said axial slots 55 together form a turbine assembly.

The cam member 47, the pins 69, the carrier member 39, the support member 32, the shroud 11 and the nozzle ring 13, together form a cartridge assembly 1400. The cartridge assembly 1400 is easy to install and remove from the turbocharger 1 since it may be installed and removed as a single piece. In this regard, in order to install the cartridge assembly, the cartridge assembly is mounted in position on the bearing housing 4 and the turbine housing 2 is then attached to the bearing housing 4 so as to sandwich the cartridge assembly within the cavity 24, between the bearing housing 4 and the turbine housing 2.

In order to facilitate the correct orientation of the cartridge assembly 1400, the nozzle ring 13 is provided with a protrusion 124 (see FIG. 8) that extends axially outboard from the outboard surface 26 of the nozzle ring 13. The protrusion 124 is generally elongate and has a generally semi-circular cross-sectional shape. The radially outer surface 27 of the inboard portion 110 of the bearing housing 4 is provided with a radially inwardly and axially outboard extending recess 64 defined by an inner surface 65. The recess 64 has a generally semi-circular cross-sectional shape. The recess 64 is arranged to receive the protrusion 124 on outboard surface 26 of the nozzle ring 13. When the protrusion 124 is received within the recess 64, the nozzle ring 13 is automatically aligned in its correct rotational orientation. Accordingly, the engagement of the protrusion 124 and the recess 64 facilitates the correct rotational orientation of the nozzle ring, and therefore of the entire cartridge assembly 1400.

The variable geometry turbine assembly of the disclosure provides for a relatively compact variable geometry turbine 91 that is particularly suited for use on small variable geometry turbochargers. In addition, since it only requires a relatively small cavity to house the actuation mechanism, this reduces the pressure differential experienced during filling and scavenging of the exhaust gas in the housing.

In addition, since it does not require the yoke and push rods of prior-art designs, it has improved sealing and does not require water cooling.

Furthermore, the cartridge assembly may be easily and conveniently retro fitted to existing turbines so as to convert them into variable geometry turbines. In this regard, the bearing housing 4 of an existing turbine may be provided with said axial slots 55 and said cartridge assembly 1400 mounted in a cavity between the bearing housing and turbine housing, to convert it into a variable geometry turbine.

Referring to FIGS. 25 to 46 there is shown a variable geometry turbocharger comprising a variable geometry turbine assembly according to a second embodiment of the present disclosure. The variable geometry turbocharger of the second embodiment is identical to the variable geometry turbocharger 1 of the first embodiment, except for the differences described below. Corresponding features are given corresponding reference numerals.

The turbocharger of the second embodiment differs from that of the first embodiment in that the axially extending slots 55 in the annular axially extending flange 52 of the bearing housing 4 are located radially outwardly of their position in the first embodiment.

Furthermore, the support member 32 is sealed against the bearing housing 4 in a reciprocal manner to the first embodiment. In this regard, the annular flange 35, provided on the radially inner surface 34 of the support member 32 is provided, substantially midway along its length in the axial direction, with an annular groove 300 (see FIG. 34). The annular groove 300 extends radially inwardly from the radially inner surface of the annular flange 35 and extends, in the circumferential direction, about the turbocharger axis 5A, substantially about the inner circumference of the support member 32. An annular ring seal 301 (see FIG. 25) is received within the groove 300 and seals the support member 32 against the radially outer surface 27 of the bearing housing 4. In this regard, the annular groove 300 and seal 301 replaces the annular groove 36 in the bearing housing and the annular seal 37 of the first embodiment so as to provide an alternative sealing arrangement to seal the support member 32 against the radially outer surface 27 of the bearing housing 4.

The second embodiment of the turbocharger also differs from the first embodiment in how the cam member 47 is coupled to the movable shroud 11. In this regard, the axially extending annular flange 19 of the shroud 11 is provided, towards its inboard end, with a plurality of circumferentially distributed radial bores 302. Each bore 302 extends from the radially outer surface 22 of the axially extending flange 19 to a radially inner surface 303 of the axially extending flange 19 (see FIG. 36). Each bore 302 extends from the radially outer surface 22 to the radially inner surface 303 along a longitudinal axis that is substantially parallel to the radial direction. Each bore 302 has a substantially circular cross-sectional shape (about its longitudinal axis). Each bore 302 is for receiving a respective said pin 69 (as described in more detail below).

In this embodiment, the carrier member 39 and the shroud 11 are not connected to each other by the stepped arrangement 23 of the first embodiment. In this regard, the axially extending flange 19 of the shroud 11 is of substantially uniform thickness across its length in the axial direction and so is not provided with said section 23 that defines a step.

Instead, the axial flange 19 of the shroud 11 extends inboard substantially across the axial length of the carrier member 39. In this regard, respective axially inboard ends of the axial flange 19 of the shroud 11 and of the radially outer surface 41 of the carrier member 39 are substantially axially aligned. The radially outer surface 41 of the carrier member 39 forms an interference fit with the adjacent radially inner surface 303 of the axially extending flange 19 of the shroud 11.

The radial bores 43 in the annular wall 117 of the carrier member 39 are substantially aligned in, the circumferential direction, with the respective bores 302 in the annular flange 19 of the shroud 11. In addition, the slots 50 in the cam member 47 overlap the radial bores 302, 43, in the axially extending flange 19 of the shroud 11 and in the carrier member 39.

As with the first embodiment, each pin 69 is received within a respective radial bore 43 in the carrier member 39. In addition, in this embodiment, each pin 69 passes through a respective said bore 302 in the axial flange 19 of the shroud 11. In this way, the shroud 11 is coupled to the carrier member 39 due to said interference fit and due to the pins 69 engaging in the bores 302 in the axial flange 19 of the shroud 11. In this respect, each bore 302 in the flange 19 has a diameter that is substantially the same (or slightly greater than) the diameter of the pins 69 so that as the pin 69 move in the axial direction, the shroud 11 is also moved in the axial direction (i.e. the shroud 11 is axially fixed relative to the pins 69).

The method of operation of the actuation mechanism is substantially the same as that for the first embodiment. In this respect, the rotation of the cam member 47 causes movement of each slot 50 relative to the respective pin 69 that passes through the slot 50. The inner surfaces 51 of the cam member 47, that define the slots 50, engage the pins 69 so as to move them in the axial direction. The engagement of each pin 69 with the inner surface 56 of the annular flange 52 that defines the respective axial slot 55 in the bearing housing 4 prevents the pin 69 from rotating and guides the pin 69 in the axial direction. The engagement of the pin 69 in the radial bores 43 in the carrier member 39 causes the carrier member 39 (and therefore the shroud 11) to move in the axial direction), with the seal 44 in the annular groove 46 in the carrier member 39 sliding across the radially outer surface of the support member 32. In addition, the engagement of the pins 69 in the radial bores 303 in the shroud 11 also acts to move the shroud 11 in the axial direction, so as to vary the width of the inlet passageway.

However, in this embodiment, the helical slots 50 are oriented in the opposite rotational sense. Accordingly, rotation of the cam member 47 in the clockwise direction (when viewed looking from the turbine end of FIG. 26), acts to move the inboard surface 12 of the radial wall 18 of the shroud 11 towards the facing inboard surface 17 of the turbine housing 2.

In this embodiment, the radially extending protrusion 66 of the cam member 47 has been replaced with a slot 304. The slot 304 extends radially inwardly, from the radially outer surface 48 of the annular wall 104 of the cam member 47, to the radially inner surface 49, along a longitudinal axis. The longitudinal axis is substantially parallel to the radial direction. The slot 304 has a substantially rectangular cross-sectional shape (with an open outboard side), about its longitudinal axis.

The slot 304 extends in the inboard axial direction from an axially outboard surface of the annular wall 104 of the cam member 47 and terminates within the axial thickness of said annular wall 104 such that the slot 304 is open at its axially outboard end and is closed at its axially inboard end.

The axially extending protrusion 58 of the arm 60 is of a complimentary shape to that of the slot 304 in the cam member 47. In this regard, the protrusion 58 has a curved rectangular cross-sectional shape that forms an interference fit with the slot 304 such that rotation of the protrusion 58 about the turbocharger axis, rotates the cam member 47 about the turbocharger axis.

The removal of the radially extending protrusion 66 of the cam member 47 of the first embodiment advantageously reduces the weight of the actuation mechanism.

Figure 37:
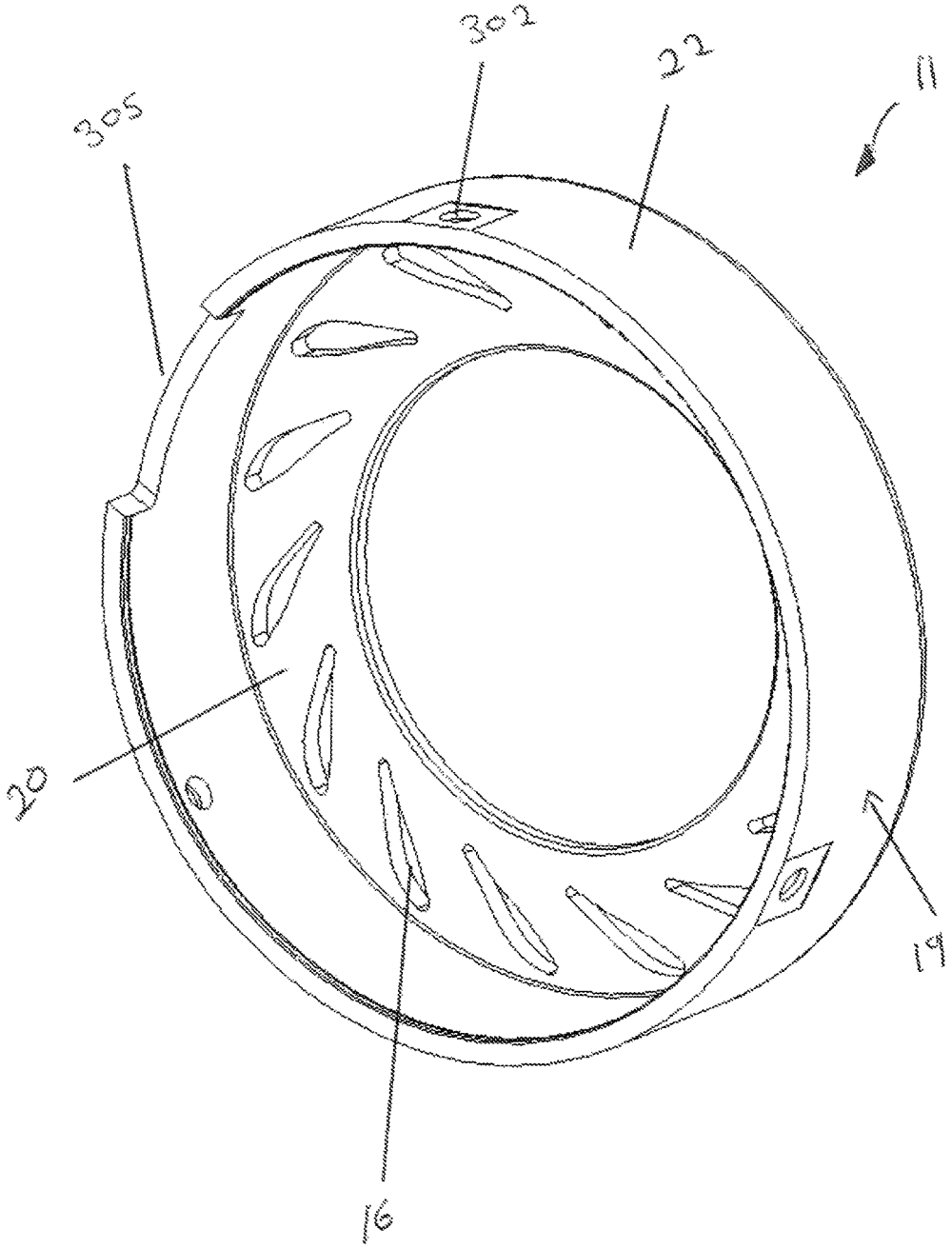
FIG. 37 is a rear perspective view of the shroud shown in FIGS. 35 and 36.
Figure 39:
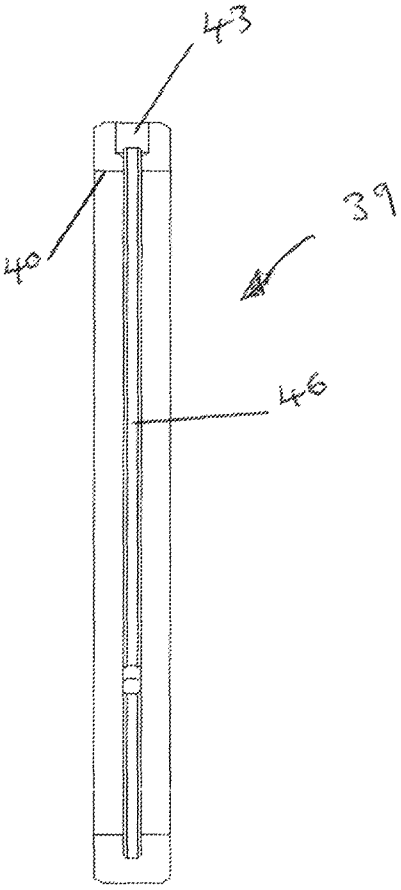
FIG. 39 is an axial cross-sectional view of the carrier member shown in FIG. 38.
Figure 38:
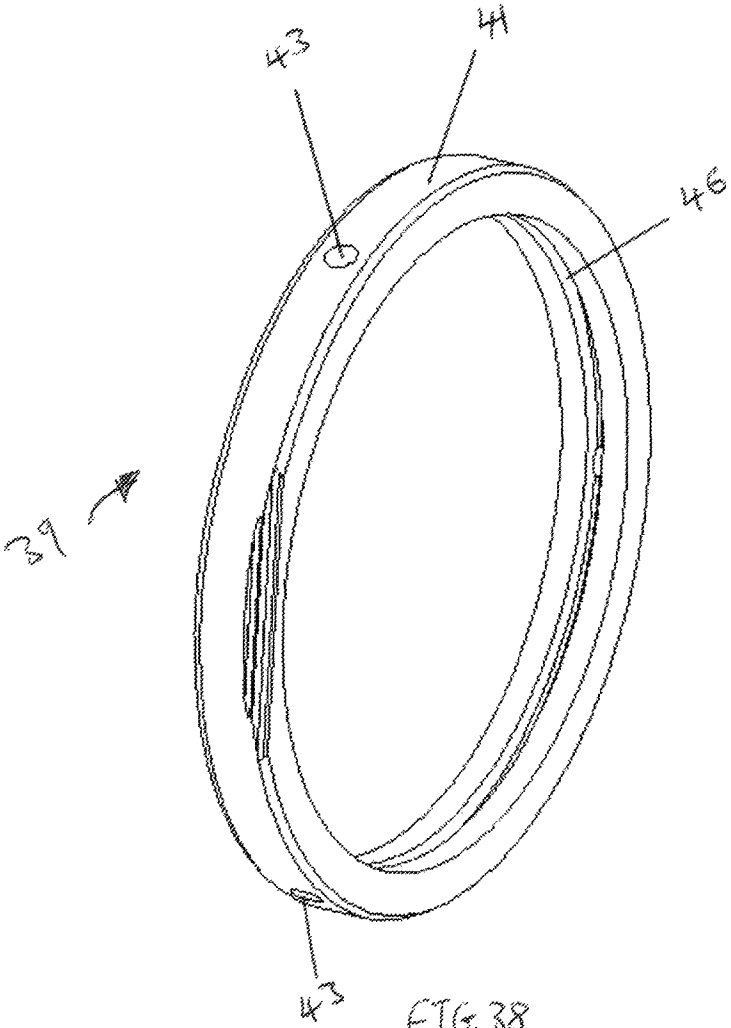
FIG. 38 is a front perspective view of a carrier member of the variable geometry turbine shown in FIGS. 25 to 27.
Figure 41:
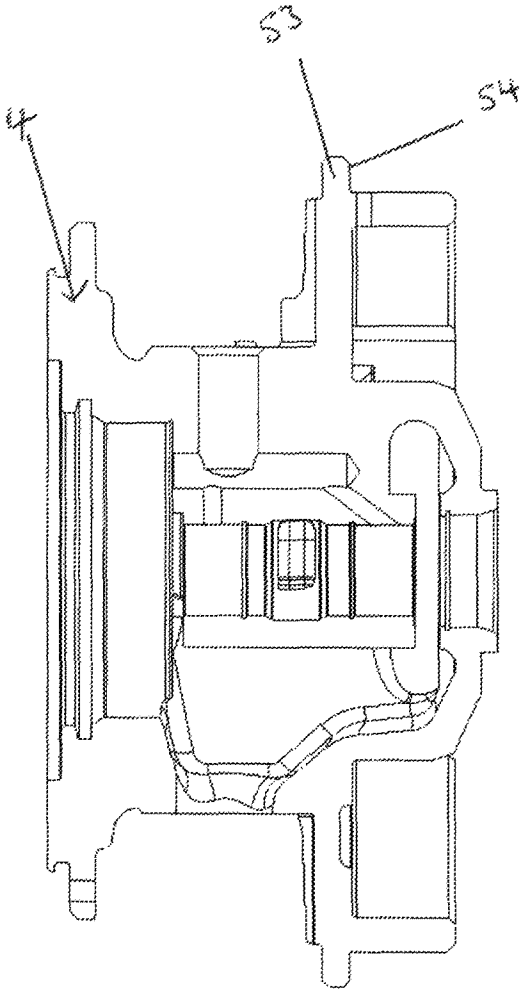
FIG. 41 is an axial cross-sectional view of the bearing housing shown in FIG. 40.
Figure 40:
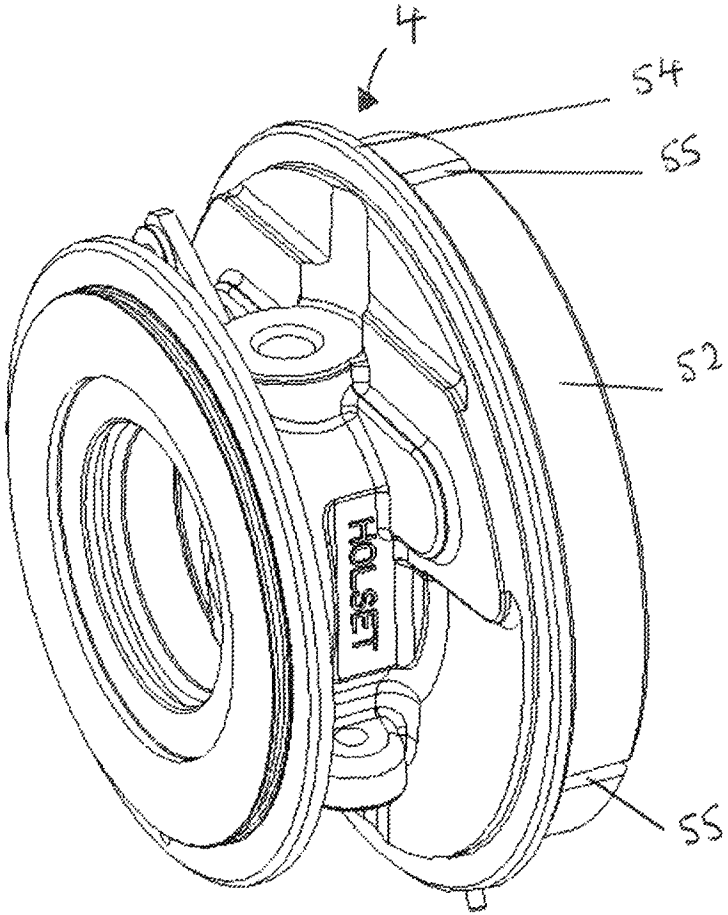
FIG. 40 is a rear perspective view of a bearing housing of the turbocharger shown in FIGS. 25 to 27.
Figure 43:
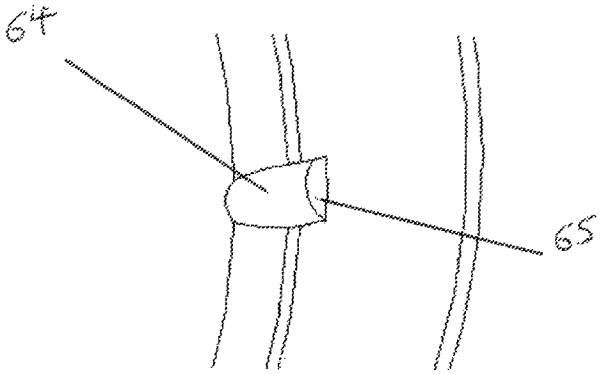
FIG. 43 is an enlarged perspective view of the region labelled 'A' in FIG. 42.
Figure 42:
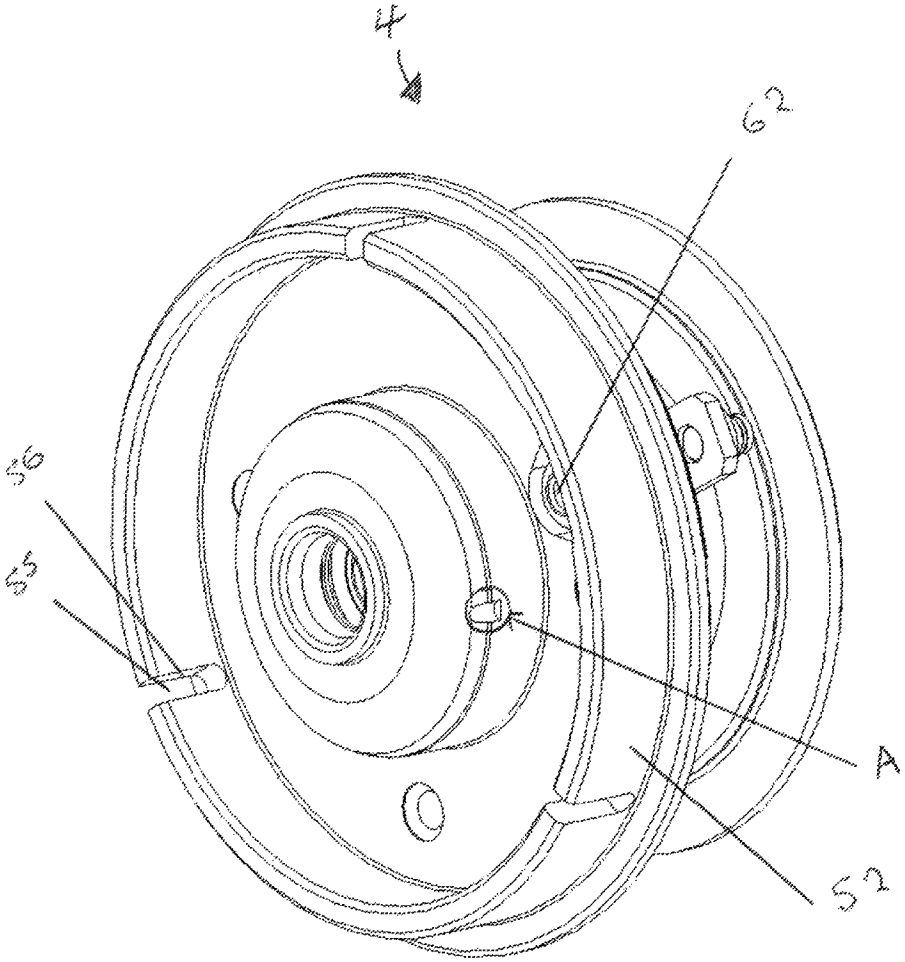
FIG. 42 is a front perspective view of the bearing housing shown in FIGS. 40 and 41.
Figure 44:
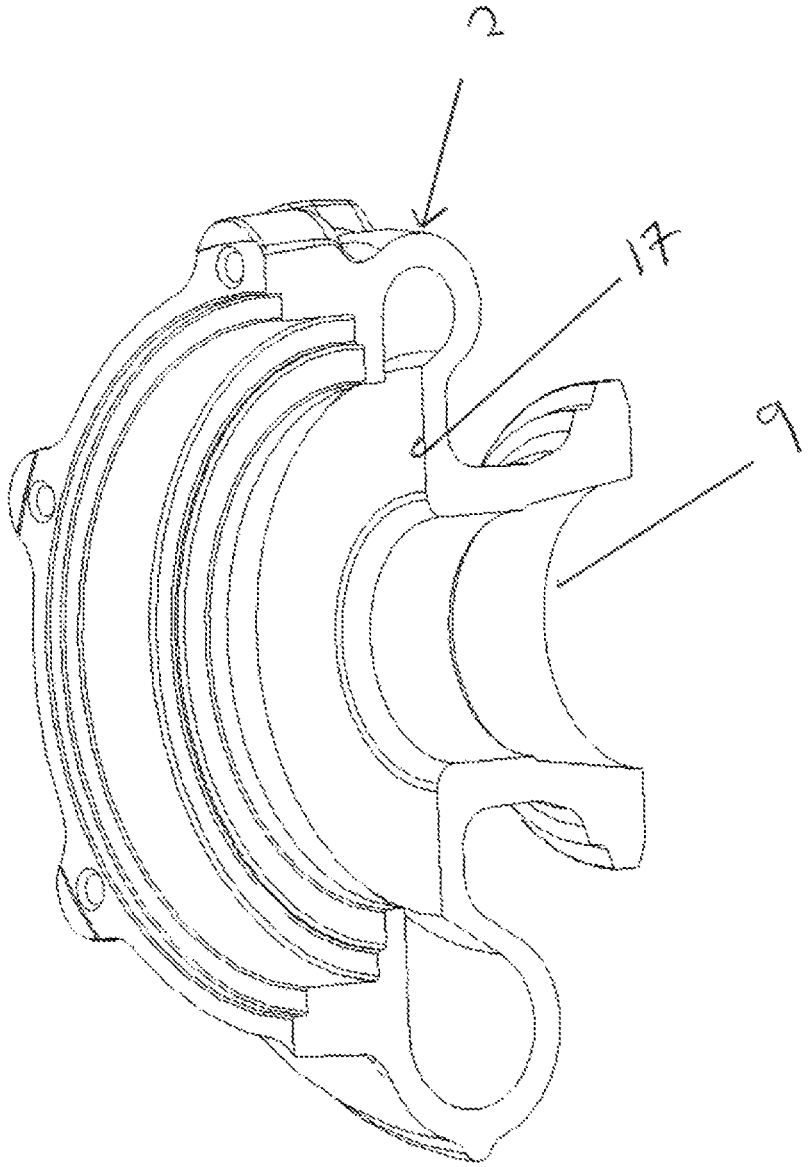
FIG. 44 is a cut away perspective view of a turbine housing of the turbocharger shown in FIGS. 25 to 27.
Figure 46:
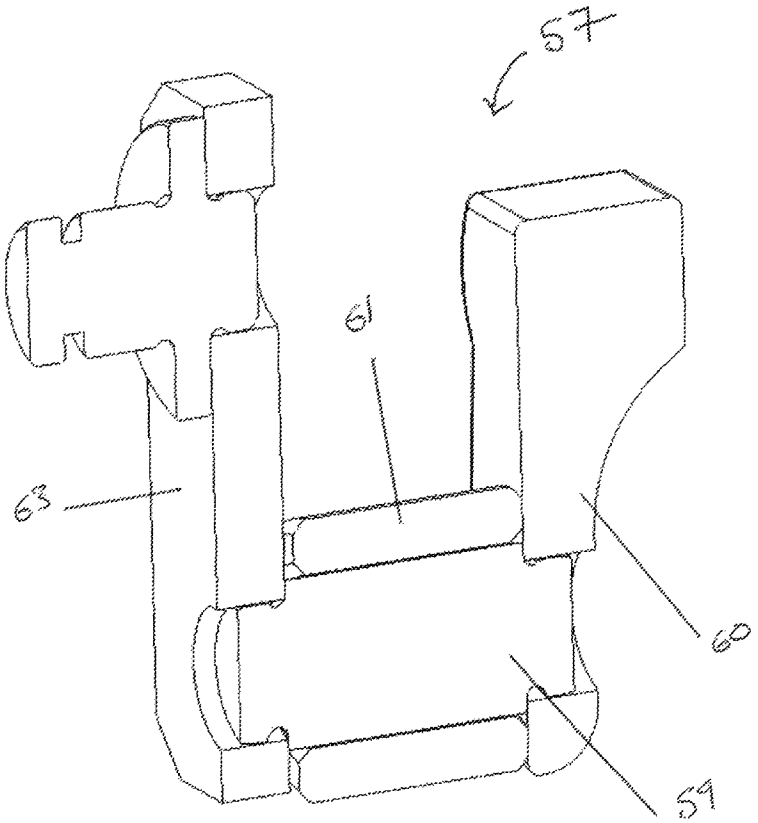
FIG. 46 is a cut away perspective view of the rotatable arm assembly shown in FIG. 45.
Figure 45:
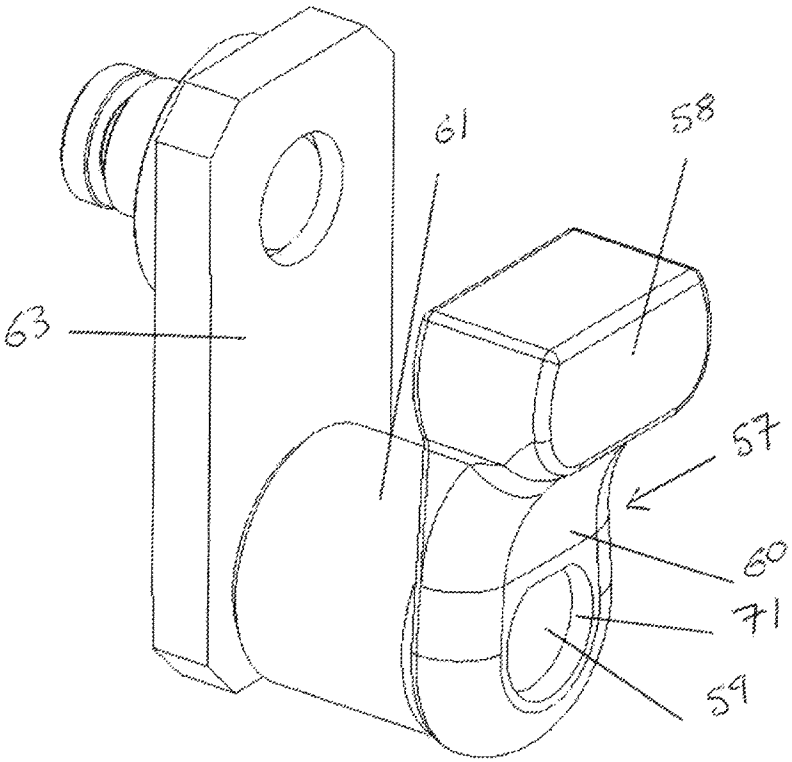
FIG. 45 is a perspective view of a rotatable arm assembly of the turbocharger shown in FIGS. 25 to 27.
Figure 47:
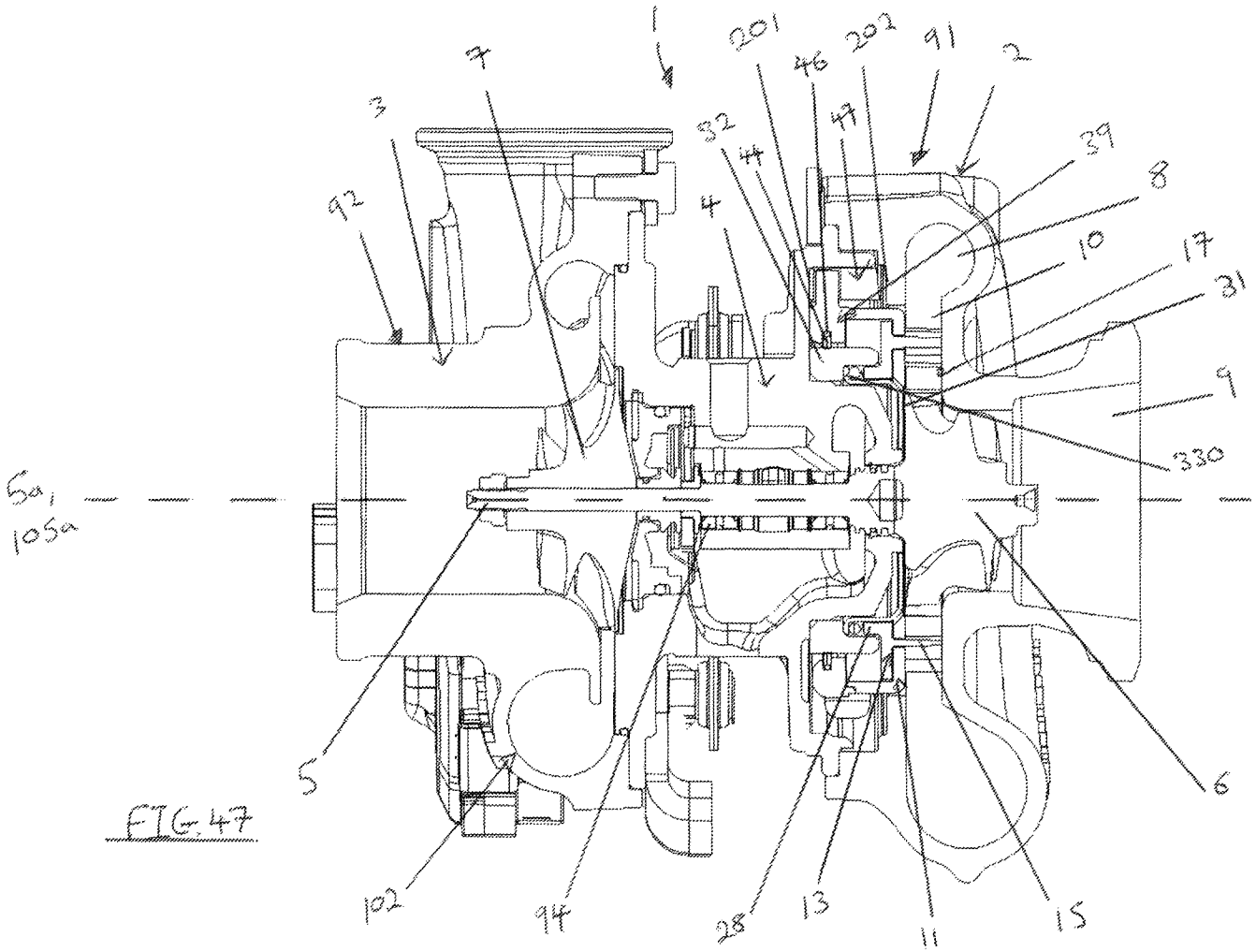
FIG. 47 is an axial cross section through a variable geometry turbocharger according to a third embodiment of the present disclosure.

As shown in FIG. 37, an outboard end of the axially extending flange 19 of the shroud 11 is provided with a slot 305 (see FIG. 37). The slot extends axially inboard from the outboard end of the flange 19 and extends in the circumferential direction, part way along the circumference of the flange 19. The slot is adjacent to the arm 60 of the rotatable arm assembly 57 and provides clearance for the arm 60 to rotate.

Referring to FIGS. 47 to 70 there is shown a variable geometry turbocharger comprising a variable geometry turbine assembly according to a third embodiment of the present disclosure. The variable geometry turbocharger of the third embodiment is identical to the variable geometry turbocharger of the second embodiment, except for the differences described below. Corresponding features are given corresponding reference numerals.

The turbocharger of the third embodiment differs from that of the second embodiment in that the annular flange 52 is not provided with said axially extending slots 55. Instead, the vanes 15 of the nozzle ring 13 and the slots 16 in the shroud 11 are arranged such that the engagement of the vanes 15 within the slots 16 substantially prevents the shroud 11, and carrier member 39, from rotating, as the pins 69 are urged in both the axial and circumferential directions due to the rotation of the cam member 47. In this regard, the slots 16 have a complimentary shape to the vanes 15. In a similar manner to the second embodiment, rotation of the cam member 47 in the clockwise direction (when viewed looking from the turbine end of FIG. 48), acts to move the inboard surface 12 of the radial wall 18 of the shroud 11 towards the facing inboard surface 17 of the turbine housing 2.

In this embodiment, there are no said axial guide slots 55 provided in said bearing housing. Accordingly, as the cam member 47 rotates, the pins 69 are not prevented from rotating by said axial guide slots 55.

In this regard, the rotation of the cam member 47 (in the clockwise direction) causes the inner surfaces 51 of the cam member that define the slots 50 to engage the respective pins 69 such that the pins 69 are urged in the clockwise rotational direction about the turbine axis. This acts to rotate the carrier member, and therefore the shroud 11 about the turbine axis (in said clockwise direction). However, the engagement of the vanes 15 within the slots 16 acts to limit the rotation of the shroud 11 and to guide the shroud 11 in the axial direction. In this regard, as the shroud 11 moves axially, the slots 16 slide over the vanes 15.

Due to the rotational force exerted on the shroud 11 by the cam member 47, via the pins 69, the shroud 11 is rotated by a small amount such that, for each slot 16, a radially outer section of a surface of the shroud that defines the slot abuts a radially outer surface the vane 15 received within the slot. This substantially closes the high pressure side of the slot and substantially prevents exhaust gas on this side from passing from the inlet passageway through the slots 16.

Alternatively, the actuation mechanism may be arranged such that rotation of the cam member 47 in the anti-clockwise direction (when viewed looking from the turbine end of FIG. 48), acts to move the inboard surface 12 of the radial wall 18 of the shroud 11 towards the facing inboard surface 17 of the turbine housing 2. In order to do this, the rotational orientation of the helical slots may be reversed.

In this case, the rotation of the cam member 47 (in the anti-clockwise direction) causes the inner surfaces 51 of the cam member that define the slots 50 to engage the respective pins 69 such that the pins 69 are urged in the anti-clockwise direction about the turbine axis. This acts to rotate the carrier member 39, and therefore the shroud 11 about the turbine axis (in said anti-clockwise direction). However, the engagement of the vanes 15 within the slots 16 acts to limit the rotation of the shroud 11 and to guide the shroud 11 in the axial direction.

Due to the rotational force exerted on the shroud 11 by the cam member 47, via the pins 69, the shroud 11 is rotated by a small amount such that, for each slot 16, a radially inner section of a surface of the shroud that defines the slot abuts a radially inner surface the vane 15 received within the slot.

This substantially closes the low pressure side of the slot and substantially prevents exhaust gas on this side from passing from the inlet passageway through the slots 16.

Accordingly, in this way, the actuation mechanism may be arranged in either rotational sense to provide desired performance characteristics.

Furthermore, in this embodiment, the pins 69 are integrally formed with the carrier member 39. In this regard, the pins 69 form part of the carrier member 39 and protrude radially outwardly from a radially outer surface of the carrier member 39. As with the preceding embodiments, the pins 69 each extend from a radially inner end to a radially outer end along a longitudinal axis that is substantially parallel to the radial direction. In this embodiment, each pin 69 has a cross-sectional shape, about its longitudinal axis, that is of a generally square shape with curved corners. This shape advantageously increases the contact area between the pins 69 and the surfaces 51 that define the slots 50, which reduces the contact stresses between the pins 69 and said surfaces 51.

In addition, since the pins 69 are integral with the carrier member 39 this facilitates assembly of a cartridge assembly 1400, formed by the cam member 47, the pins 69, the carrier member 39, the support member 32, the shroud 11 and the nozzle ring 13, since this provides few separate components to have to bring together.

Figure 48:
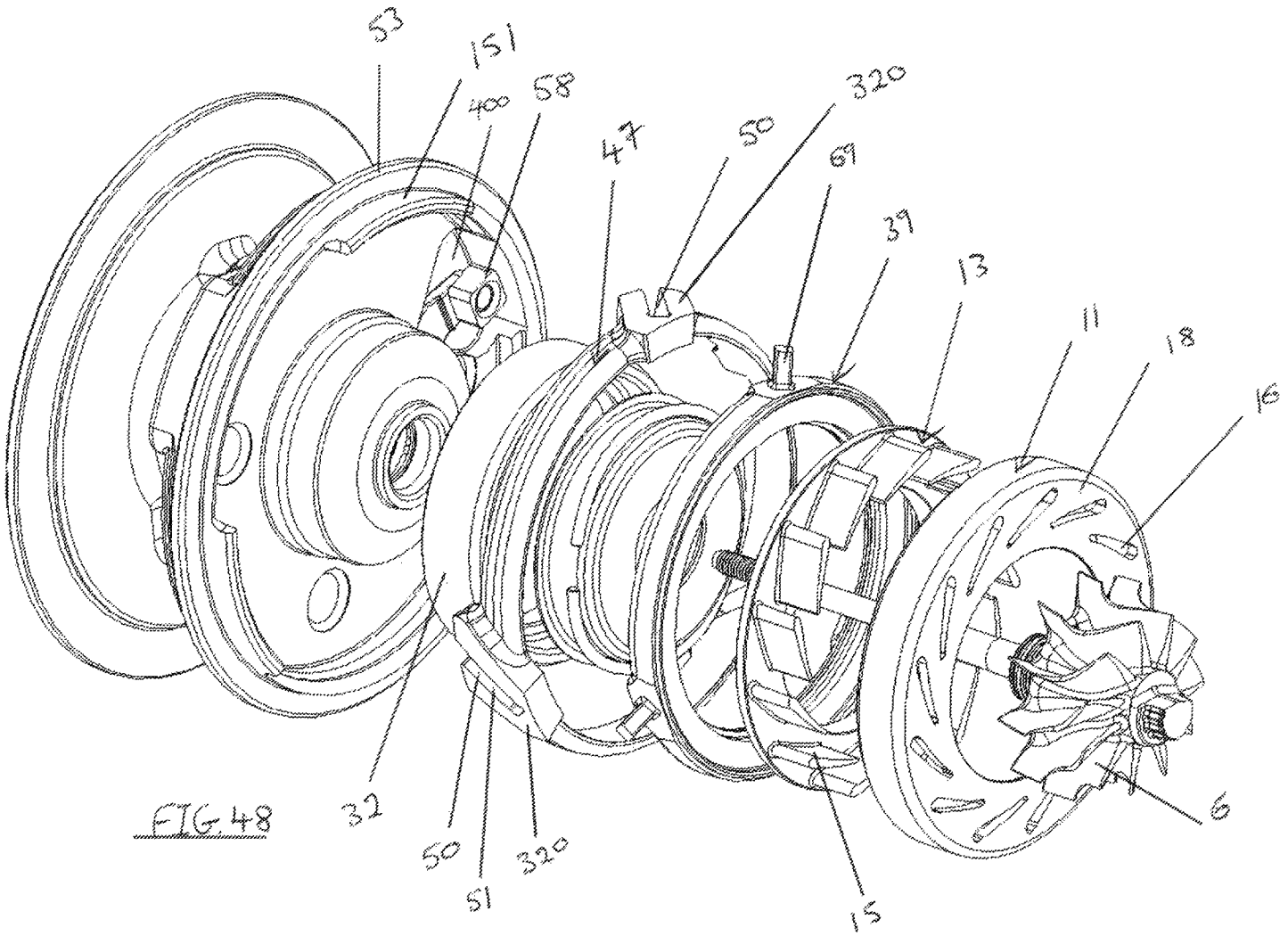
FIG. 48 is an exploded perspective view of part of a variable geometry turbine and of a bearing housing of the variable geometry turbocharger shown in FIG. 47.
Figure 49:
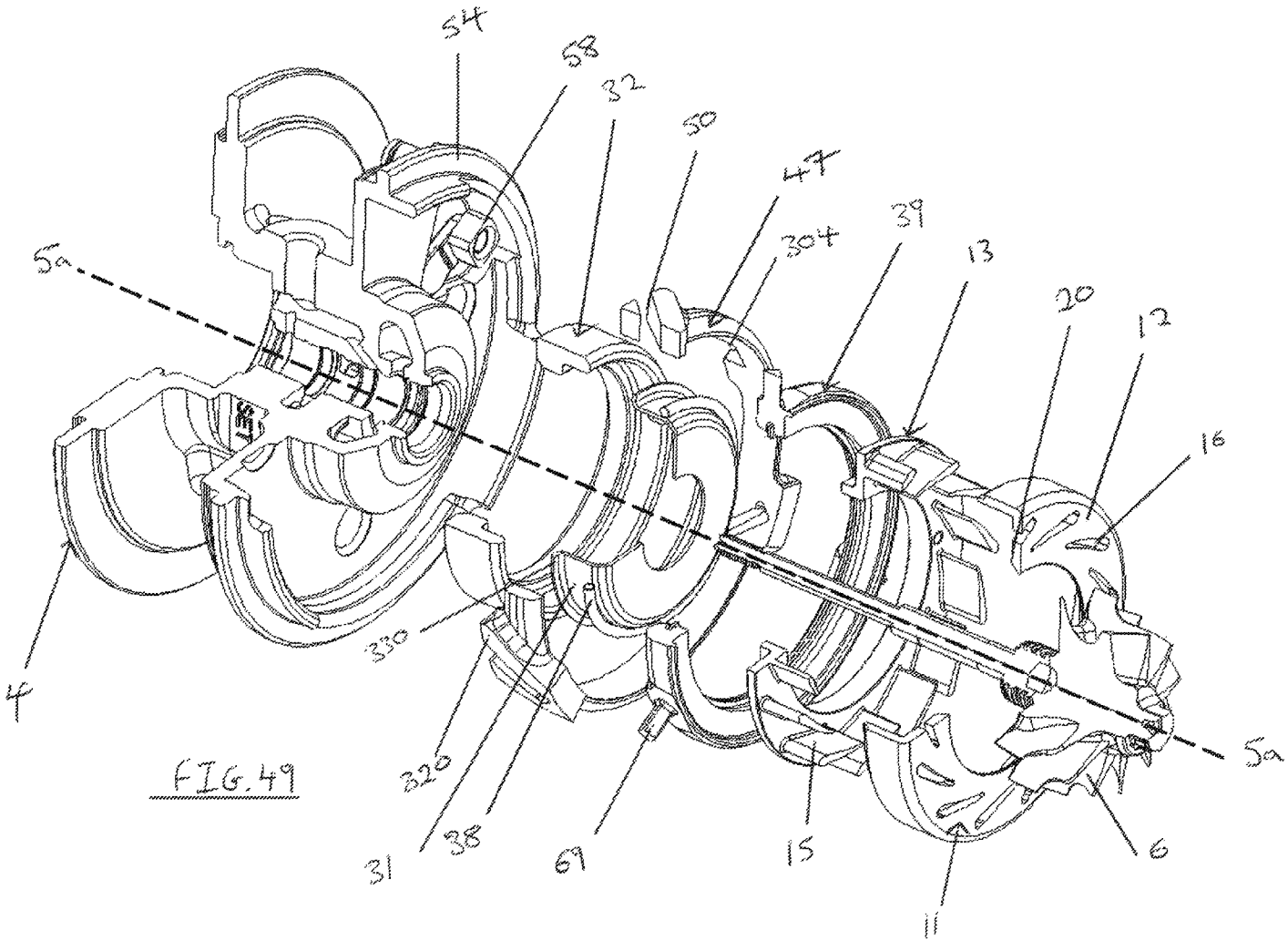
FIG. 49 is a view corresponding to that of FIG. 48, but with a circumferential section cut away for illustrative purposes.
Figure 50:
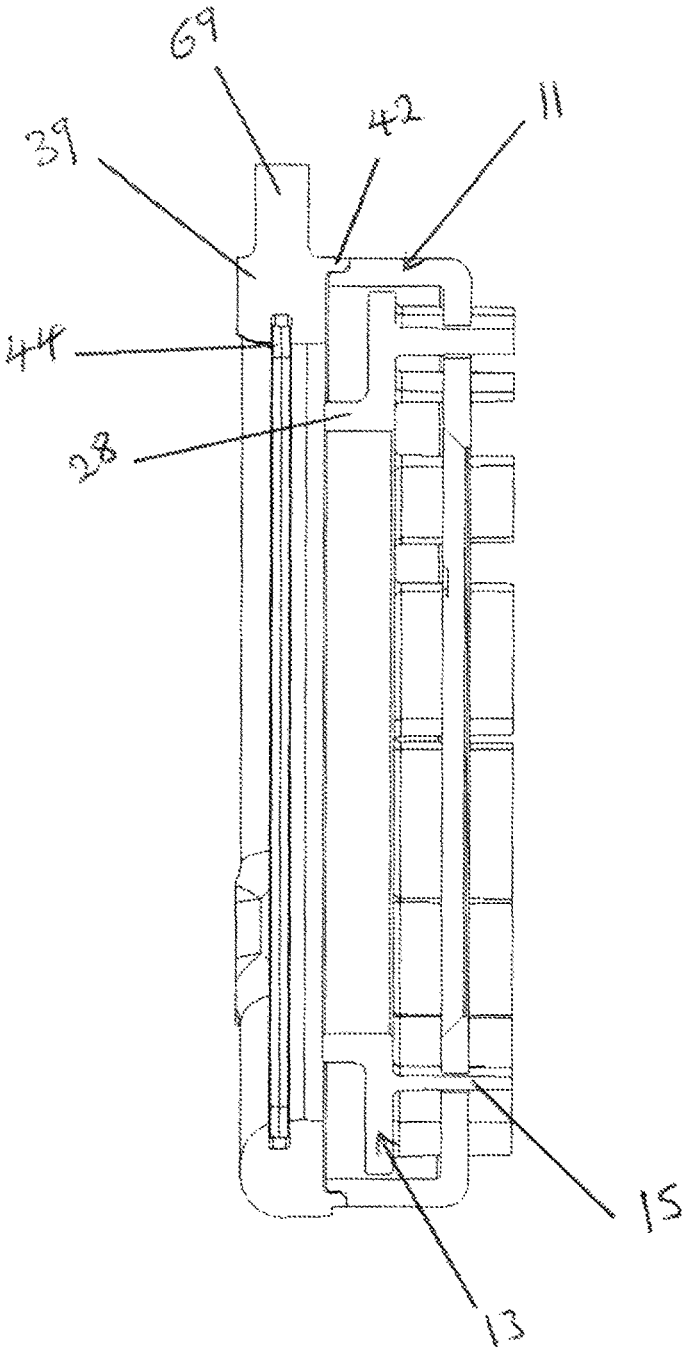
FIG. 50 is an axial cross-section through a carrier member, support member, shroud and nozzle ring of the variable geometry turbine shown in FIGS. 47 to 49.
Figure 51:
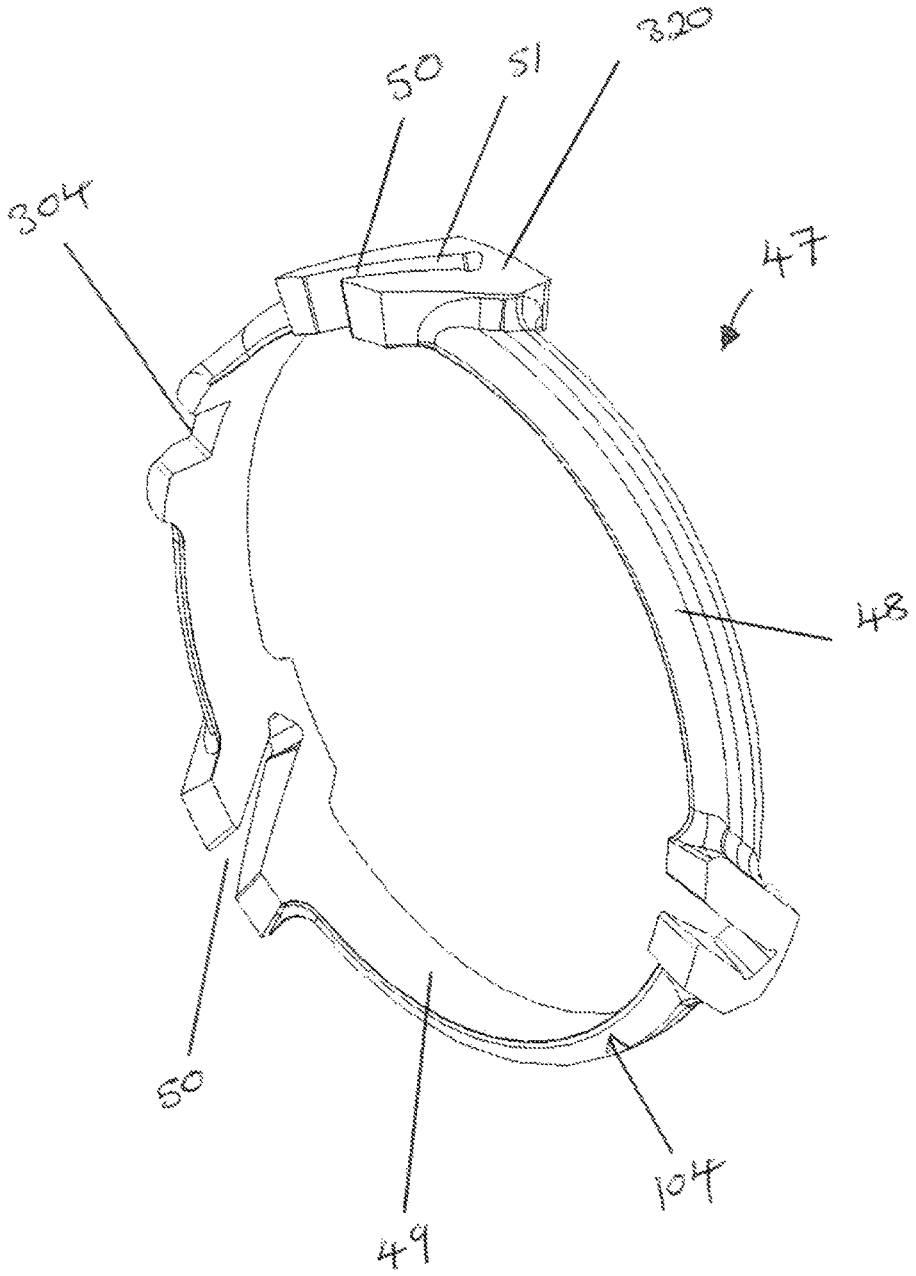
FIG. 51 is a rear perspective view of a cam member of the variable geometry turbine shown in FIGS. 47 to 49.
Figure 53:
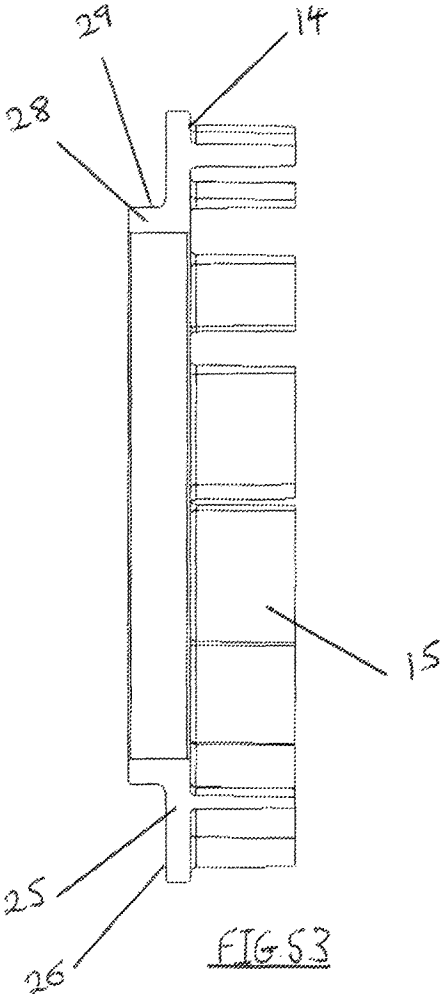
FIG. 53 is an axial cross-sectional view of the nozzle ring shown in FIG. 52.
Figure 52:
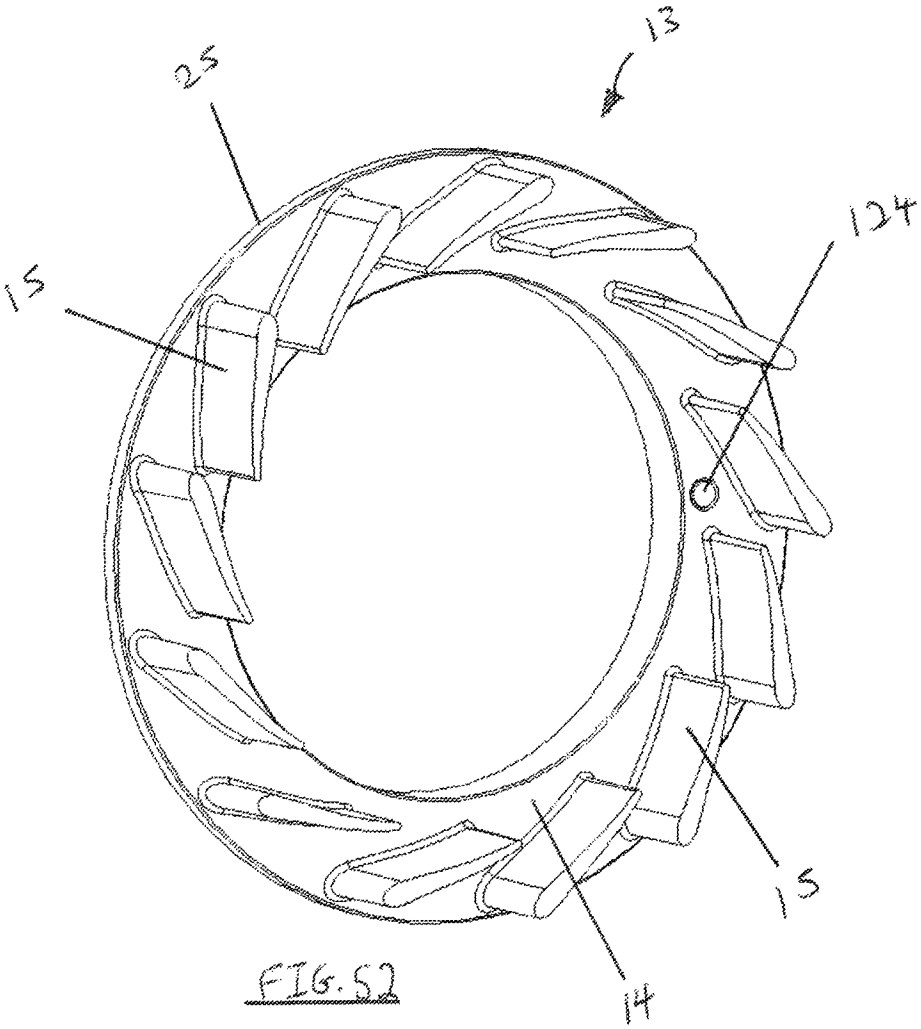
FIG. 52 is a front perspective view of a nozzle ring of the variable geometry turbine shown in FIGS. 47 to 49.

In this embodiment, the cam member 47 is of a thinner radial thickness compared to that of the previous embodiments, but is provided with a plurality of lugs 320 circumferential distributed about the cam member 47 (see FIG. 48). The lugs 320 are of greater thickness (in the radial direction) than the remaining sections of the cam member 47 provided between the lugs 320. In this embodiment, the cam member 47 is provided with three of said lugs 320, distributed in the circumferential direction.

Each lug 320 has an inner surface 51 that defines a respective said helical slot 50 for receiving a respective said pin 69. An outboard end of each helical slot 50 is open, so as to allow insertion of a respective said pin 69 (which is integral with the carrier member 39) through the open end and into the slot 50.

Providing the lugs 320 of increased thickness advantageously increases the contact area between the pins 69 and the inner surfaces 51 of the lugs 320, that define the helical slots 15. This advantageously reduces the contact stresses between the pins 69 and the inner surfaces 51 that define the helical slots 15. In addition, since the sections of the cam member 47 between the lugs 69 are of reduced thickness compared to the lugs 320, this reduces the overall weight of the cam member 47 (and therefore of the turbocharger), than if said sections of the cam member 47 were of the same thickness as the lugs 320.

Alternatively, instead of having pins 69 that are integral to the carrier member 39, the pins 69 may be separate entities to the carrier member 39 and may be receivable within bores 43 in the carrier member 39, as in the preceding embodiments.

In this embodiment, the carrier member 39 is attached to the shroud 11 as in the first embodiment, i.e. the axially extending flange 19 of the shroud 11 has a section 23 (see FIG. 60) towards its outboard end that is of reduced thickness.

A radially inner surface of the inboard section 42 of the annular wall 117 of the carrier member 39 is welded to a radially outer surface of the outboard section of reduced thickness 23 of the axial flange 19 of the shroud 11. It will be appreciated that carrier member 39 may be fixedly attached to the shroud 11 by any suitable means, including brazing.

Figure 54:
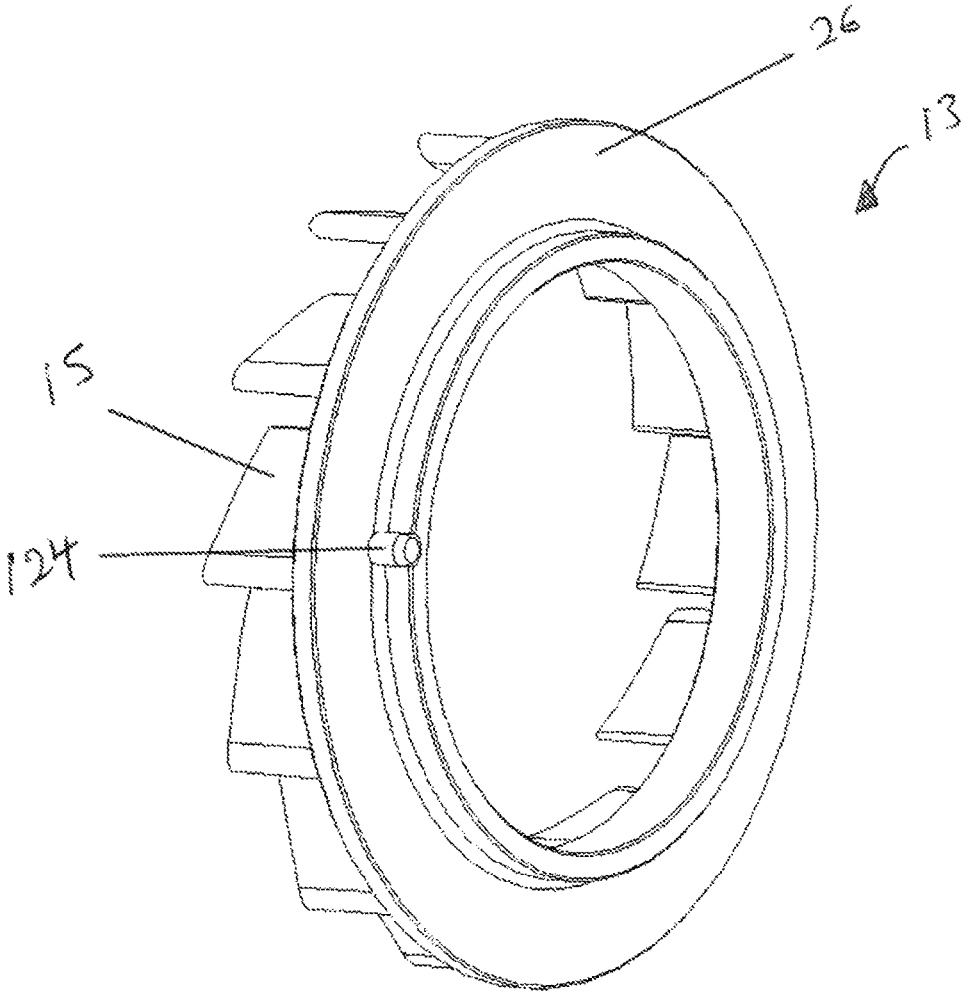
FIG. 54 is a rear perspective view of the nozzle ring shown in FIGS. 52 and 53.
Figure 56:
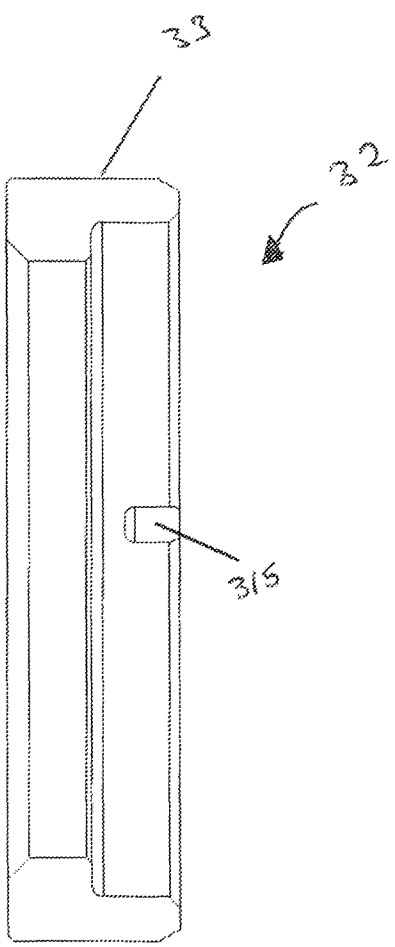
FIG. 56 is an axial cross-sectional view of the support member shown in FIG. 55.
Figure 55:
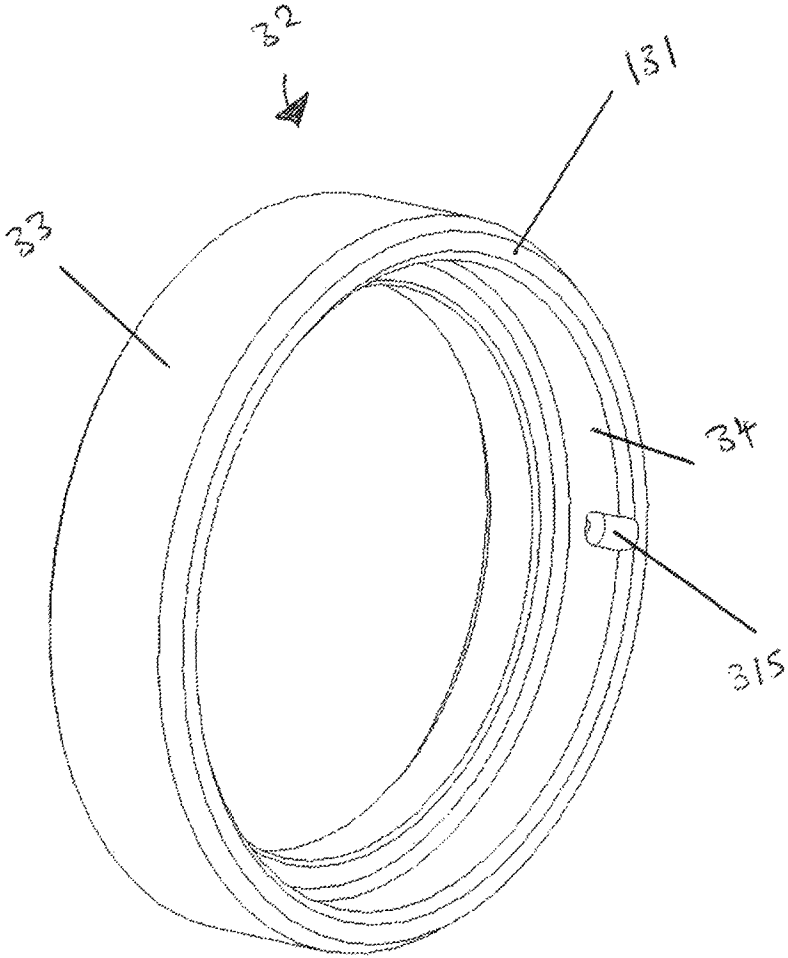
FIG. 55 is a front perspective view of a support member of the variable geometry turbine shown in FIGS. 47 to 49.
Figure 58:
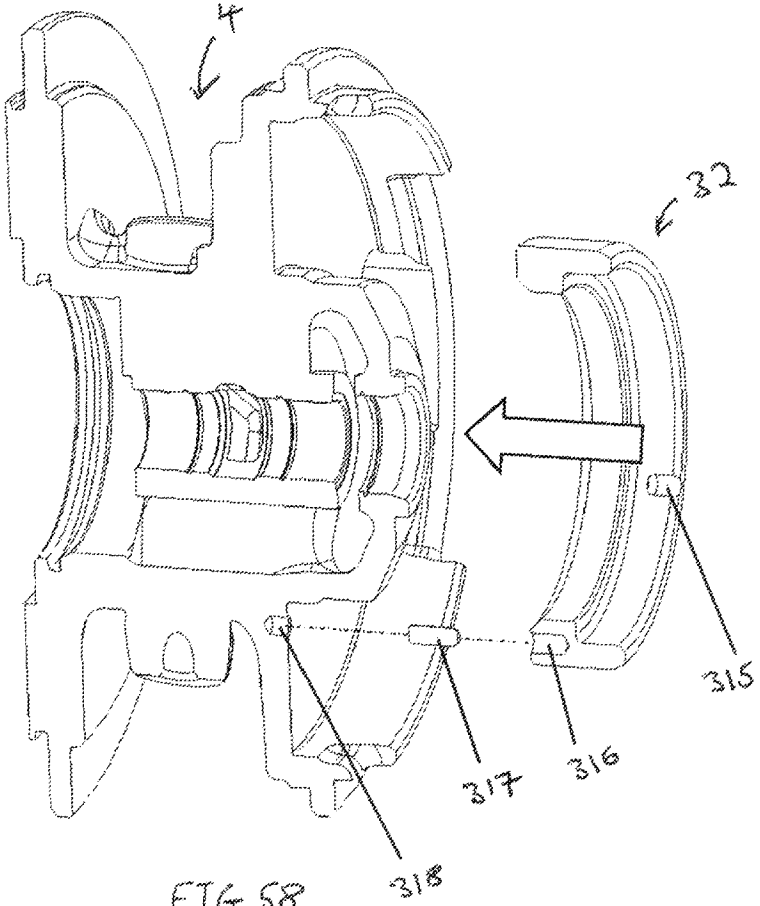
FIG. 58 is an exploded perspective view, with a circumferential section cut away for illustrative purposes, of a section of a bearing housing and the support member of the variable geometry turbine shown in FIGS. 47 to 49, showing how the support member is slidably mounted to the bearing housing.
Figure 57:
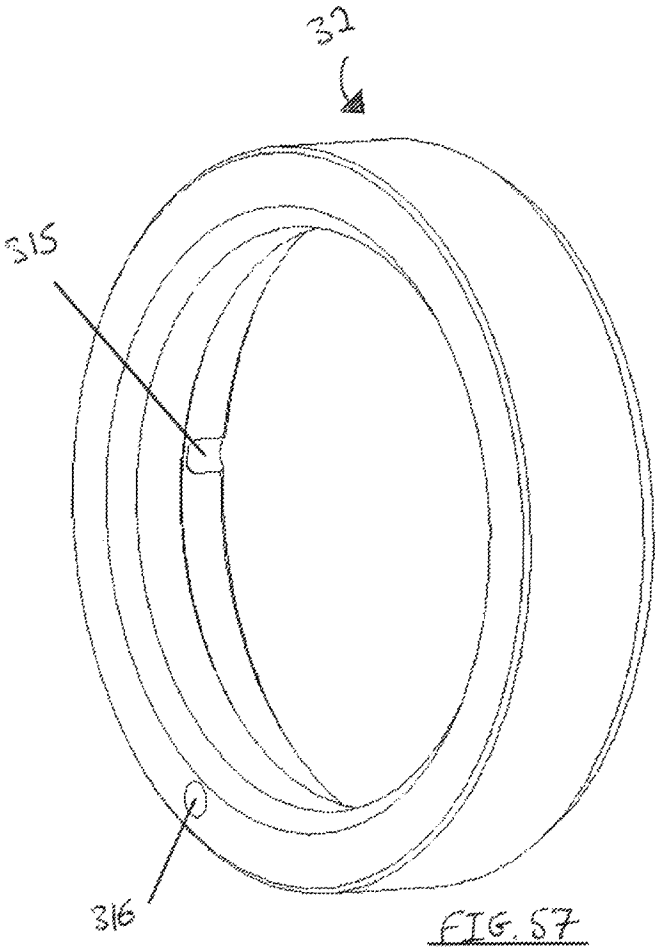
FIG. 57 is a rear perspective view of the support member shown in FIGS. 55 and 56.
Figure 60:
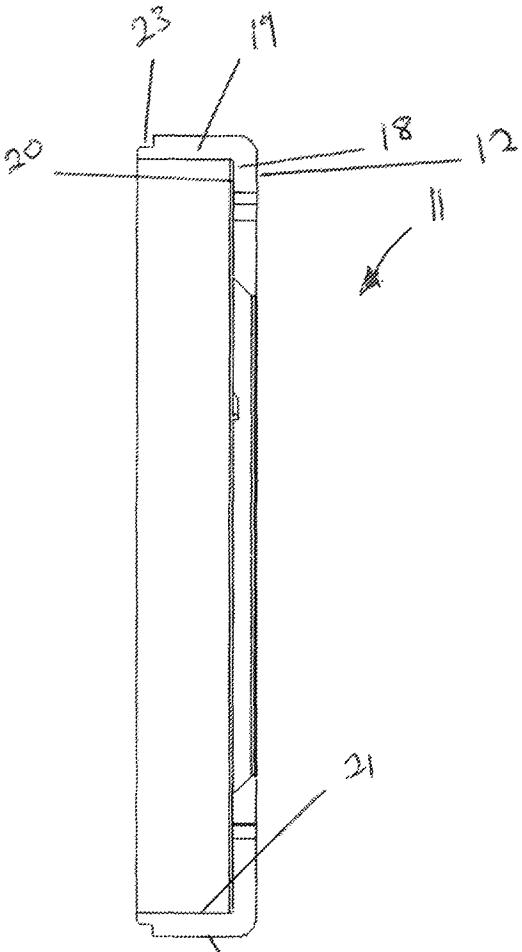
FIG. 60 is an axial cross-sectional view of the shroud shown in FIG. 59.
Figure 59:
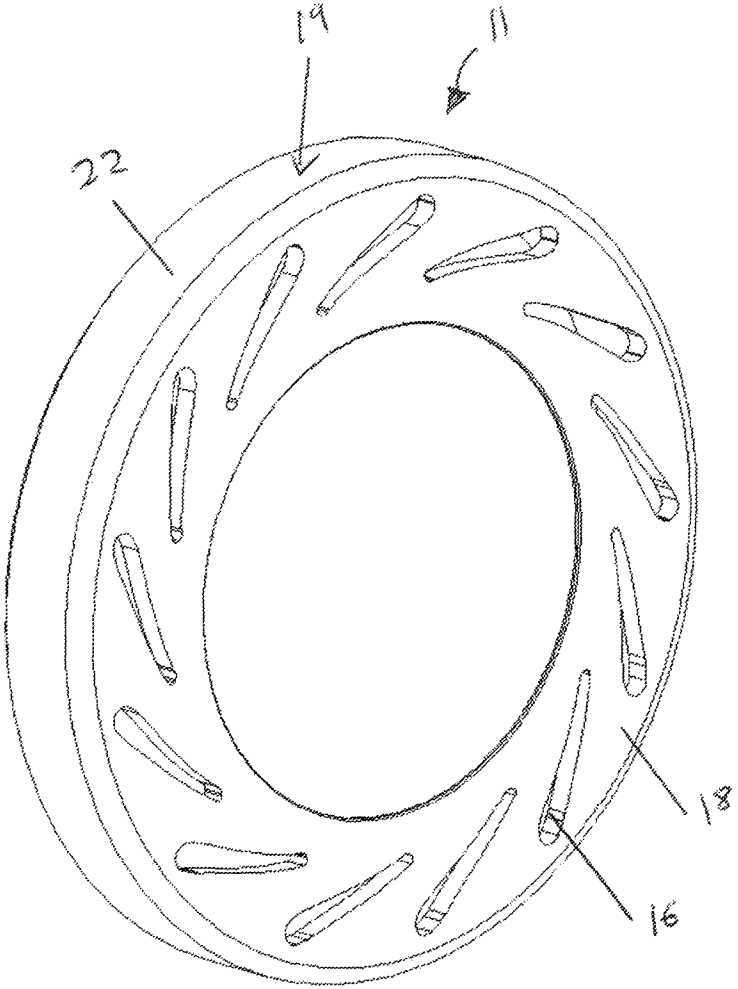
FIG. 59 is a front perspective view of a shroud of the variable geometry turbine shown in FIGS. 47 to 49.
Figure 61:
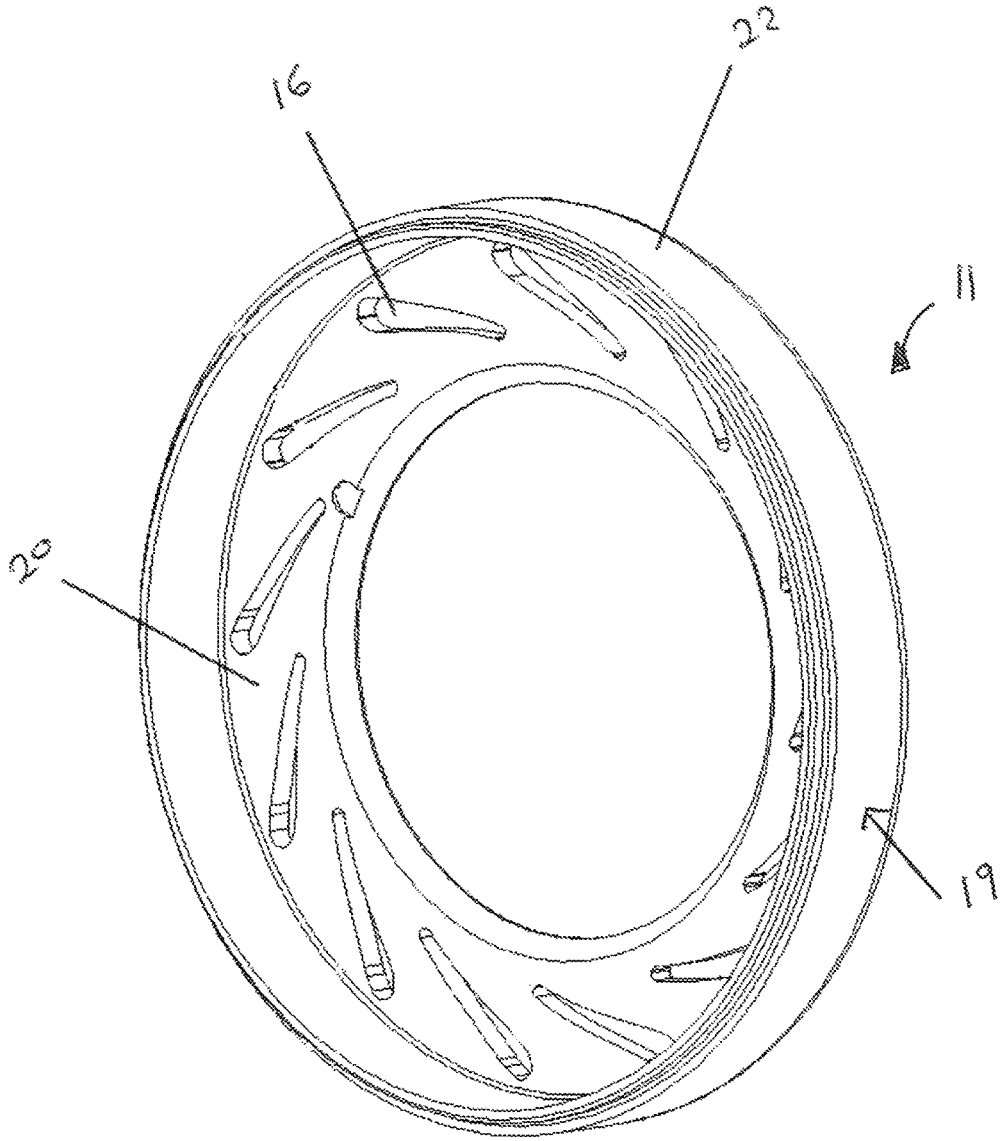
FIG. 61 is a rear perspective view of the shroud shown in FIGS. 59 and 60.
Figure 63:
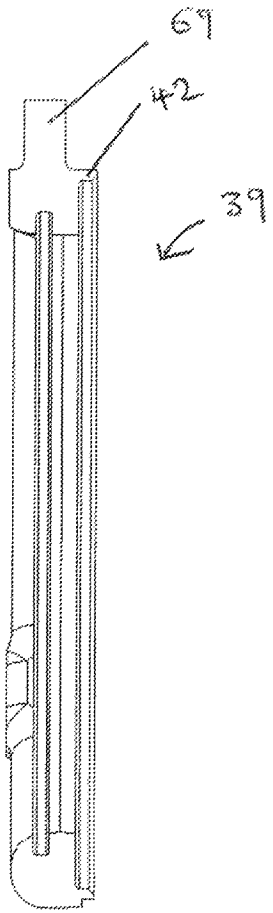
FIG. 63 is an axial cross-sectional view of the carrier member shown in FIG. 62.
Figure 62:
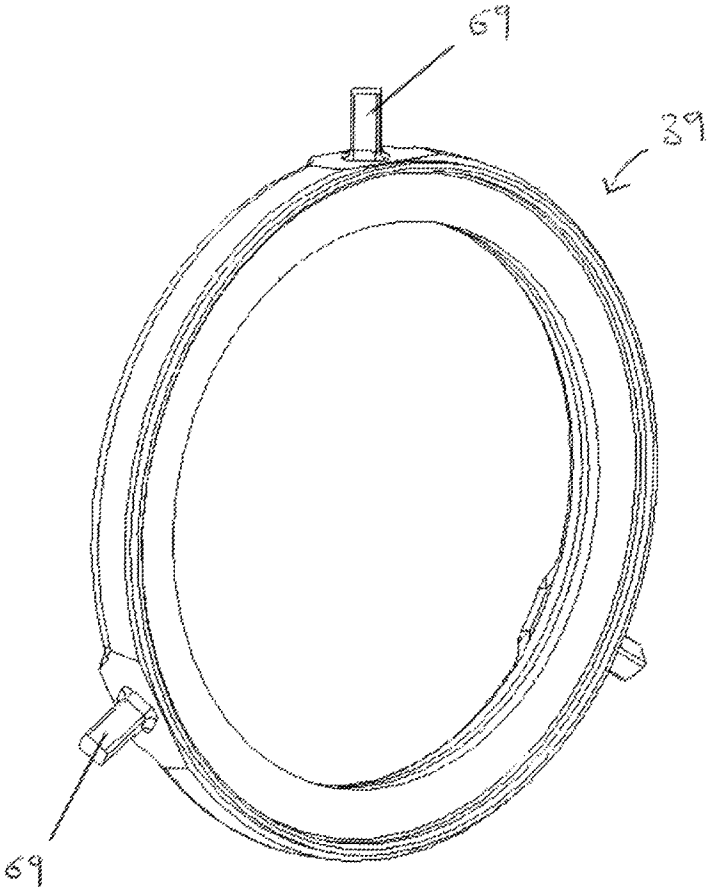
FIG. 62 is a front perspective view of a carrier member of the variable geometry turbine shown in FIGS. 47 to 49.
Figure 64:
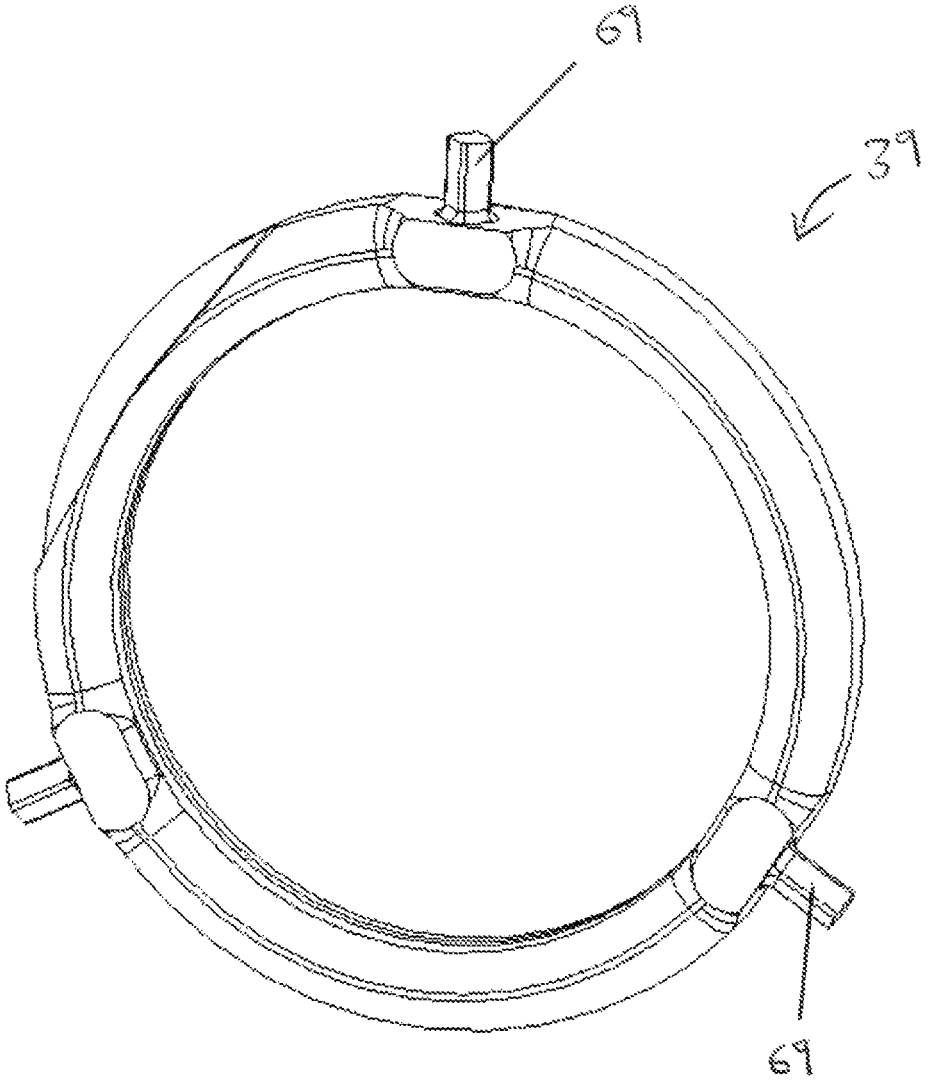
FIG. 64 is a rear perspective view of a carrier member shown in FIGS. 62 and 63.
Figure 66:
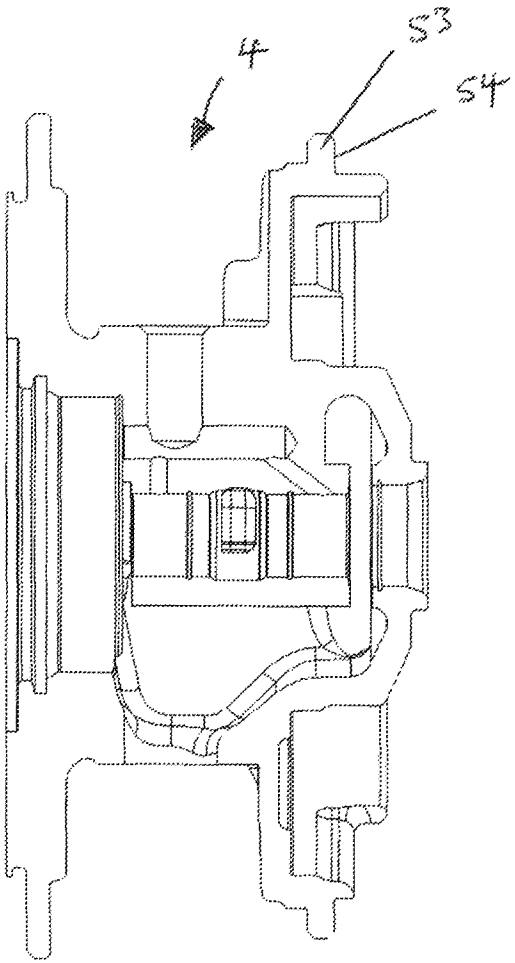
FIG. 66 is an axial cross-sectional view of the bearing housing shown in FIG. 65.
Figure 65:
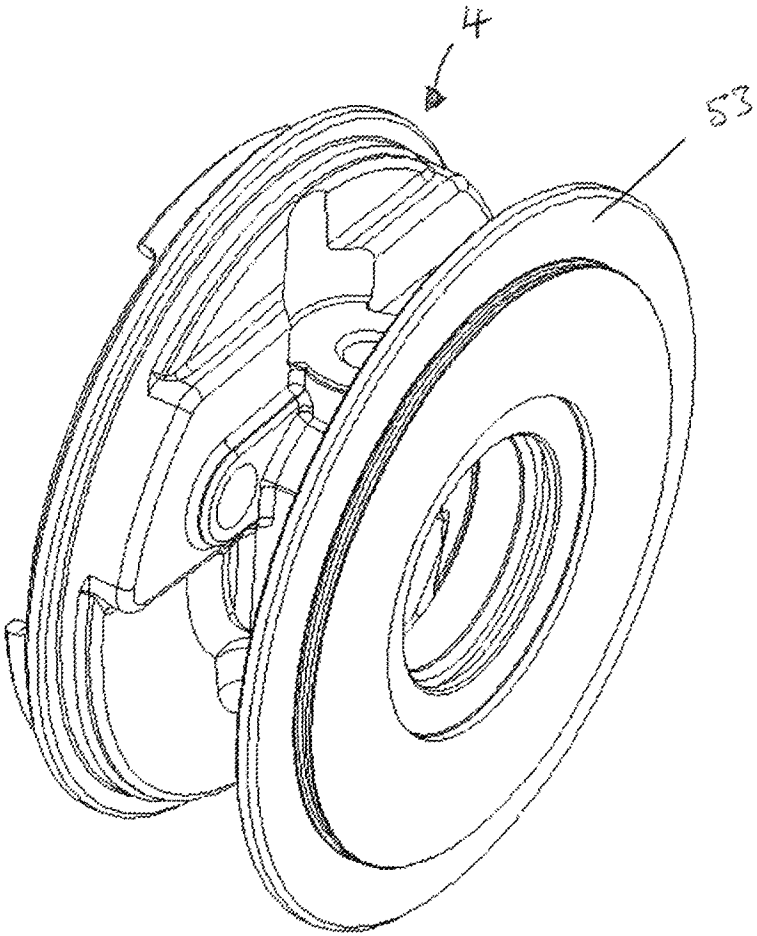
FIG. 65 is a rear perspective view of a bearing housing of the turbocharger shown in FIGS. 47 to 49.
Figure 67:
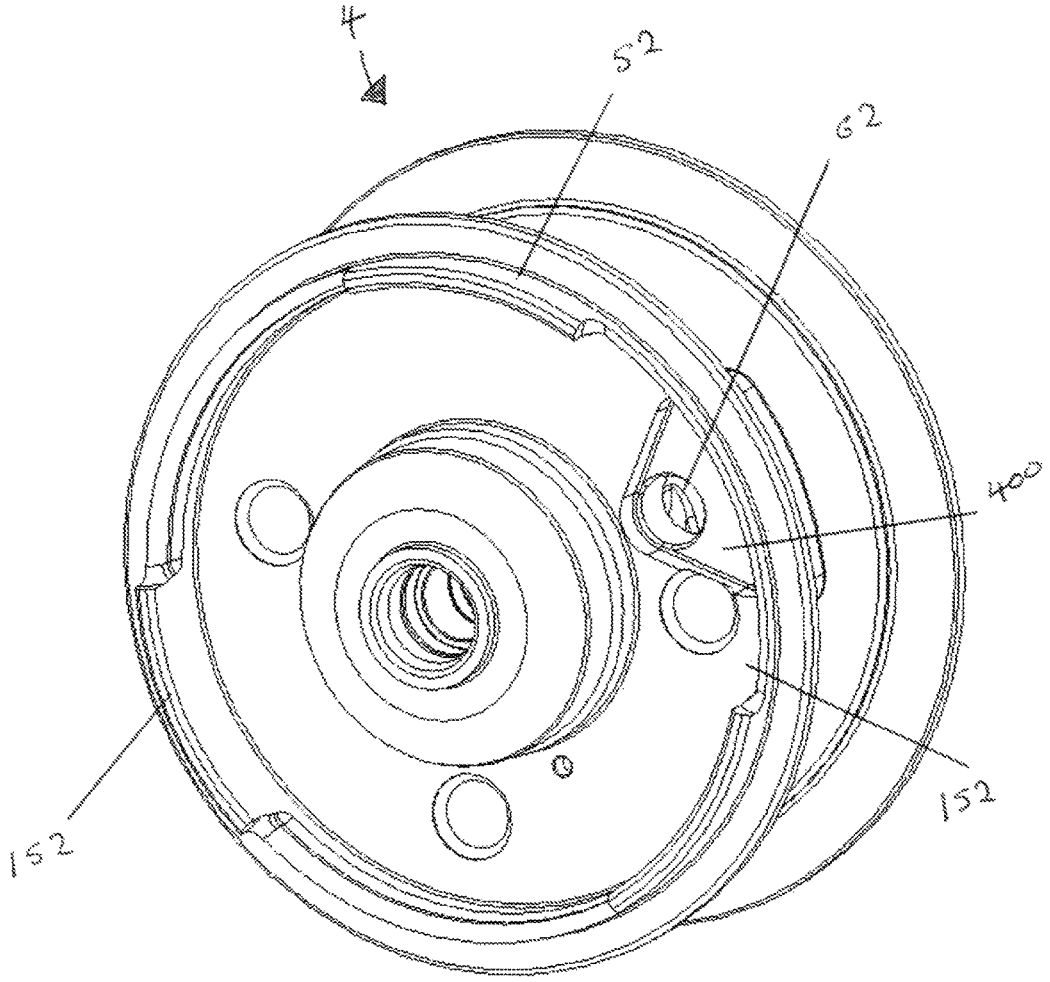
FIG. 67 is a front perspective view of the bearing housing shown in FIGS. 65 and 66.
Figure 68:
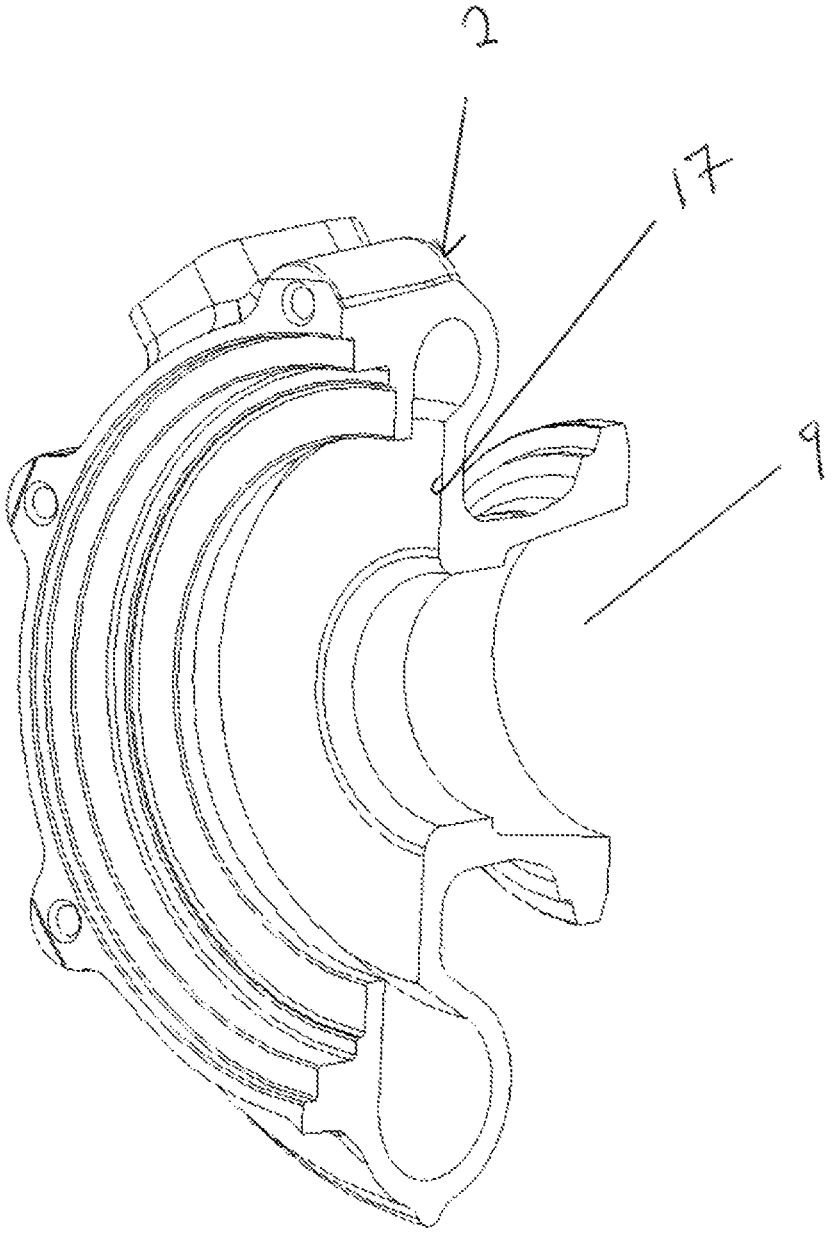
FIG. 68 is a cut away perspective view of a turbine housing of the turbocharger shown in FIGS. 47 to 49.
Figure 70:
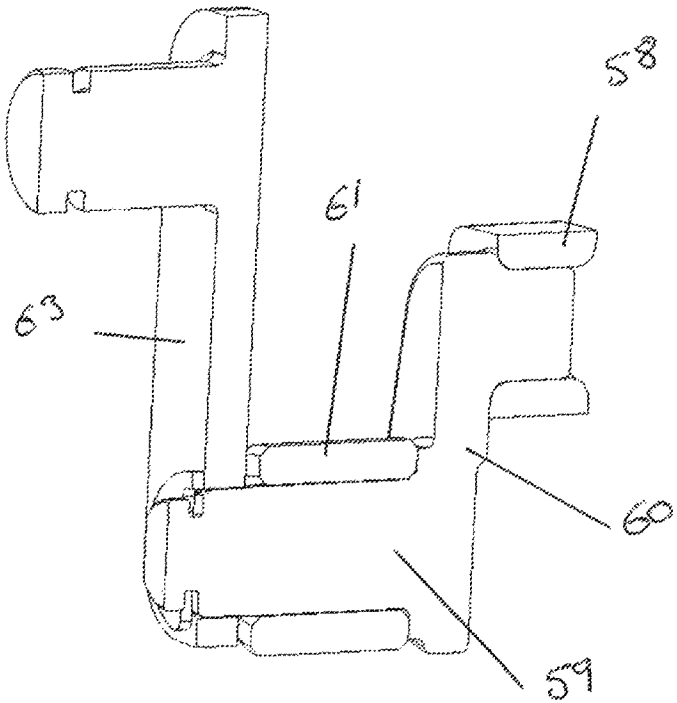
FIG. 70 is a cut away perspective view of the rotatable arm assembly shown in FIG. 69.
Figure 69:
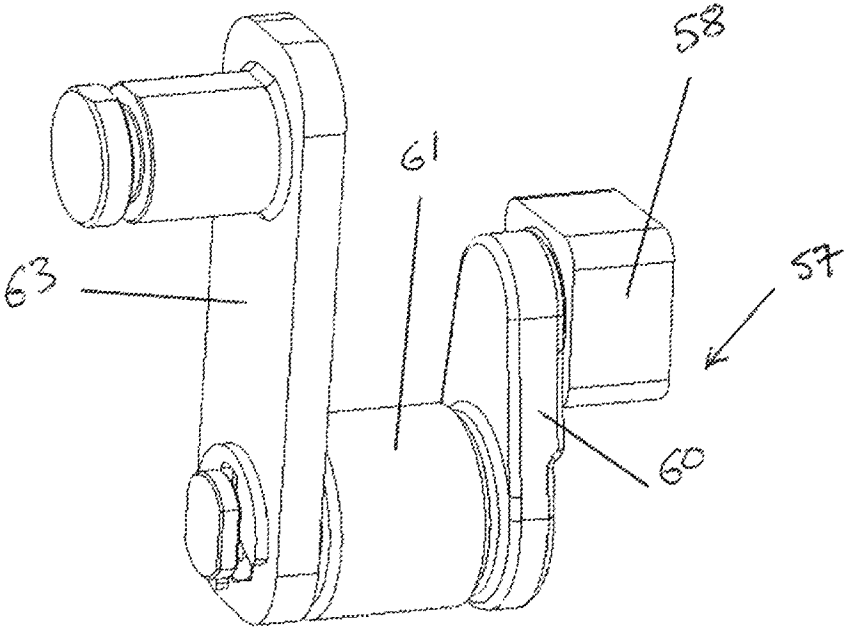
FIG. 69 is a perspective view of a rotatable arm assembly of the turbocharger shown in FIGS. 47 to 49.
Figure 7J:
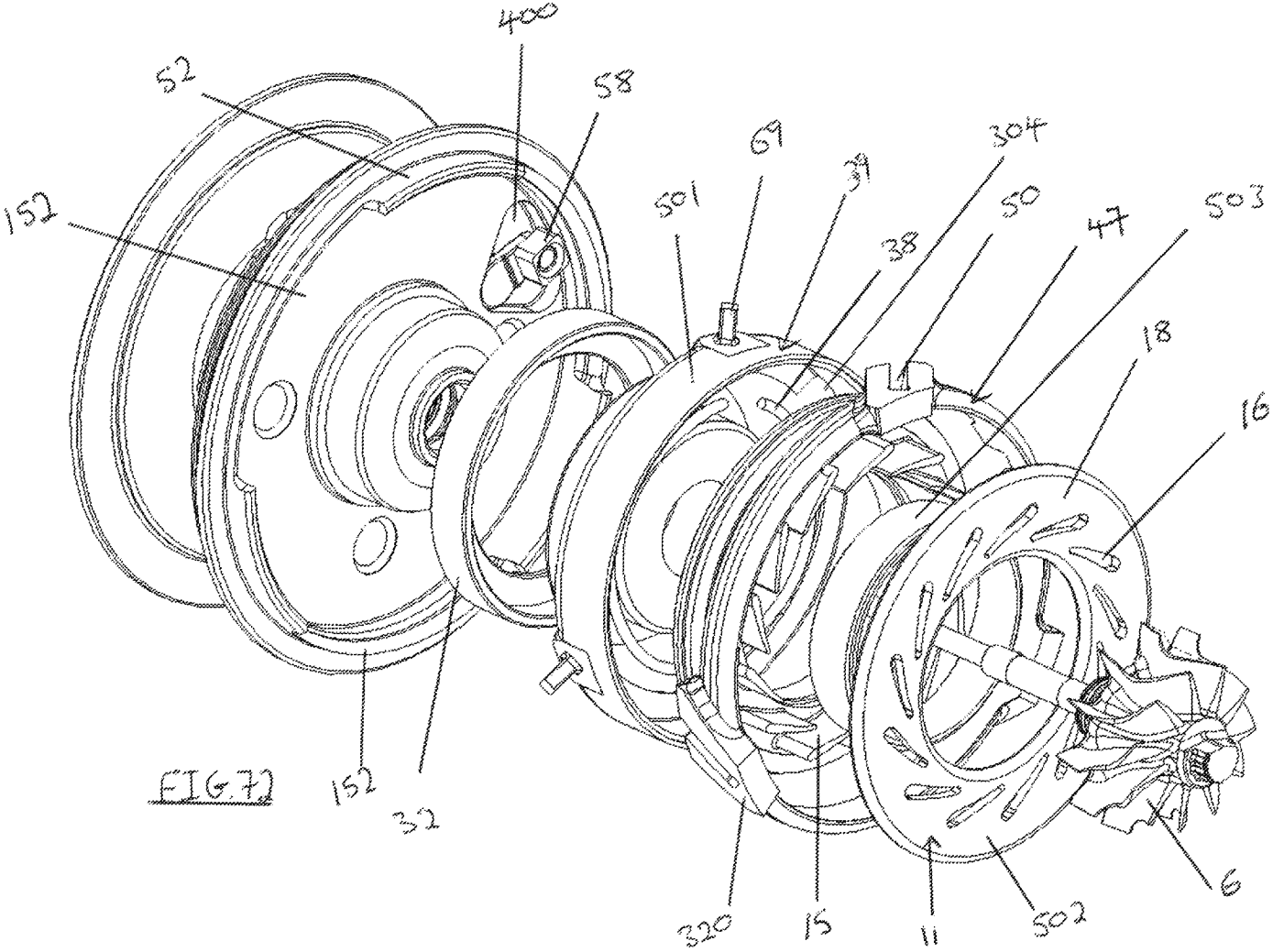
Figure 73:
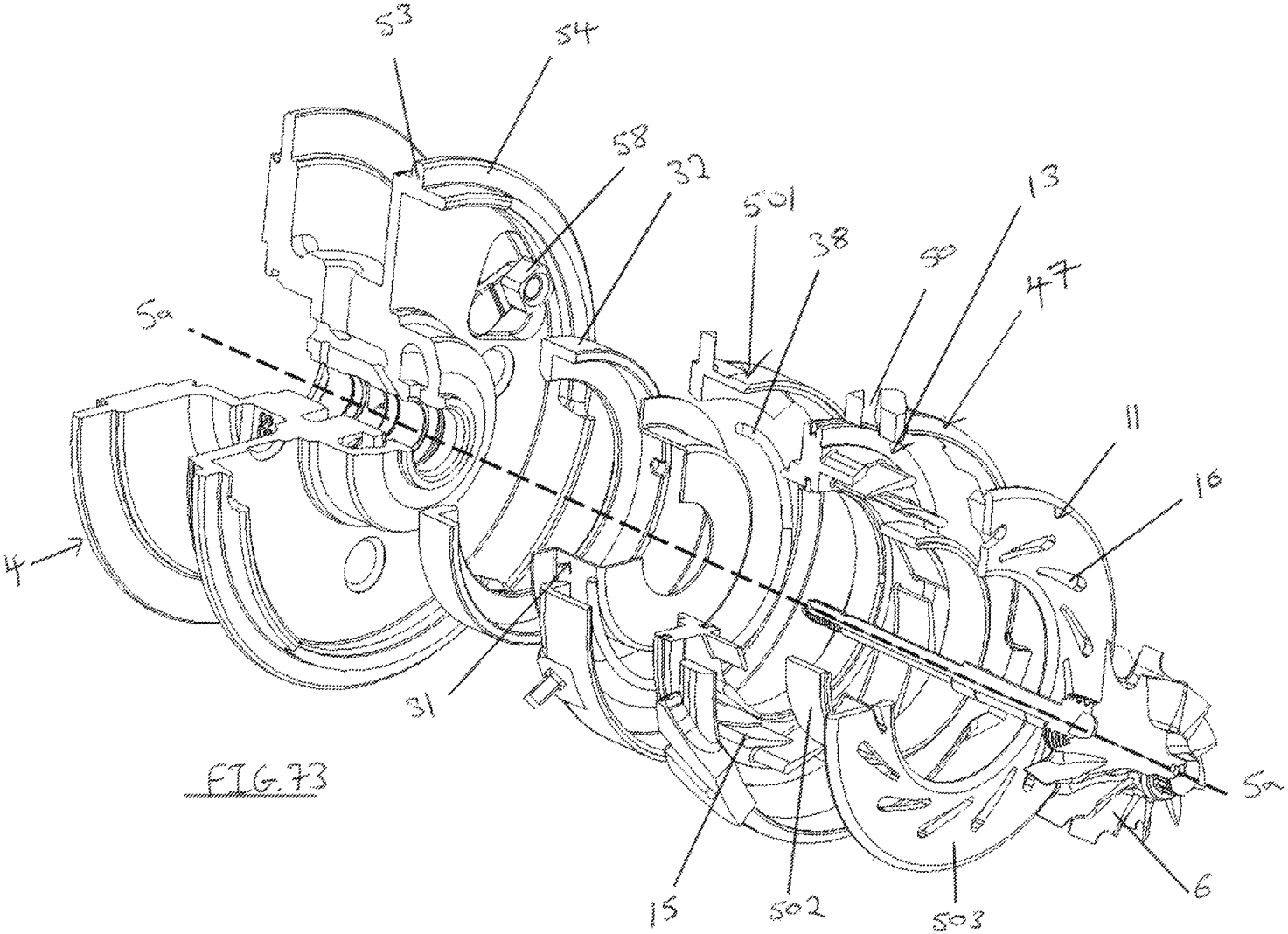
FIG. 73 is a view corresponding to that of FIG. 72, but with a circumferential section cut away for illustrative purposes.
Figure 74:
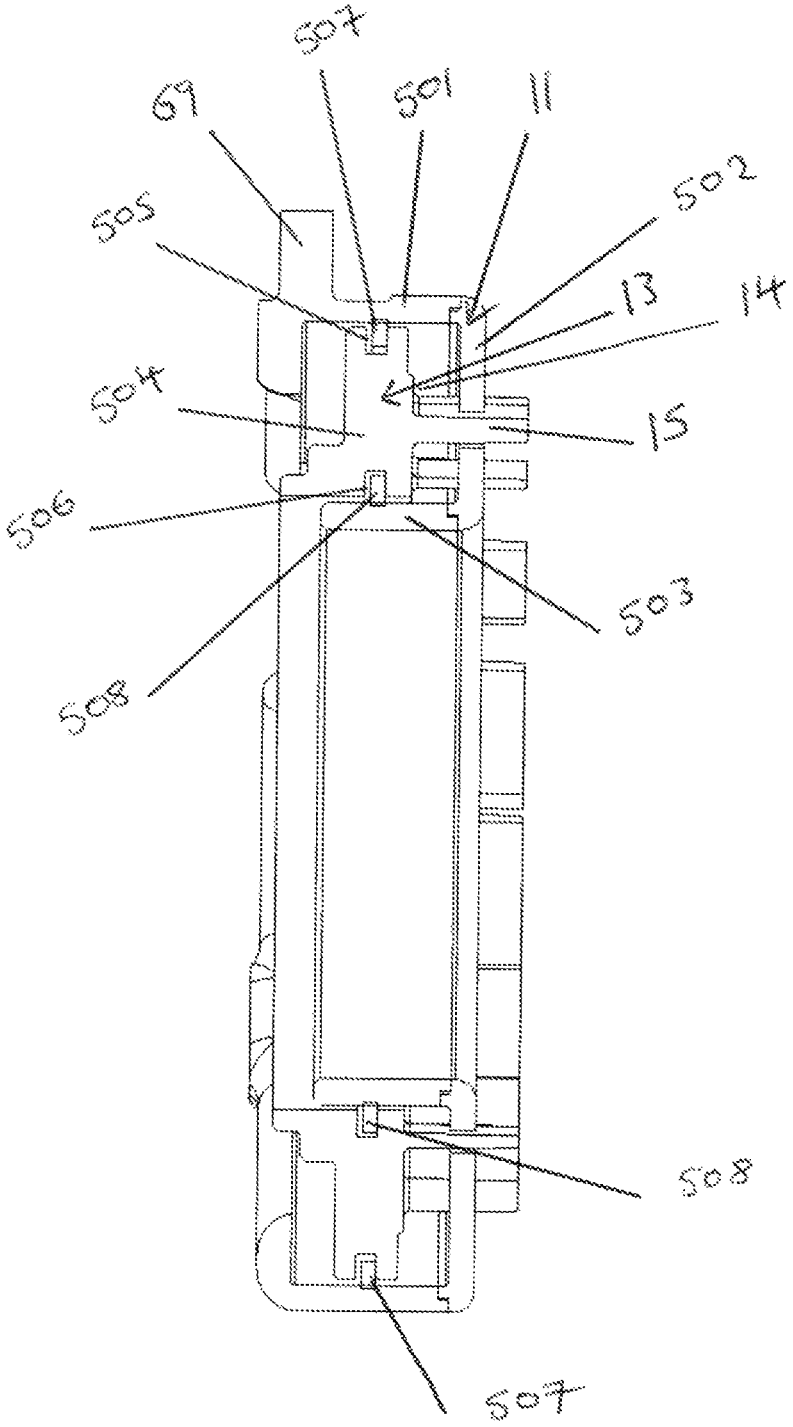
FIG. 74 is an axial cross-section through a carrier member, support member, shroud and nozzle ring of the variable geometry turbine shown in FIGS. 71 to 73.
Figure 75:
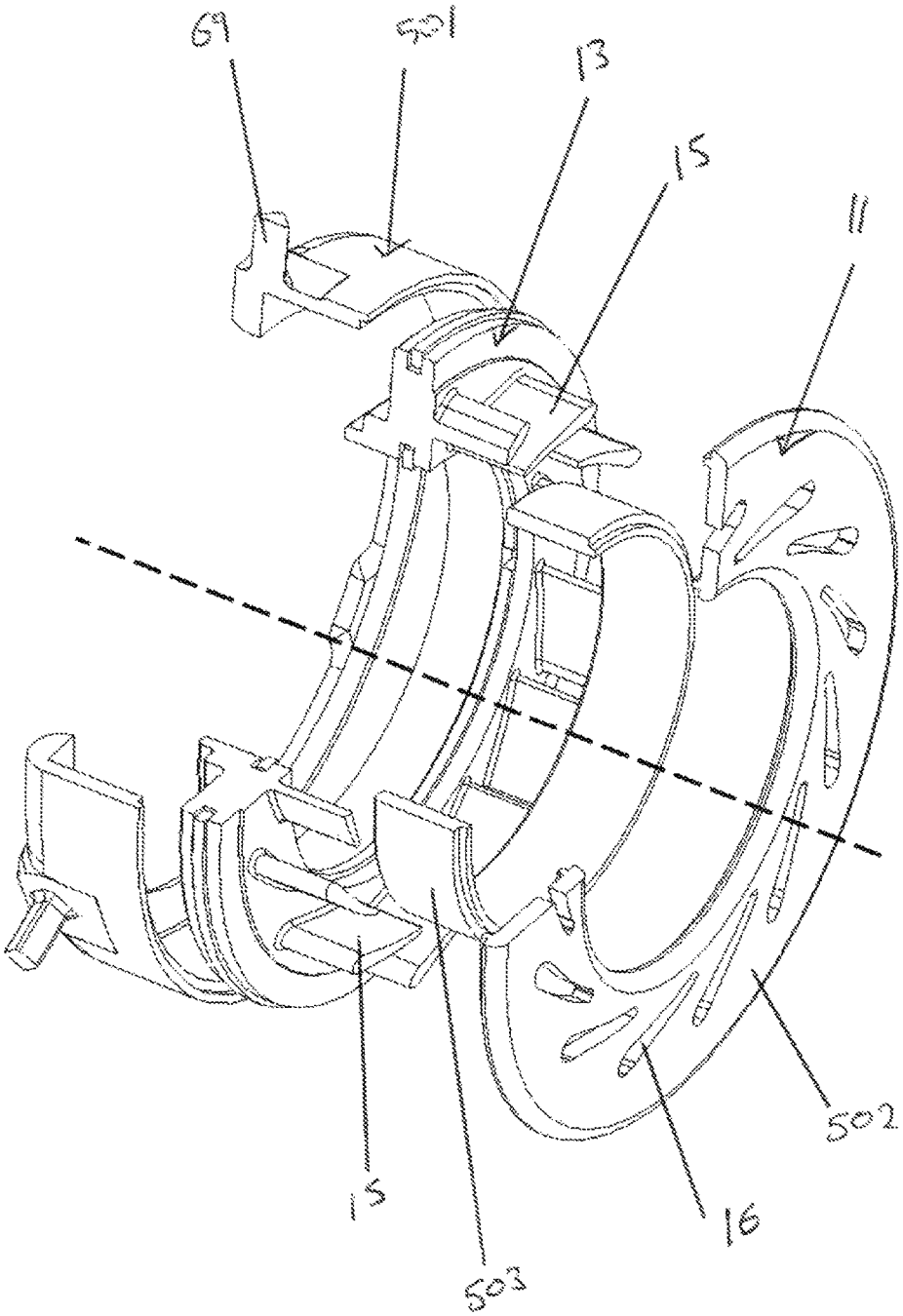
FIG. 75 corresponds to FIG. 74 but in exploded form.
Figure 76:
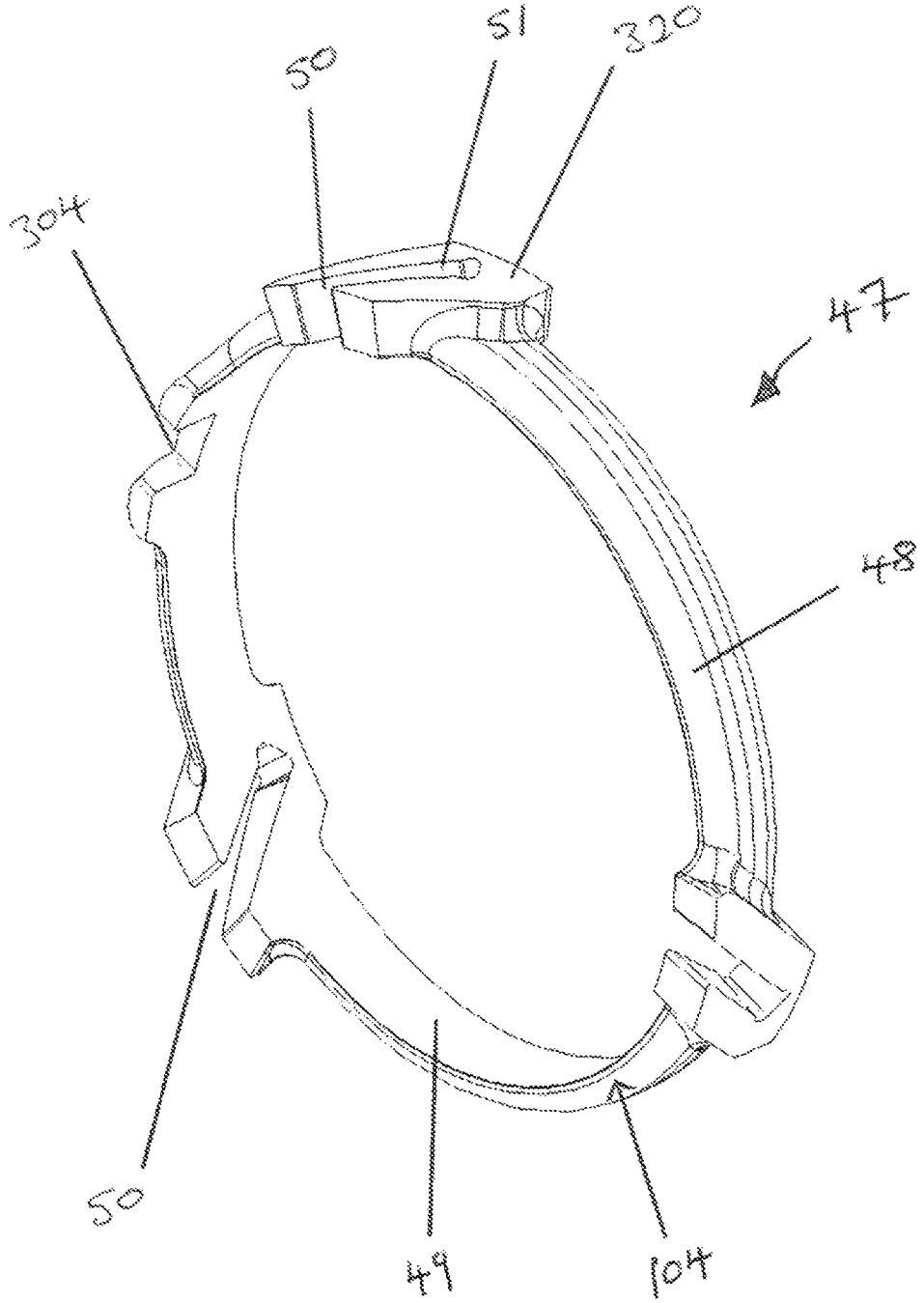
FIG. 76 is a rear perspective view of a cam member of the variable geometry turbine shown in FIGS. 71 to 73.
Figure 78:
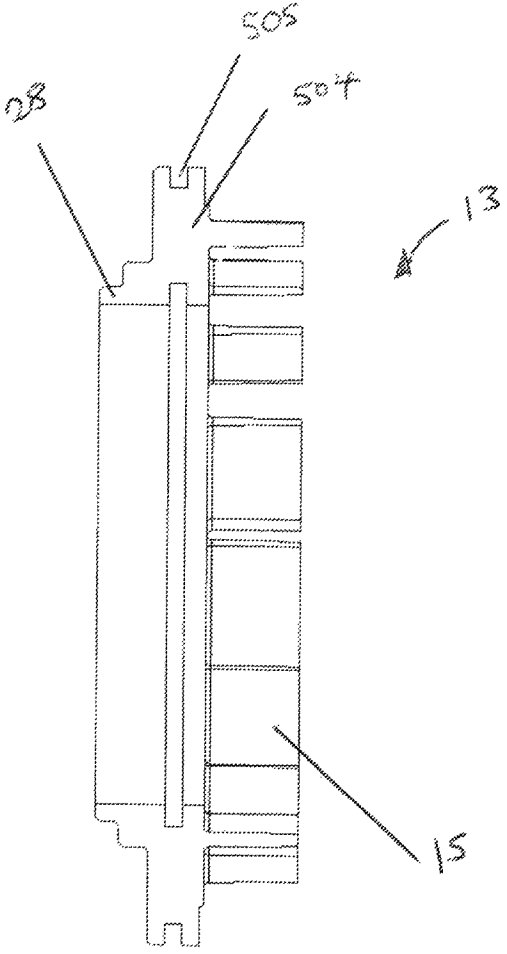
FIG. 78 is an axial cross-sectional view of the nozzle ring shown in FIG. 77.
Figure 77:
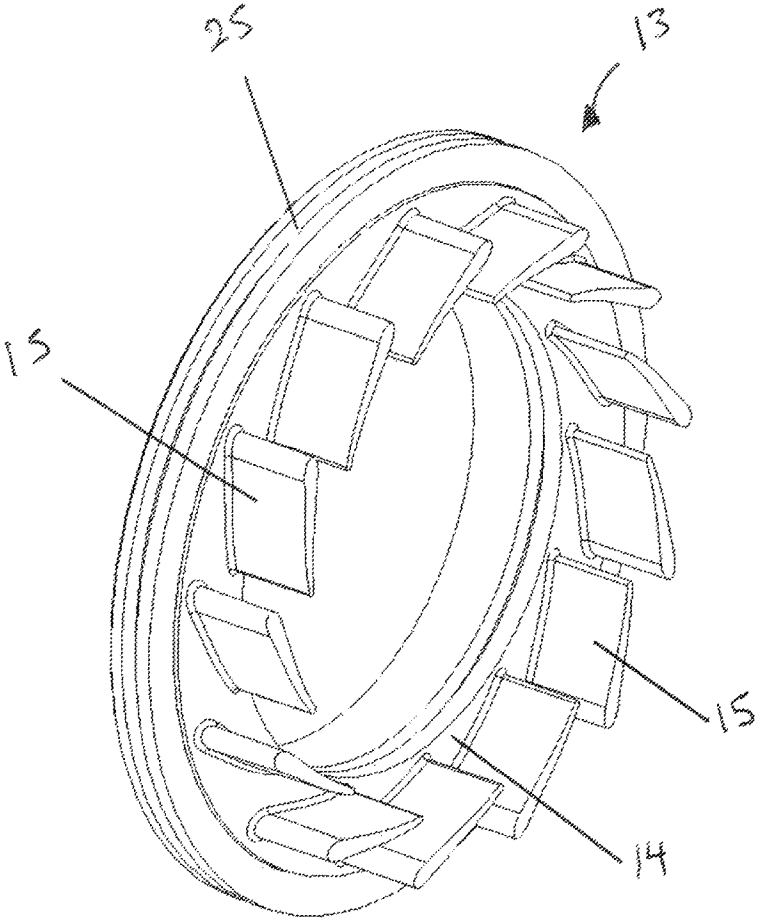
FIG. 77 is a front perspective view of a nozzle ring of the variable geometry turbine shown in FIGS. 71 to 73.
Figure 79:
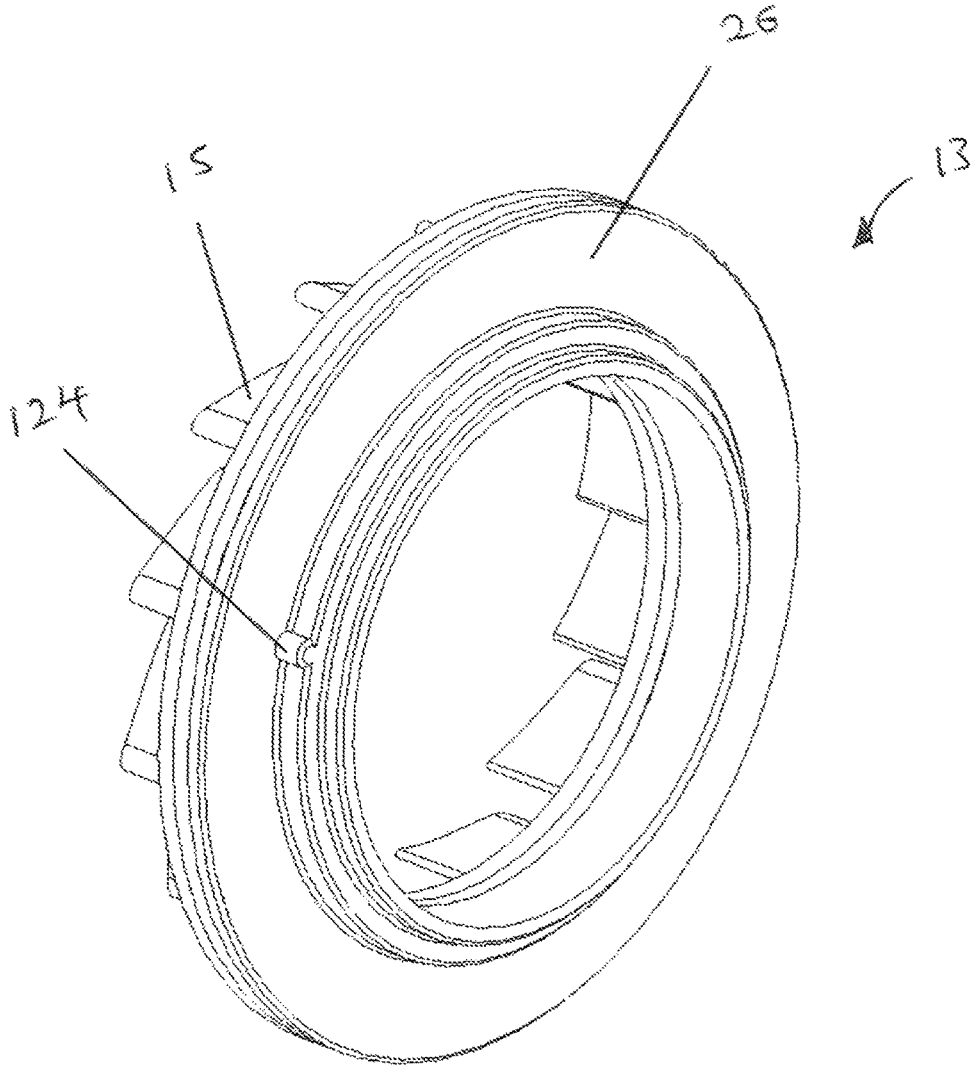
FIG. 79 is a rear perspective view of the nozzle ring shown in FIGS. 77 and 78.
Figure 81:
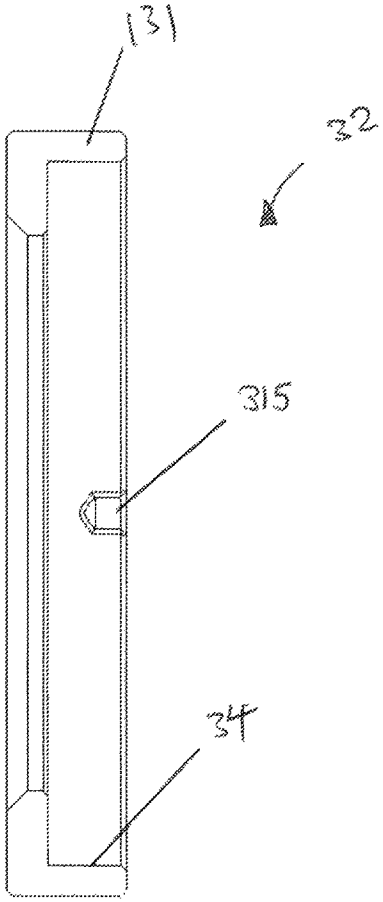
FIG. 81 is an axial cross-sectional view of the support member shown in FIG. 80.
Figure 80:
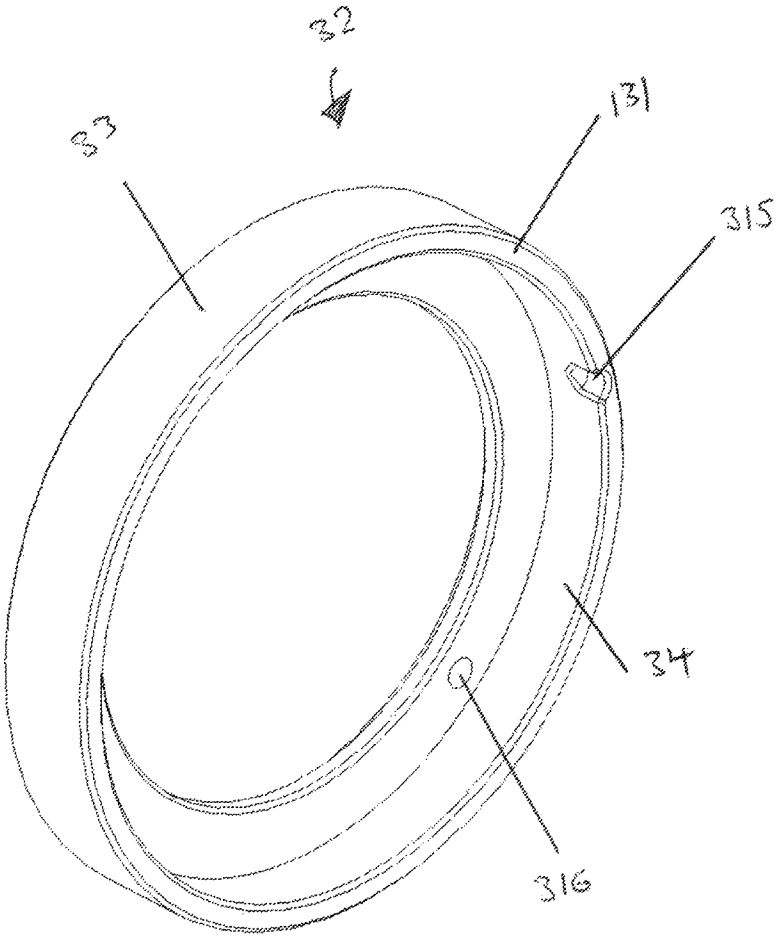
FIG. 80 is a front perspective view of a support member of the variable geometry turbine shown in FIGS. 71 to 73.
Figure 84:
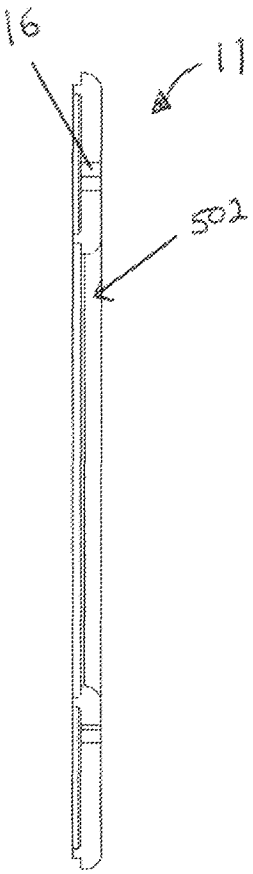
FIG. 84 is an axial cross-sectional view of the radial wall of the shroud shown in FIGS. 82 and 83.
Figure 83:
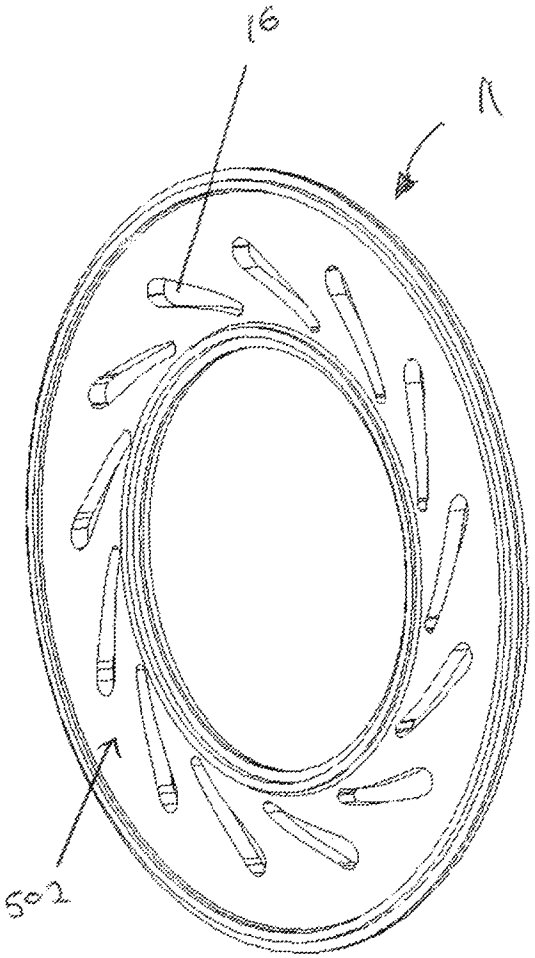
FIG. 83 is a rear perspective view of the radial wall of the shroud shown in FIG. 82.
Figure 82:
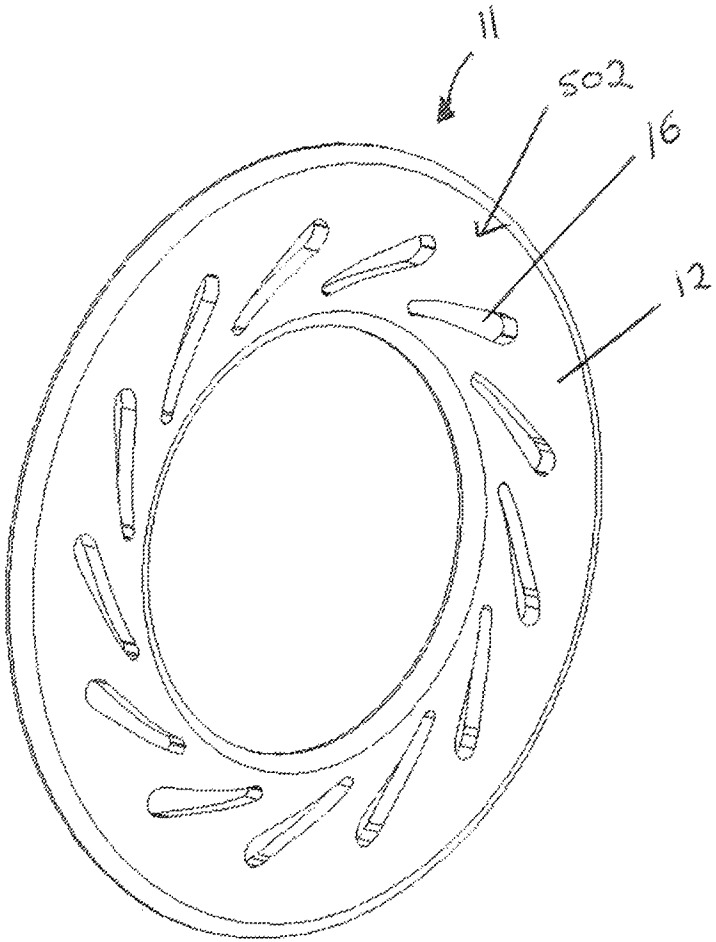
FIG. 82 is a front perspective view of a radial wall of shroud of the variable geometry turbine shown in FIGS. 71 to 73.
Figure 86:
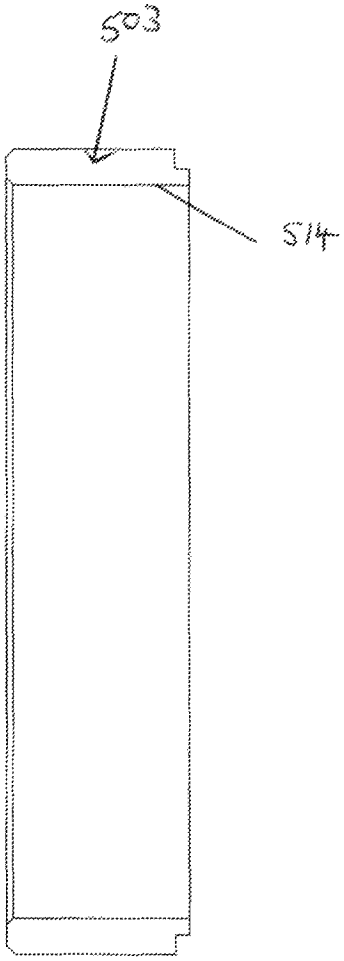
FIG. 86 is an axial cross-sectional view of the radially inner axially extending annular flange of the shroud shown in FIG. 85.
Figure 85:
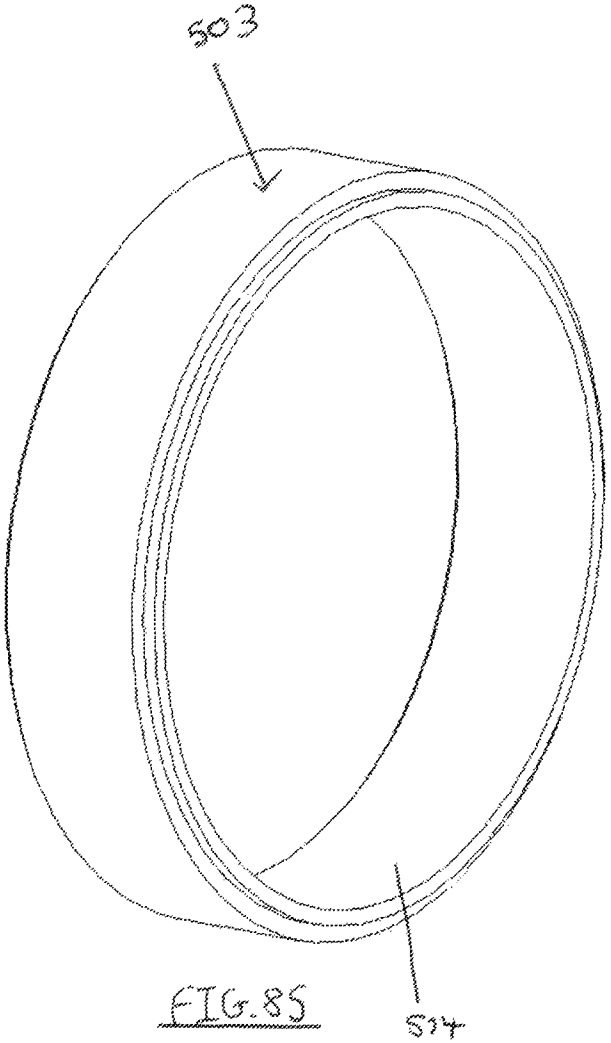
FIG. 85 is a front perspective view of a radially inner axially extending annular flange of the shroud of the variable geometry turbine shown in FIGS. 71 to 73.
Figure 88:
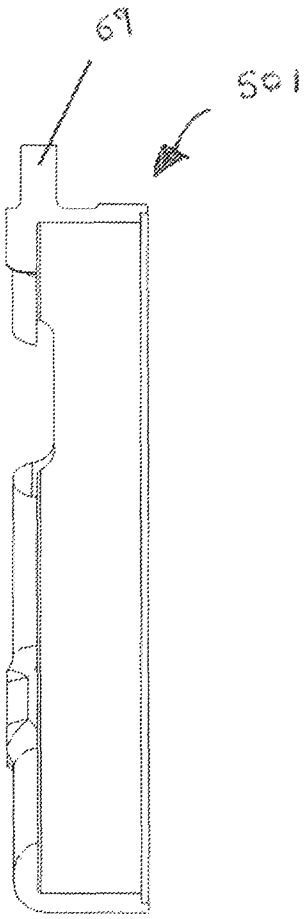
FIG. 88 is an axial cross-sectional view of the radially outer axially extending annular flange of the shroud shown in FIG. 87.
Figure 87:
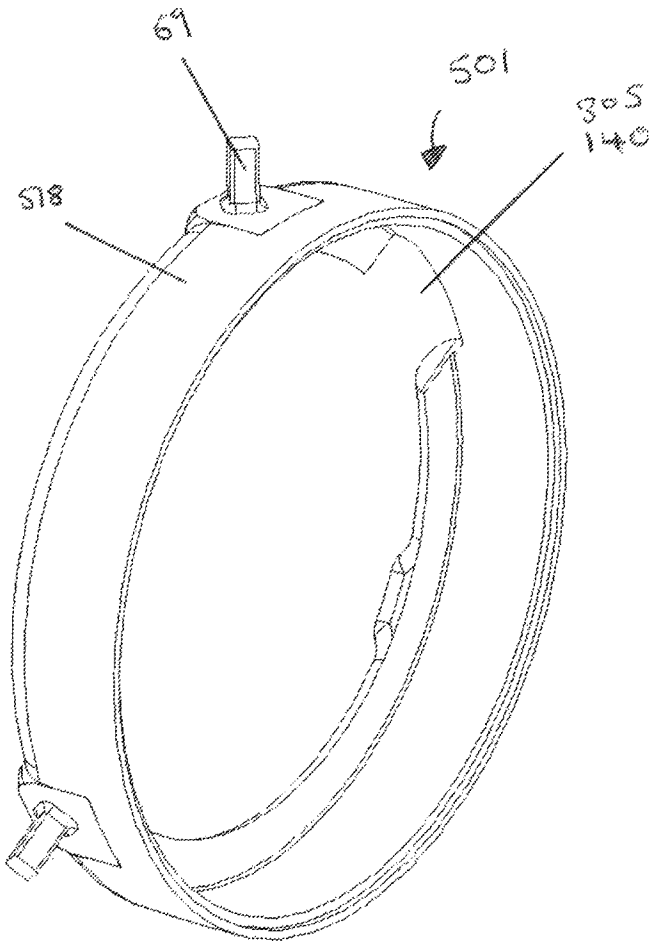
FIG. 87 is a front perspective view of a radially outer axially extending annular flange of the shroud of the turbocharger shown in FIGS. 71 to 73.
Figure 89:
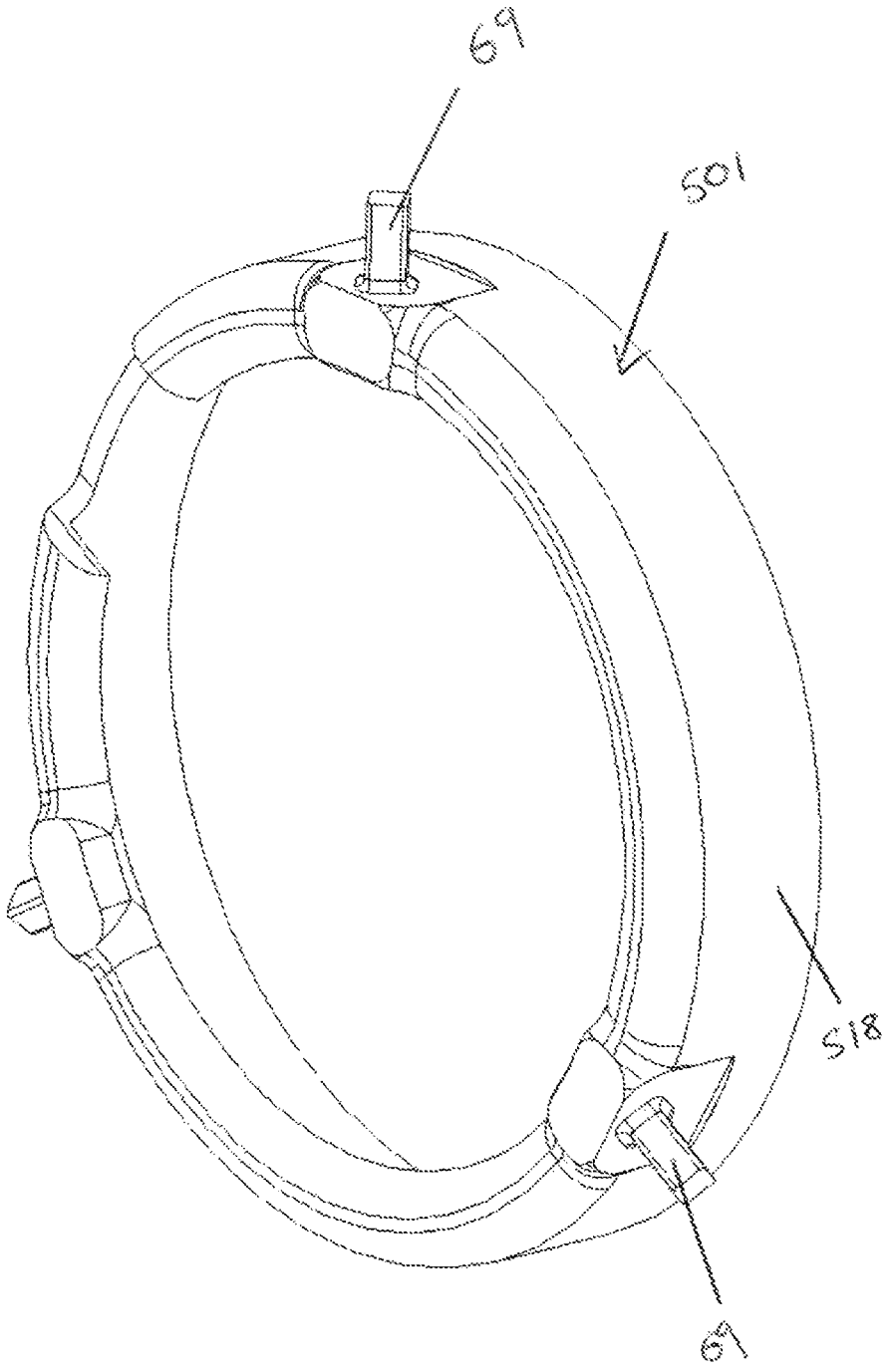
FIG. 89 is a rear perspective view of radially outer, axially extending annular flange of the shroud shown in FIGS. 87 and 88.
Figure 91:
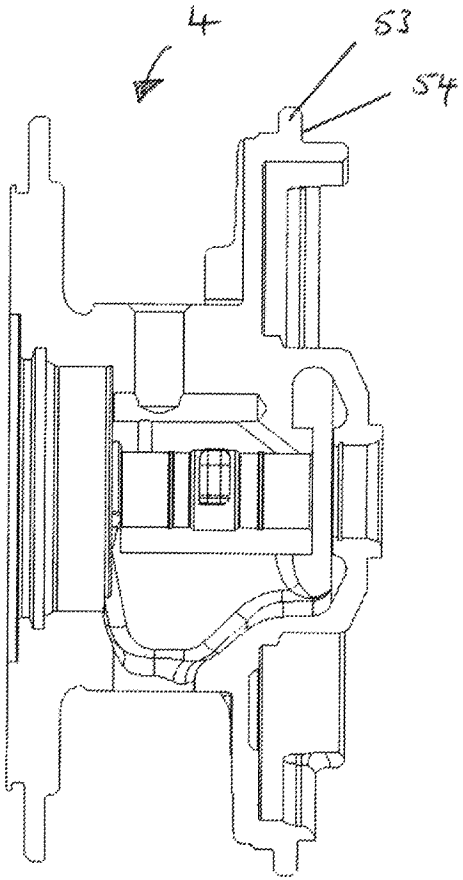
FIG. 91 is an axial cross-sectional view of the bearing housing shown in FIG. 90.
Figure 90:
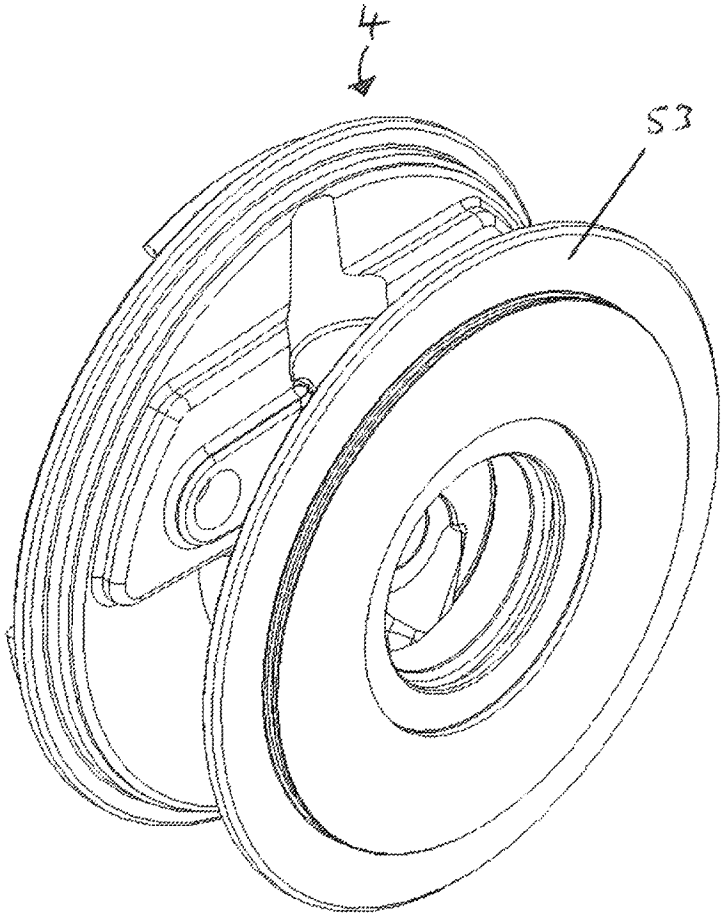
FIG. 90 is a rear perspective view of a bearing housing of the turbocharger shown in FIGS. 71 to 73.
Figure 92:
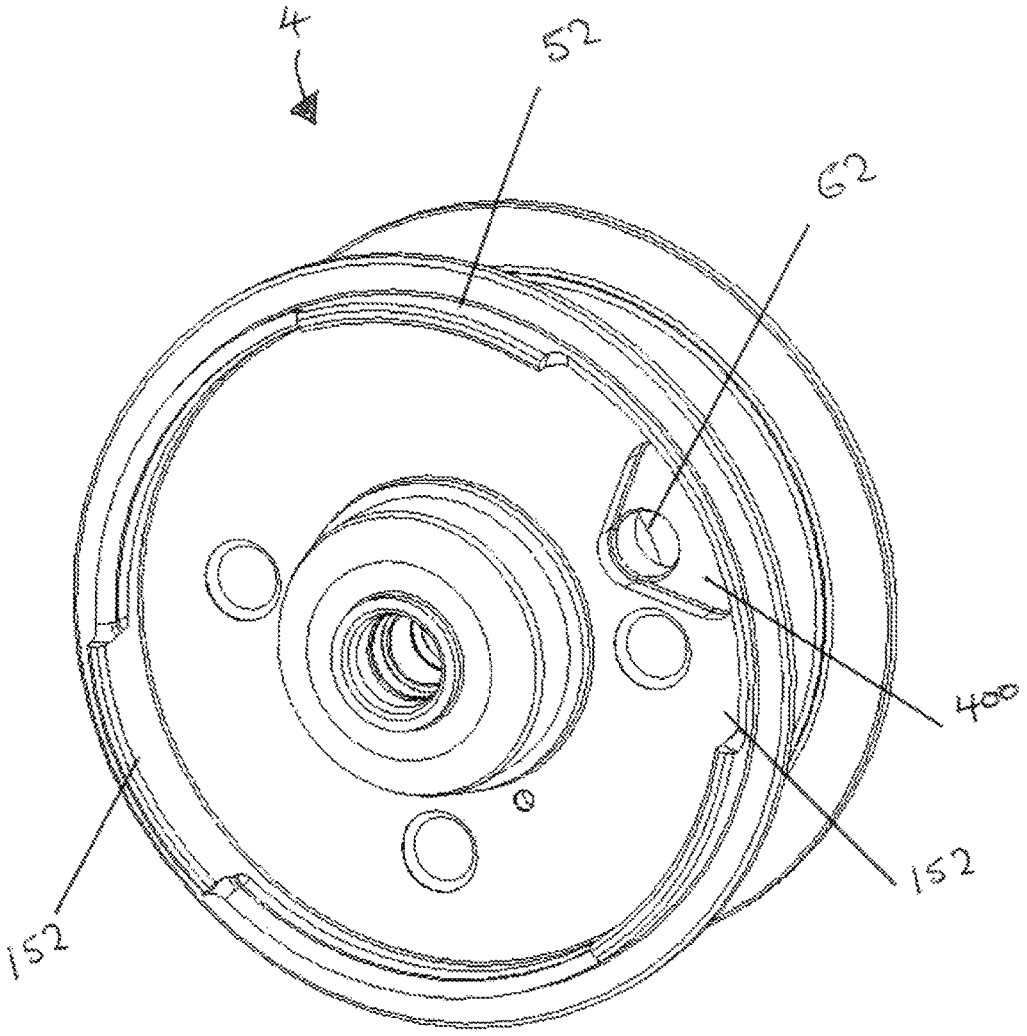
FIG. 92 is a front perspective view of a bearing housing of the turbocharger shown in FIGS. 90 and 91.
Figure 93:
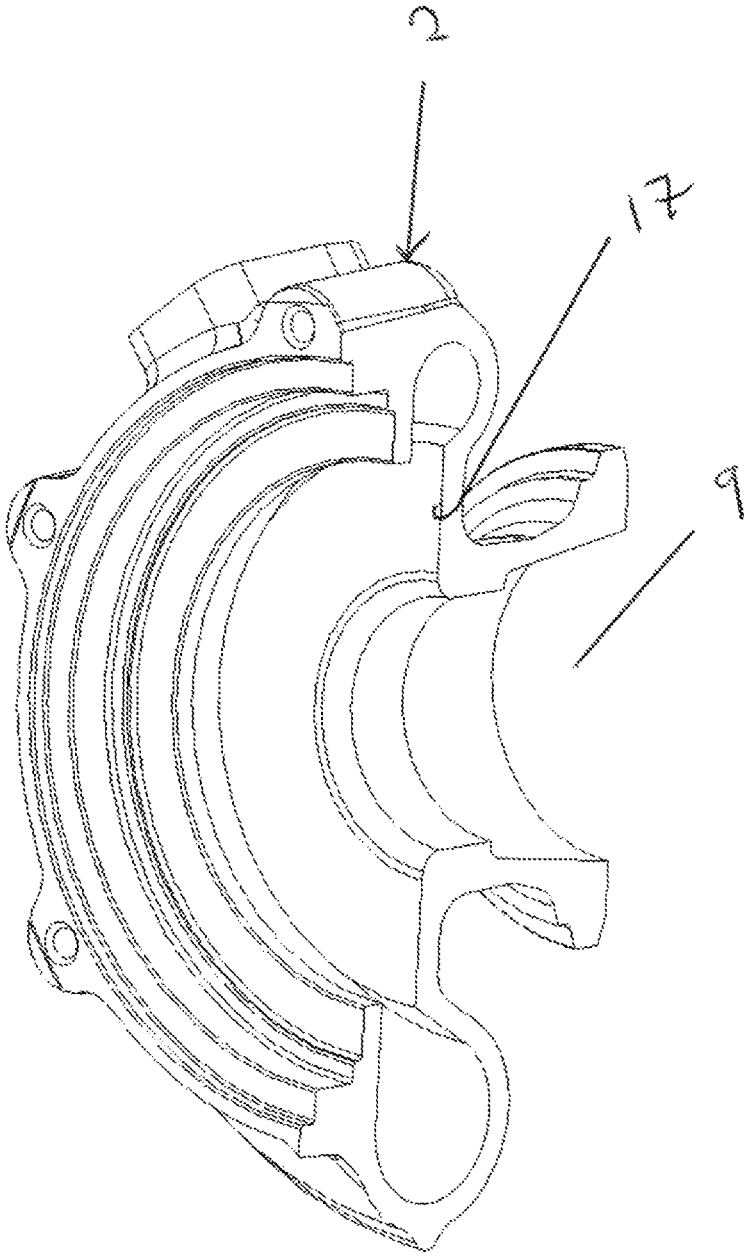
FIG. 93 is a cut away perspective view of a turbine housing of the turbocharger shown in FIGS. 71 to 73.
Figure 95:
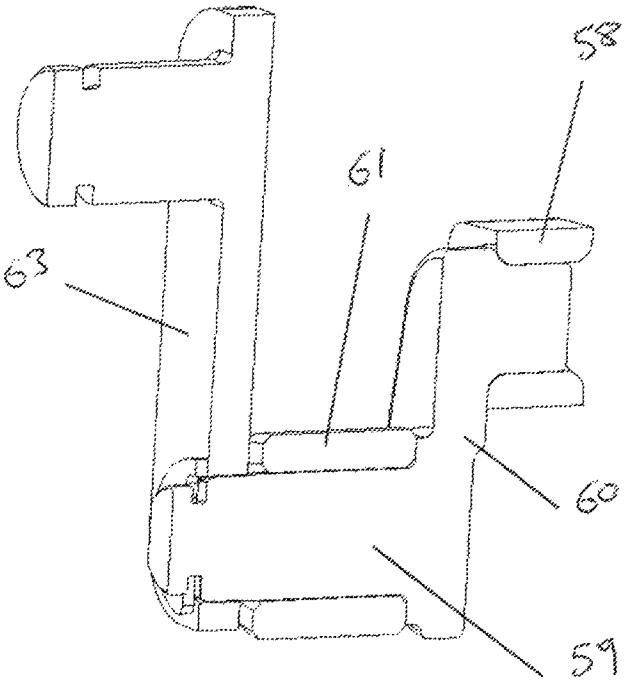
FIG. 95 is a cut away perspective view of the rotatable arm assembly shown in FIG. 94.
Figure 94:
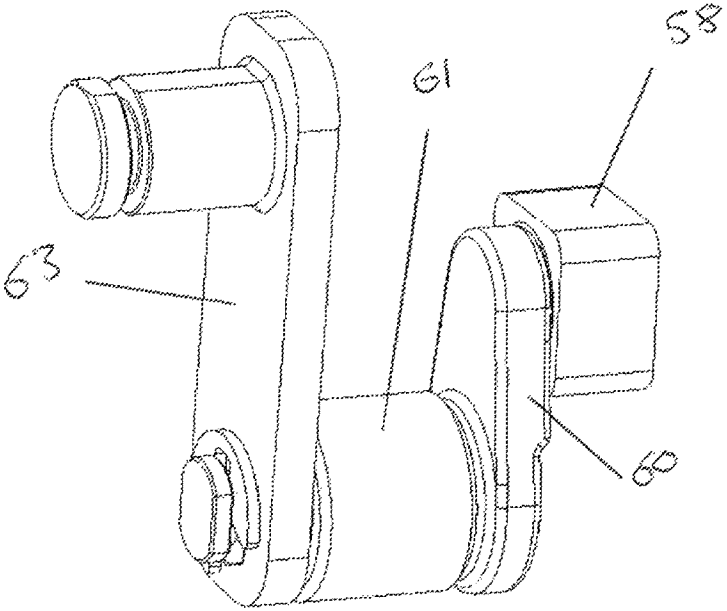
FIG. 94 is a perspective view of a rotatable arm assembly of the turbocharger shown in FIGS. 71 to 73.

In this embodiment, the nozzle ring 13 is provided with a protrusion 124 for rotatably orienting the nozzle ring 13 relative to the support member 32 (see FIG. 54). The protrusion 124 is substantially cylindrical and extends axially outboard, from the outboard surface 14 of the annular wall 25 of the nozzle ring 13. A radially inner surface of the annular wall member 131 of the support member 32 is provided with a recess 315 for receipt of the protrusion 124 of the nozzle ring 13. The recess 315 extends axially inboard from an inboard end of said wall member 131. The recess 315 has a complementary shape to that of the protrusion 124.

Similarly, the annular wall member 131 of the support member 32 is provided with a cylindrical bore 316 that extends axially inboard from the axially outboard surface of the annular wall member 131.

An axially inboard surface of the bearing housing 4 is provided with a bore 318 that extends in the axially outboard direction. The bore 318 is for receipt of a locating pin 317 (see FIG. 58) that is also received within the bore 316 in the support member 32.

In this embodiment the seal 27, 301 of the preceding embodiments, that sealed the radially inner surface of the support member 32 to the radially outer surface of the bearing housing 4 is not present and the radially inner surface of the support member 32 forms a press fit engagement with the radially outer surface of the bearing housing 4.

When the pin 317 is received within the bore 318 in the bearing housing and in the bore 316 in the support member 32, the support member 32 is oriented correctly relative to the bearing housing 4. In addition, when the protrusion 124 of the nozzle ring 13 is received within the recess 315 in the support member 32, the nozzle ring 13 is oriented correctly relative to the support member 32.

Accordingly, said protrusion 124, recess 315, bore 316, pin 317 and bore 318 provide a means of correctly orienting (in the circumferential direction) both the support member 39 and the nozzle ring 13 (and therefore the shroud 11) relative to the bearing housing 4, during assembly. This facilitates ease of assembly of the cartridge assembly 1400.

In this embodiment, the rotatable arm assembly 57 (see FIGS. 69 and 70) is substantially the same as in the preceding embodiments, except in that the protrusion 58 has a substantially square cross-sectional shape, with rounded corners. The slot 304 in the cam member 47 is a complementary square shape to the protrusion 58.

In this embodiment, the heat shield 31 is no longer integral with the nozzle ring 13, but is a separate entity. The nozzle ring 31 is mounted on a radially outer surface of the heat shield 31, between the radially outer surface of the heat shield 31 and axially adjacent radially inner surfaces of the support member 32 and shroud 11.

An axially outboard end of a radially outer annular axially extending flange of the heat shield 31 is provided with an annular, radially outwardly extending, lip 330. The lip 330 is disposed axially outboard of the tolerance ring 38, and is sandwiched between the tolerance ring 38 and a contacting axially inboard surface of the support member 32.

An inboard side of the tolerance ring 38 contacts an inboard surface of the nozzle ring 13, which biases the vanes 15 of the nozzle ring 13 against the facing surface 17 of the turbine housing.

Accordingly, in this embodiment, the tolerance ring 38 directly contacts the nozzle ring 13 to bias it in the axially inboard direction. The heat shield 31 is separate to the nozzle ring 13 and is mounted to the bearing housing 4 such that its lip 330 is disposed axially outboard of the tolerance ring 38. Accordingly, the tolerance ring 38 does not exert a force on the heat shield 31 in the axially inboard direction (as in the previous embodiments). This is advantageous in that, during assembly, the heat shield 31 is not urged in the axially inboard direction (which would otherwise occur before the turbine housing is attached to the bearing housing 4). Therefore the heat shield 301 does not exert a force, in the inboard direction, on the turbine wheel 6, which would be undesirable.

The axially extending flange 52 of the bearing housing 4 is provided with three of said circumferentially extending gaps 152, equally spaced in the circumferential direction. This reduces the weight of the bearing housing 4.

The method of operation of the actuation mechanism is substantially the same as that for the preceding embodiment.

Referring to FIGS. 71 to 95 there is shown a turbocharger comprising a variable geometry turbine assembly according to a fourth embodiment of the present disclosure. The variable geometry turbocharger of the fourth embodiment is identical to the variable geometry turbocharger of the third embodiment, except for the differences described below. Corresponding features are given corresponding reference numerals.

The turbocharger of the fourth embodiment differs from that of the third embodiment in that the shroud 11 is formed from a radially outer, axially extending annular flange 501, a radially inner axially extending annular flange 503 and a radially extending annular wall 502 that connects inboard ends of the radially outer and inner axially extending flanges 501, 503.

An inboard radial surface of the radially extending annular wall 502 forms said inboard surface 12 that defines the inlet passageway. In this regard, the radially extending annular wall 502 forms the movable wall member and the radially outer, axially extending annular flange 501 forms the carrier member. Accordingly, in this embodiment the shroud 11 comprises the movable wall member and the carrier member. As with the preceding embodiments, the inboard surface 12 is provided with said plurality of slots 16 for receipt of the nozzle vanes 15.

The radially outer, axially extending flange 501 extends outboard from a radially outer end of the annular wall 502. An inboard end of the axially extending flange 501 is welded to said radially outer end of the annular wall 502.

In this embodiment, the pins 69 are integrally formed with the radially outer axially extending flange 501, towards an outboard end of said flange 501. The pins 69 extend radially outwardly from a radially outer surface 518 of said flange 501.

The radially inner axially extending flange 503 has a radially inner surface 514 that is mounted on a radially outer surface of the heat shield 31.

The nozzle ring 13 is mounted within the shroud 11. In this regard, the nozzle ring 13 comprises a radially extending wall 504, where the vanes 15 extend axially inboard from an inboard surface 14 of the wall 504 (see FIG. 74). The radially extending wall 504 is provided with a radially outer and inner annular grooves 505, 506 that each house an annular seal 507, 508. The seals 507, 508 respectively seal the radial wall 504 of the nozzle ring 13 against a radially inner surface of the radially outer axially flange 501 and against a radially outer surface of the radially inner axially extending flange 503, as the shroud 11 moves axially, relative to the nozzle ring 13.

The seals 507, 508 advantageously prevent exhaust gas, that has passed through the slots 16, from passing outboard of the seals 507, 508. Furthermore, the radially inner seal 508 prevents this exhaust gas from passing to the turbine wheel.

The method of operation of the actuation mechanism is substantially the same as that for the preceding embodiment.

In each of the described embodiments, the nozzle ring 13 and shroud 11 are mounted on the same axial side of the inlet passageway. In combination with the actuation mechanism of the above described embodiments, this advantageously produces a compact arrangement and allows the actuation mechanism to be formed as a cartridge.

In each of the described embodiments, the carrier member 39 is annular and the cam member 47 and the carrier member 39 axially overlap for at least one axial position of the shroud 11. In combination with the actuation mechanism of the above described embodiments, this advantageously produces a compact arrangement and allows the actuation mechanism to be formed as a cartridge.

It will be appreciated that the cam member 47 and the carrier member 39 axially overlap for a plurality of axial positions of the shroud 11.

In each of the described embodiments, the cam member 47 is disposed radially outwardly of the shroud 11. In combination with the actuation mechanism of the above described embodiments, this advantageously produces a compact arrangement and allows the actuation mechanism to be formed as a cartridge.

It will be appreciated that numerous modifications to the above described variable geometry turbine assembly may be made without departing from the scope of the disclosure as defined by the claims.

In this regard, in the described embodiments the slots 50 in the cam member 47 each form a formation and the pins 69 each form a co-operating formation that is coupled to the carrier member 39 such that as the co-operating formation is moved in the axial direction, the carrier member 39 is moved in the axial direction. In an alternative arrangement to that described, the slots 50 may be provided in the carrier member 39, with the cam member 47 provided with said pins 69 such that rotation of the cam member 47 relative to the carrier member moves the carrier member 39 in the axial direction.

It will be appreciated that the disclosure is not limited to the use of said pins 69 and slots 50. The pins 69 may be any radially extending formation and the slots 50 may be any complimentary recess for receiving the radially extending formation.

In the described embodiments the slots 50 extend in both the circumferential direction and the axial direction and the pins 69 are arranged to move along the slots 50. Alternatively, or additionally, the pins 69 (or any radially extending formation) may extend in both the circumferential direction and the axial direction (e.g. having a helical shape); with the slots 50 being for receipt of the pins 69 such that rotation of the cam member 47 moves the carrier member 39 in the axial direction.

The features of any of the described embodiments may be combined with the features of any of the other described embodiments.

For example, in any embodiment, the pins 69 may be coupled to the shroud 11 as in any other embodiment. For example, in the fourth embodiment the pins 69 are part of the shroud 11. However, the pins 69 may not be part of the shroud and may instead be received within bores in the shroud and/or carrier member 39 as in the first to third embodiments.

The different shapes of the slots 50 in the cam member 47 that are shown in FIGS. 24*a* to 24*c* may be used for any of the described embodiments.

In the described embodiments the shroud 11 is axially movable and the nozzle ring 13 is axially fixed, relative to the bearing housing 4. Alternatively, the nozzle 13 may be axially movable and the shroud 11 fixed in the axial direction. In this case, the nozzle ring 13 is attached to the carrier member 39, instead of the shroud 16 such that the actuation mechanism moves the nozzle ring 13. In this case, the nozzle ring 13 and shroud 13 may be mounted on opposite axial sides of the inlet passageway.

Both the shroud 13 and the nozzle ring 13 may be movable in the axial direction.

In the described embodiments the actuation mechanism is disposed within a cavity 24 between the bearing housing 4 and the turbine housing 2, on the side of the bearing housing 4. Alternatively, the actuation mechanism may be provided in a cavity on the turbine housing 2 side of the annular inlet passageway 10. The actuation mechanism may be housed in any suitable location.

The second to the fourth embodiments may have features of the first embodiment of the annular axially extending flange 52 of the bearing housing 4 provided with said axially extending slots 55, with the pins 69 received within said slots 55.

In the described embodiments the carrier member 39 is disposed radially inwardly of the cam member 47. Alternatively, the carrier member 39 may be disposed radially outwardly of the cam member 47. In this case, the carrier member 39 may be attached to the shroud 11 by any suitable arrangement, for example via a flange which extends in the axial direction and the radially inwardly direction so as to pass over and around the cam member 47 to the shroud 11.

Additionally, or alternatively, the axially extending flange 19 of the shroud may be mounted radially outwardly of the cam member 47.

In the described embodiments the cam member 47 is provided with a set of three slots 50. Alternatively, the cam member 47 may be provided with only a single slot 50. The cam member 47 may be provided with one or more said slots 50.

In this regard, the carrier member 39 may be provided with a corresponding number of said radial bores 43. In relation to the first embodiment the annular axially extending flange 52 of the bearing housing 4 may be provided with a corresponding number of said axially extending slots 55 and with a corresponding number of said radial pins 69 protruding through the respective slots/bores.

In the first embodiment the axial slots 55 are provided in the annular axially extending flange 52 of the bearing housing 54. Alternatively, the slots 55 may be provided in a different housing of the turbocharger 1.

The rotatable arm assembly 57 may be mounted to any housing of the turbocharger 1.

In the described embodiments the nozzle ring 13 is provided with a plurality of inlet vanes 15 and the shroud 11 is provided with a plurality of slots 16. Alternatively, the nozzle ring may not be provided with said inlet vanes 15. In this case, the shroud 11 may not be provided with said slots 16.

The described variable geometry turbine assembly is described when used as part of a variable geometry turbocharger 1. However, it will be appreciated that the variable geometry turbine assembly may be used as part of any turbomachine and is not limited to use with turbochargers. For example, the variable geometry turbine assembly of the disclosure may be used as part of a power turbine, or any other turbomachine.

In the described embodiments the carrier member is coupled to the shroud, so that axial movement of the carrier member causes axial movement of the shroud, by being directly attached to the shroud. Alternatively, the carrier member may be so coupled to the shroud by being indirectly connected to the shroud, for example via an intermediary coupling member. The same applies to the coupling of the carrier member to the nozzle ring, where the nozzle ring comprises the movable wall member.

The variable geometry turbine assembly may not comprise the support member 32. In this case, the carrier member 39 may be axially slidably mounted on a housing of the variable geometry turbine assembly, such as the bearing housing 4.

In the described embodiment the nozzle ring is provided with said protrusion 124 for receipt in said recess 64. Alternatively, or additionally, the cam member and/or the support member may be provided with said protrusion.

The bearing housing may be cast around the support member 32. In order to do this, the support member 32 would be placed into a casing mould and molten metal poured around it. The support member 32 would then be machined in conjunction with the bearing housing to help reduce tolerance stack-ups. The annular groove 36 and seal 37 may then be omitted as there is no longer a potential leakage path needing to be sealed.

The facing inboard surface 17 of the turbine housing 2 may also be movable in the axial direction so as to vary the width of the inlet passageway.

The invention claimed is:

1. A variable geometry turbine assembly comprising:

a turbine wheel mounted within a turbine housing for rotation about a turbine axis;

an annular inlet passageway extending radially inwards towards the turbine wheel;

the annular inlet passageway being defined between a surface of a movable wall member and a facing wall;

the movable wall member being movable in an axial direction so as to vary the size of the annular inlet passageway, and an actuation mechanism arranged to move the movable wall member axially relative to the facing wall;

the actuation mechanism comprising:

a carrier member, the carrier member being movable in the axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both a circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

the turbine assembly further comprising a nozzle ring having a plurality of circumferentially distributed inlet vanes and an annular shroud provided with a plurality of slots for receiving the inlet vanes of the nozzle ring as the shroud is moved axially relative to the nozzle ring;

wherein the shroud comprises the movable wall member; and the nozzle ring and shroud are mounted on the same axial side of the inlet passageway.

2. A variable geometry turbine assembly according to claim 1 wherein the nozzle ring comprises an annular radially extending wall, the plurality of circumferentially distributed inlet vanes extend axially inboard from an inboard surface of the radially extending wall and the annular shroud comprises an annular radially extending wall provided with said plurality of slots, wherein the radially extending wall of the nozzle ring is mounted axially outboard of the radial wall of the shroud.

3. A variable geometry turbine assembly according to claim 1 wherein the variable geometry turbine assembly comprises a bearing housing arranged to house at least one bearing that rotatably supports a shaft on which the turbine wheel is mounted and the shroud and the nozzle ring are mounted on the same axial side of the inlet passageway as the bearing housing.

4. A variable geometry turbine assembly according to claim 1 wherein a wall member of the variably geometry turbine assembly is provided with a formation that is arranged to engage with a complimentary formation on nozzle ring, the carrier member, the cam member and/or the support member such that when the formations are engaged, the nozzle ring, carrier member, cam member and/or the support member is in a specific rotational orientation about the turbine axis.

5. A turbomachine comprising a variable geometry turbine assembly according to claim 1.

6. A variable geometry turbine assembly comprising:

a turbine wheel mounted within a turbine housing for rotation about a turbine axis;

an annular inlet passageway extending radially inwards towards the turbine wheel;

the annular inlet passageway being defined between a surface of a movable wall member and a facing wall;

the movable wall member being movable in the axial direction so as to vary the size of the annular inlet passageway, and an actuation mechanism arranged to move the movable wall member axially relative to the facing wall;

the actuation mechanism comprising:

an annular carrier member, the carrier member being movable in the axial direction and coupled to the movable wall member such that as the carrier member is moved in the axial direction, the moveable wall member is moved in the axial direction;

a cam member mounted for rotation about the turbine axis;

the cam member is provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess to receive the radially extending formation, the at least one formation extending in both the circumferential direction and the axial direction;

the actuation mechanism is arranged such that as the cam member is rotated, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member and the carrier member axially overlap for at least one axial position of the movable wall member.

7. A variable geometry turbine assembly according to claim 6 wherein the cam member and the carrier member axially overlap for a plurality of axial positions of the movable wall member.

8. A variable geometry turbine assembly according to claim 6 wherein the cam member is annular.

9. A variable geometry turbine assembly according to claim 6 wherein the turbine assembly further comprises a nozzle ring having a plurality of circumferentially distributed inlet vanes and an annular shroud provided with a plurality of slots for receiving the inlet vanes of the nozzle ring as the shroud is moved axially relative to the nozzle ring, wherein the nozzle ring or the shroud comprises the movable wall member.

10. A variable geometry turbine assembly comprising:

a turbine wheel mounted within a turbine housing for rotation about a turbine axis;

an annular inlet passageway extending radially inwards towards the turbine wheel;

the annular inlet passageway being defined between a surface of a movable wall member and a facing wall;

the movable wall member being movable in the axial direction so as to vary the size of the annular inlet passageway, and an actuation mechanism arranged to move the movable wall member axially relative to the facing wall;

the actuation mechanism comprising:

a carrier member, the carrier member being movable in the axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member is disposed radially outwardly of the movable wall member.

11. A variable geometry turbine assembly according to claim 10 wherein the cam member and the movable wall member are annular.

12. A variable geometry turbine assembly according to claim 10 wherein the turbine assembly further comprises a nozzle ring having a plurality of circumferentially distributed inlet vanes and an annular shroud provided with a plurality of slots for receiving the inlet vanes of the nozzle ring as the shroud is moved axially relative to the nozzle ring, wherein the nozzle ring or the shroud comprises the movable wall member.

13. A variable geometry turbine assembly comprising:

a turbine wheel mounted within a turbine housing for rotation about a turbine axis;

an annular inlet passageway extending radially inwards towards the turbine wheel;

the annular inlet passageway being defined between a surface of a movable wall member and a facing wall of a housing of the variable geometry turbine assembly;

the movable wall member being movable in the axial direction so as to vary the size of the annular inlet passageway, and an actuation mechanism arranged to move the movable wall member axially, relative to the facing wall of the housing;

the actuation mechanism comprising:

a carrier member, the carrier member being movable in the axial direction and coupled to the movable wall member such that as the carrier member is moved in the axial direction, the moveable wall member is moved in the axial direction, the carrier member having an annular wall provided with at least one radially extending bore;

at least one radially extending coupling element received in the at least one radially extending bore in the annular wall of the carrier member such that as the at least one coupling element is moved in the axial direction, the carrier member is moved in the axial direction;

a cam member mounted for rotation about the turbine axis, the cam member having an annular wall provided with at least one slot defined by at least one surface of the annular wall, the at least one slot extending in both the circumferential direction and the axial direction;

the at least one coupling element also being received in the at least one slot in the cam member;

wherein a wall member is provided with at least one axially extending slot, the at least one coupling element also being received in at least one axially extending slot;

and wherein the actuation mechanism is arranged such that as the cam member is rotated about the turbine axis, the at least one slot in the annular wall of the cam member is moved relative to the at least one coupling element, with the at least one surface of the cam member that defines the at least one slot acting on the at least one coupling element to move the at least one coupling element in a the axial direction, along the at least one axially extending slot in said wall member, thereby moving the carrier member in the axial direction and thereby moving the movable wall member in the axial direction, so as to vary the width of the inlet passageway.

14. A variable geometry turbine assembly according to claim 13 wherein the carrier member is axially fixed relative to the movable wall member.

15. A variable geometry turbine assembly according to claim 13 wherein the variable geometry turbine assembly comprises a nozzle ring provided with a plurality of guide vanes distributed circumferentially about the nozzle ring that are receivable into the annular inlet passageway.

16. A variable geometry turbine assembly according to claim 13 wherein the carrier member, movable wall member, cam member and the at least one coupling element form a cartridge assembly.

17. An actuation mechanism assembly comprising an actuation mechanism for moving a movable wall member, a surface of which defines, with a facing wall, an annular inlet passageway of a turbine, so as to vary the width of the annular inlet passageway, the actuation mechanism comprising a carrier member, the carrier member being movable in an axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

the actuation member assembly further comprising a nozzle ring having a plurality of circumferentially distributed inlet vanes and an annular shroud provided with a plurality of slots for receiving the inlet vanes of the nozzle ring as the shroud is moved axially relative to the nozzle ring;

wherein the shroud comprises the movable wall member;

and the nozzle ring and shroud are mountable on the same axial side of the inlet passageway.

18. An actuation mechanism for moving a movable wall member, a surface of which defines, with a facing wall, an annular inlet passageway of a turbine, so as to vary the width of the annular inlet passageway, the actuation mechanism comprising:

an annular carrier member, the carrier member being movable in an axial direction and for coupling to the movable wall member such that as the carrier member is moved in the axial direction, the moveable wall member is moved in the axial direction a cam member mounted for rotation;

the cam member is provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess to receive the radially extending formation, the at least one formation extending in both the circumferential direction and the axial direction;

the actuation mechanism is arranged such that as the cam member is rotated, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member and the carrier member axially overlap for at least one axial position of the movable wall member.

19. An actuation mechanism assembly comprising an actuation mechanism and a movable wall member, wherein the actuation mechanism is for moving the movable wall member, a surface of which is for defining, with a facing wall, an annular inlet passageway of a turbine, so as to vary the width of the annular inlet passageway, the actuation mechanism comprising:

a carrier member, the carrier member being movable in an axial direction and coupled to the movable wall member such that as the carrier member is moved in the axial direction, the moveable wall member is moved in the axial direction a cam member provided with at least one formation;

the carrier member being coupled to at least one co-operating formation such that as the at least one co-operating formation is moved in the axial direction, the carrier member is moved in the axial direction, wherein one of the at least one formation and the at least one co-operating formation is a radially extending formation and the other defines a complimentary recess for receiving the radially extending formation, the at least one formation or the at least one co-operating formation extending in both the circumferential direction and the axial direction;

the actuation mechanism is arranged such that as the cam member is rotated relative to the carrier member, the at least one formation and the at least one co-operating formation engage such that the at least one co-operating formation is moved in the axial direction, thereby moving the carrier member in the axial direction, and thereby moving the movable wall member in the axial direction so as to vary the size of the inlet passageway;

wherein the cam member is disposed radially outwardly of the movable wall member.

20. An actuation mechanism for moving a movable wall member, a surface of which defines, with a facing wall of a housing, an annular inlet passageway of a turbine, so as to vary the width of the annular inlet passageway, the actuation mechanism comprising:

a carrier member for coupling to the movable wall member, a surface of which defines, with the facing wall of the housing, an annular inlet passageway of the turbine, such that as the carrier member is moved in the direction of a longitudinal axis of the carrier member, the moveable wall member is moved in the axial direction, the carrier member having an annular wall provided with at least one radially extending bore;

at least one radially extending coupling element being received in the at least one radially extending bore in the annular wall of the carrier member such that as the at least one coupling element is moved in the axial direction, the carrier member is moved in the axial direction;

a cam member mounted for rotation about said axis, the cam member having an annular wall provided with at least one slot defined by at least one surface of the annular wall, the at least one slot extending in both the circumferential direction and the axial direction;

the at least one coupling element also being received in the at least one slot in the cam member;

the at least one coupling element being for receipt in at least one axially extending slot in a wall member such that as the cam member is rotated about said axis, the at least one slot in the annular wall of the cam member is moved relative to the at least one coupling element, with the at least one surface of the cam member that defines the at least one slot acting on the at least one coupling element to move the at least one coupling element in a the axial direction, along the at least one axially extending slot in said wall member, thereby moving the carrier member in the axial direction and thereby moving the movable wall member in the axial direction, so as to vary the width of the inlet passageway.

* * * * *